US008677920B1

(12) United States Patent
Jeng

(10) Patent No.: US 8,677,920 B1
(45) Date of Patent: Mar. 25, 2014

(54) UNDERWATER VEHICLE

(75) Inventor: Jack Ing Jeng, Old Westbury, NY (US)

(73) Assignee: Ocom Technology LLC, Arcadia, CA (US)

( * ) Notice: Subject to any disclaimer, the term of this patent is extended or adjusted under 35 U.S.C. 154(b) by 907 days.

(21) Appl. No.: 12/203,054

(22) Filed: Sep. 2, 2008

Related U.S. Application Data

(60) Provisional application No. 60/969,106, filed on Aug. 30, 2007.

(51) Int. Cl.
*B63G 8/00* (2006.01)

(52) U.S. Cl.
USPC ..... 114/312; 114/327; 114/77 R

(58) Field of Classification Search
USPC ..... 114/77 A, 77 R, 312–346
See application file for complete search history.

(56) References Cited

U.S. PATENT DOCUMENTS

| | | | | | |
|---|---|---|---|---|---|
| 788,525 | A * | 5/1905 | D'Quevilley | 114/332 |
| 872,842 | A * | 12/1907 | Peacock | 114/332 |
| 1,300,745 | A * | 4/1919 | Lieske | 114/316 |
| 2,365,066 | A * | 12/1944 | Fuller | 114/240 R |
| 2,873,710 | A * | 2/1959 | Morel | 114/330 |
| 3,832,965 | A * | 9/1974 | Walker | 114/321 |
| 3,903,825 | A * | 9/1975 | Hamy | 114/77 R |
| 4,611,551 | A * | 9/1986 | Ferguson et al. | 114/339 |
| 5,121,702 | A * | 6/1992 | Johnson et al. | 114/330 |
| 5,322,003 | A * | 6/1994 | Winyard et al. | 91/363 A |
| 5,979,354 | A * | 11/1999 | Arzola | 114/312 |
| 6,095,078 | A * | 8/2000 | Adams | 114/330 |
| 7,290,496 | B2 * | 11/2007 | Asfar et al. | 114/312 |
| 2006/0042532 | A1 * | 3/2006 | Wong et al. | 114/144 RE |
| 2008/0041294 | A1 * | 2/2008 | Diorio et al. | 114/312 |

FOREIGN PATENT DOCUMENTS

| | | | | |
|---|---|---|---|---|
| DE | 4023322 | A1 * | 1/1992 | B63G 8/38 |
| WO | WO 9200874 | A1 * | 1/1992 | B63G 8/34 |

* cited by examiner

*Primary Examiner* — Edwin Swinehart
(74) *Attorney, Agent, or Firm* — The Mueller Law Office, P.C.

(57) ABSTRACT

Various aspects can be implemented to provide a reconfigurable underwater vehicle. In general, one aspect of the subject matter described in this specification can be embodied in a underwater vehicle that includes a hull that is angular in shape and capable of avoiding sonar detection. The hull can include a bow and a stern that are substantially similar in shape. The underwater vehicle can also include a plurality of reconfigurable modules that are interconnected to form the hull of the underwater vehicle. Each reconfigurable module is capable of performing a different function associated with operation of the underwater vehicle. Further, the plurality of reconfigurable modules can be built in a warehouse away from a shipyard and assembled to form the underwater vehicle at the shipyard.

22 Claims, 80 Drawing Sheets

UNDERWATER VEHICLE

CROSS-REFERENCE TO RELATED APPLICATIONS

This application claims priority to U.S. Provisional Application Ser. No. 60/969,106, filed on Aug. 30, 2007. The disclosure of the prior application is considered part of the disclosure of this application and is incorporated by reference in its entirety.

TECHNICAL FIELD

This disclosure generally relates to the design, construction, configuration, and deployment of an underwater vehicle (UV), which can be either manned or unmanned.

BACKGROUND

Underwater vehicles (UVs), such as submarines, can be used for various applications, including military, scientific, and sightseeing applications. A military submarine can be very expensive to build. For example, it can cost about $750M for an SSK-class submarine and over $2 B for an SSN-class submarine, and it can take about 2 years to build. Such military submarines generally have about 60 to 100 crew members to operate in three shifts. There can be limitations for the command, control and communication in the deep ocean. There can also be a limited supply of oxygen for the engine and the crew to use. Other safety and security concerns are possible while operating a traditional military UV.

The basic maneuvering function of a UV in the ocean is based on buoyancy control. Buoyancy control can be achieved by a high pressure pneumatic valve control, which coordinates with the hull valve to regulate water intake and expression. These valves, together with the pipe connectors of the manifold system, can require regular human monitoring and manual maintenance because of the high pressure environment in the deep sea. The valves and pipe connectors can also be susceptible to unexpected failures during combat.

While underwater, a UV has a limited air supply for the engine and the crew members. Therefore, the UV has to surface to get air for the engine, to charge up the battery (e.g., for SSK-class submarines), and to pressurize air into storage for the crew. Similar to the buoyancy control equipment, the air storage apparatus needs pneumatic valve control monitoring and maintenance. While on the surface on the ocean, the UV can be in a vulnerable position during the combat mode.

A UV utilizes a periscope to observe other ships on the sea surface as well as to communicate with the command center. A typical UV periscope of an UV is approximately 50 feet in length. A mechanical/optical periscope can require precision parts and skilled assembly, contributing a major cost factor to building a UV. The wireless communication equipment can require a long antenna, and loss of power can occur due to the long transmission line used. While the periscope or the antenna is up within the periscope length, the UV can be in a vulnerable situation during combat mode.

The UV uses active sound navigation and ranging (sonar) for navigation. The UV can also use active sonar to detect surface vessels or surrounding adversary UV units. While using active sonar, a UV also exposes its position to adversary passive sonar monitoring, and this can lead to vulnerability for the UV. The active sonar emits strong ultrasonic or audible pulse waves at omni-direction and utilizes a hydrophone to detect the reflecting pulse wave to determine the position of the target and the target range.

The hull design and construction of a UV can be complicated and expensive, requiring the fabrication of many custom parts. A UV requires a high-pressure hull design which can lead to a heavier frame and reduced payload weight. A large shipyard is needed to construct a typical UV. This can require a longer lead time for construction versus the construction of, for example, a recreational vessel.

SUMMARY

Various aspects are described relating to the design, construction, configuration, and deployment of a J-type Underwater Vehicle (JUV). The JUV utilizes a modular design concept to achieve low cost, fast construction, and low power consumption. Further, the JUV can be designed using the same rudder for both horizontal and vertical navigational control. In this manner, the symmetric rudder design can reduce the cost of construction. A traditional UV requires a conning tower or "sail" for periscope functions and a propeller and shaft attached at the stern, as well as a rudder at the stern. In contrast, the JUV has a symmetric rudder on both bow and stern to increase maneuverability in the forward and aft directions. Due to its angular design, the hull of the JUV can easily reflect sonar waves away from the source and thereby avoid sonar detection The JUV modules can be built in a hangar or warehouse remotely located from the shipyard. Additionally, the JUV modules can be shipped in a container by truck or air cargo to the designated port or shipyard. The JUV can also include a Retractable Wireless-communications Periscope (RWP) float for the Retractable Wireless-communications Periscope System (RWPS). The RWP can provide a deep sea high speed wireless communication and visual surveillance capabilities for the JUV. A traditional periscope, for example, is typically limited to 50 feet in length. In contrast, the JUV RWPS can provide up to 1 km in periscope length.

A Micro-second Synchronized Power Ethernet Control & Monitoring (USPECM) system can be designed for autonomous, remote-controlled, or manual operation of the JUV. The USPECM system can include several intelligent sensors that may be individually controlled, monitored, and recorded. Simple commands can be used to navigate the vehicle, and all of the communications can be Ethernet based. The USPECM devices can utilize the Power over Ethernet (PoE) standard (IEEE 802.3af) as much as possible for power needs. All of the USPECM electronic devices can be based on Application Specific Integrated Circuit (ASIC) and/or Field Programmable Gate Array (FPGA) design; thus, the USPECM electronic devices can consume less than one tenth of the power as systems based on a personal computer (PC) or computer board.

The USPECM can utilize the broadcasting feature of Ethernet/802.3 to synchronize all of the USPECM devices at a micro-second level. Furthermore, the USPECM uses only three layers of the Open Systems Interconnection Basic Reference Model (OSI Model) throughout the system. The USPECM can provide direct, efficient, and dependable micro-second level synchronization. A USPECM router can be used to relay information from the intelligent sensors to multiple command control stations. A central monitor router can provide multiple system monitoring stations. The USPECM Ethernet MAC address assignment scheme can provide a simple method for an FPGA to implement an organized monitoring system.

The JUV can be configured into a low cost, un-manned Missile-Defense specific JUV (MD_JUV) without a weaponry system. The MD_JUV can be controlled by nearby aircraft carrier crews to submerge, surface, and navigate at a safe distance from the aircraft carrier. The MD_JUV, in some implementations, can raise a missile defense screen. For example, the missile defense screen can be used to disrupt the flight path of a missile, disable the missile, and/or prohibit a missile from exploding. Further, the MD_JUV can, in some implementations, be deployed as a decoy to defend an aircraft carrier against incoming missiles from the air. For example, the aircraft carrier can emit smoke to block the visual guidance system, allowing the incoming missile to aim at the MD_JUV decoy instead of the aircraft carrier. The JUV can also be designed to minimize casualty rate. For example, every crew member in the JUV can have an individual emergency escape capsule (EEC) for use during evacuation of the JUV.

The JUV can also be used to detect and track adversary submarines, especially a nuclear-powered submarine. A nuclear submarine can stay under deep sea for as long as 6 months without being detected. A nuclear submarine can carry nuclear weapon/warhead and can pose a serious threat to our national security. A traditional submarine during operation can generate a large amount of heat, wave ripples, engine sound, and active sonar signals. The range of detecting an adversary by the sonar can vary from a few miles to about 50 miles.

The Submarine Surveillance and Tracking Network (SSTN) can include a Long Underwater Cable (LUC) and ST_JUV (Submarine Tracking specific JUV) fleet. The LUC can be used to detect submarines or surface vessels crossing the LUC line laid between two islands or end nodes by passive sonar and temperature sensor via the USPECM sonar array network. When an adversary submarine is detected while crossing the SSTN LUC line, the end-station (ground/island) can report to the command center and dispatch the nearest JUV units to track and escort the detected submarine until it no longer poses a threat.

The details of one or more embodiments of the invention are set forth in the accompanying drawings and the description below. Other features, aspects, and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

J-Type Underwater Vehicle Overview

Figure 1:
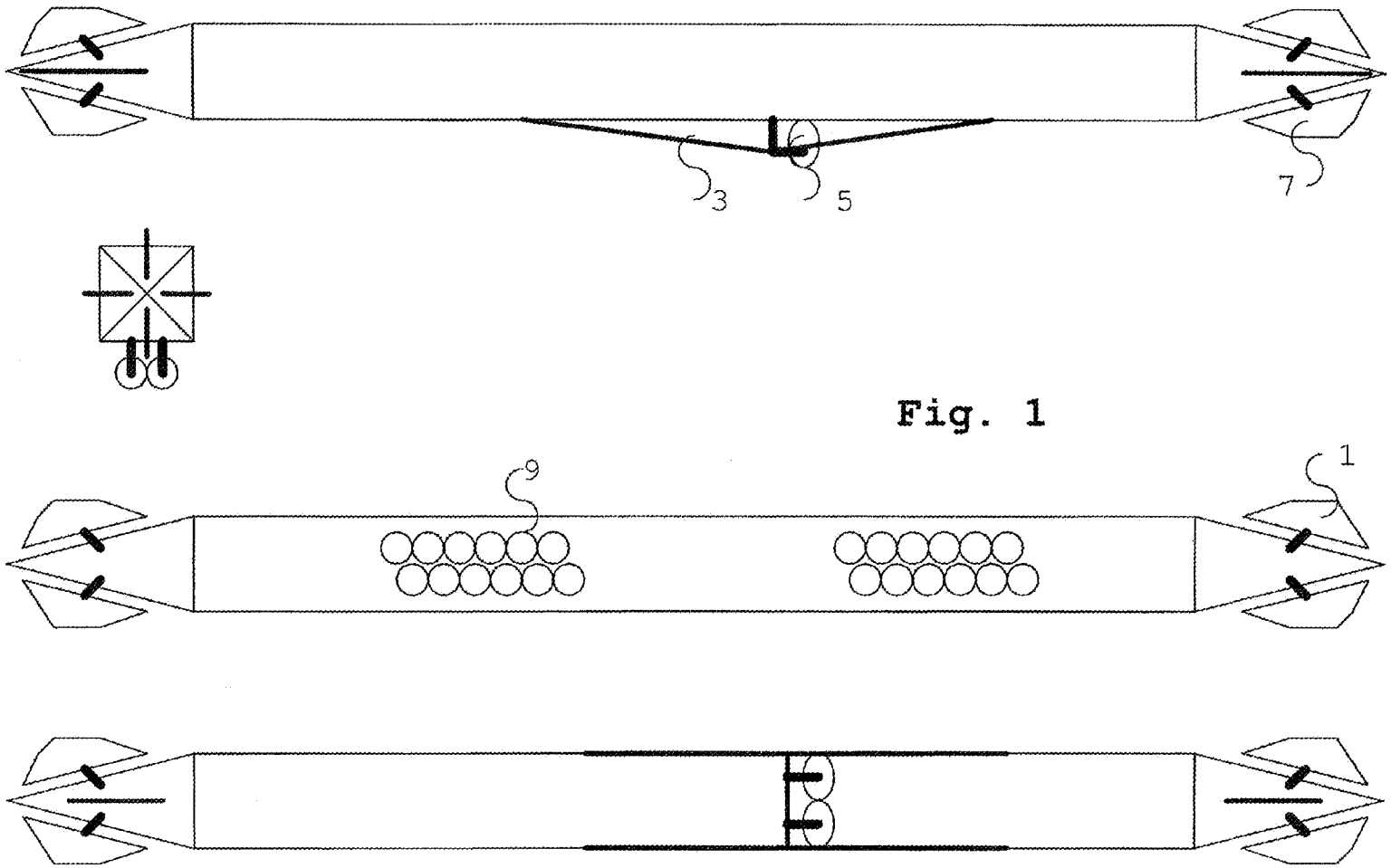
FIG. 1 illustrates side, front/rear, top and bottom views of a J-Type Underwater Vehicle.

FIG. 1 is an overview of a J-Type Underwater Vehicle (JUV) and illustrates side, front/rear, top, and bottom views of the JUV. As shown, the JUV has a square hull design. The square hull can be fabricated, for example, using commercial off-the-shelf (COTS) parts and a simplified assembly process. The square hull construction with symmetric bow and stem design provides a low drag force.

Horizontal and vertical rudders, such as a horizontal rudder 1 and a vertical rudder 7, can be placed on the bow and/or stem of the JUV. The horizontal rudder 1 is positioned at the top of the bow and/or stern section of the JUV, while the vertical rudder 7 is positioned at the bottom of the bow and/or stern section of the JUV. The horizontal rudder 1 or the vertical rudder 7 can also be placed on the top of the hull of the JUV. In some implementations, the horizontal rudder 1 and the vertical rudder 7 are designed using the same rudder construction. Using a symmetric rudder design, for example, can reduce the cost of construction. In addition, the symmetric rudder design, illustrated on both the bow and stern sections of the JUV, can increase the maneuverability of the JUV in both the forward and aft directions.

A propulsion supporting frame 3 can be fixed on the bottom-side of the JUV hull to propel the JUV evenly while keeping it leveled. The supporting frame 3 can also be used to protect the propeller from damage and to support the JUV when it rests on the ocean floor. A set of propulsion propellers 5, including propeller shafts and gears, is positioned centrally along the hull of the JUV. The central location of the propulsion propellers 5, for example, provides symmetric power to the forward and aft of the JUV. A set of vertical launch tube caps 9 can be used to launch weapons such as torpedoes and/or missiles.

Figure 2:
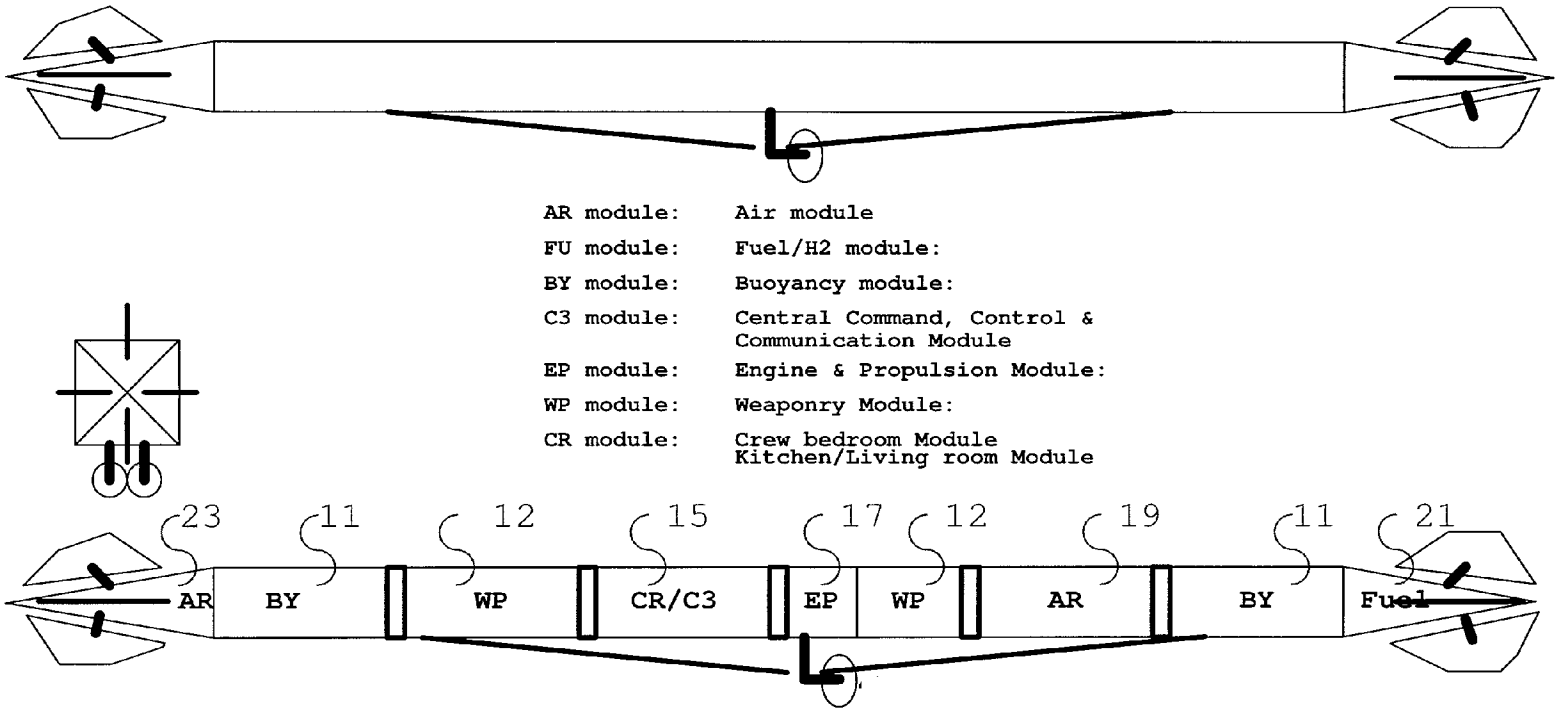
FIG. 2 illustrates a diagram of the modular hull design of a J-Type Underwater Vehicle.

FIG. 2 illustrates a diagram of the modular hull design of a JUV. A side view of the JUV is sectioned into individual modules. Each individual module, as illustrated, is forty feet in length. In other implementations, the module length can be changed to accommodate various requirements of each module. An air (AR) module 23 is shown at the bow of the JUV. The AR module 23 can include a canister for storing pressurized air. For example, the AR module 23 can provide clean air to both the engine and any crew on board.

A bow-end buoyancy (BY) module 11 follows the AR module 23. The BY module 11 provides buoyancy control to the JUV, allowing the JUV to surface and submerge. A weaponry (WP) module 12 follows the BY module 11. The WP module 12 can include defensive and/or offensive weaponry tactics (e.g., missiles, torpedoes, missile defense means, etc.) depending upon the desired configuration of the JUV.

A crew cabin (CR) module/command, control and communication (C3) module 15 follows the WP module 12. The CR/C3 module 15 setup can depend upon the chosen configuration of the JUV. For example, if the JUV is to be operated remotely, a basic C3 module 15 can be located in this position. The C3 module 15 includes communications and control electronics to run the JUV. If, instead, the JUV is configured for manned operation, the CR/C3 module 15 can be located in the position. The CR/C3 module 15, for example, can house a small crew to run the JUV. For example, a single person could theoretically steer and operate the JUV. In a typical use, it is possible that four crew members would be on board the JUV, with one crew member steering and one crew member handling the controls at all times. The CR/C3 module 15, unlike a basic C3 module 15 for example, can include monitors and input stations for manually controlling the sensors, weapons, and other peripherals of the JUV.

An engine and propulsion (EP) module 17 follows the CR/C3 module 15. The EP module 17 shares a single forty foot length module space with an additional WP module 12. The engine can be any type of engine suitable to an underwater vehicle including, but not limited to, diesel, gas, nuclear, electric or hybrid. The weapons module 12, similarly, can contain any type of weapon suitable to offensive or defensive underwater vehicle combat (e.g., missiles, torpedoes, etc.).

A pressured air (AR) module 19 follows the EP module 17/WP module 12 unit. The AR module 19 can be used to provide pressurized air to the buoyancy control module(s) 11 when surfacing. The AR module 19 can also store pressurized air for the crew and the engine. In some implementations, the AR module 19 provides air to an extra pressurized storage region within the bow and/or stern of the JUV. For example, the AR module 19 can provide air to the AR module 23. A stern-end BY module 11 follows the AR module 19. The stern-end BY module 11 balances the aft-end BY module 11, providing symmetric buoyancy control to the JUV.

A JUV stern module with fuel 21 follows the stern-end BY module 11. The JUV can be designed for a variety of fuel options including, but not limited to, hydrogen, gas, nuclear, diesel, or a hybrid (e.g., diesel-electric, etc.). Because the JUV carries a limited crew, if any, and uses low power electronics, fuel consumption can be kept to a minimum, providing the opportunity for the JUV to remain submerged at length without the need for nuclear power.

JUV Hull Design

Figure 3:
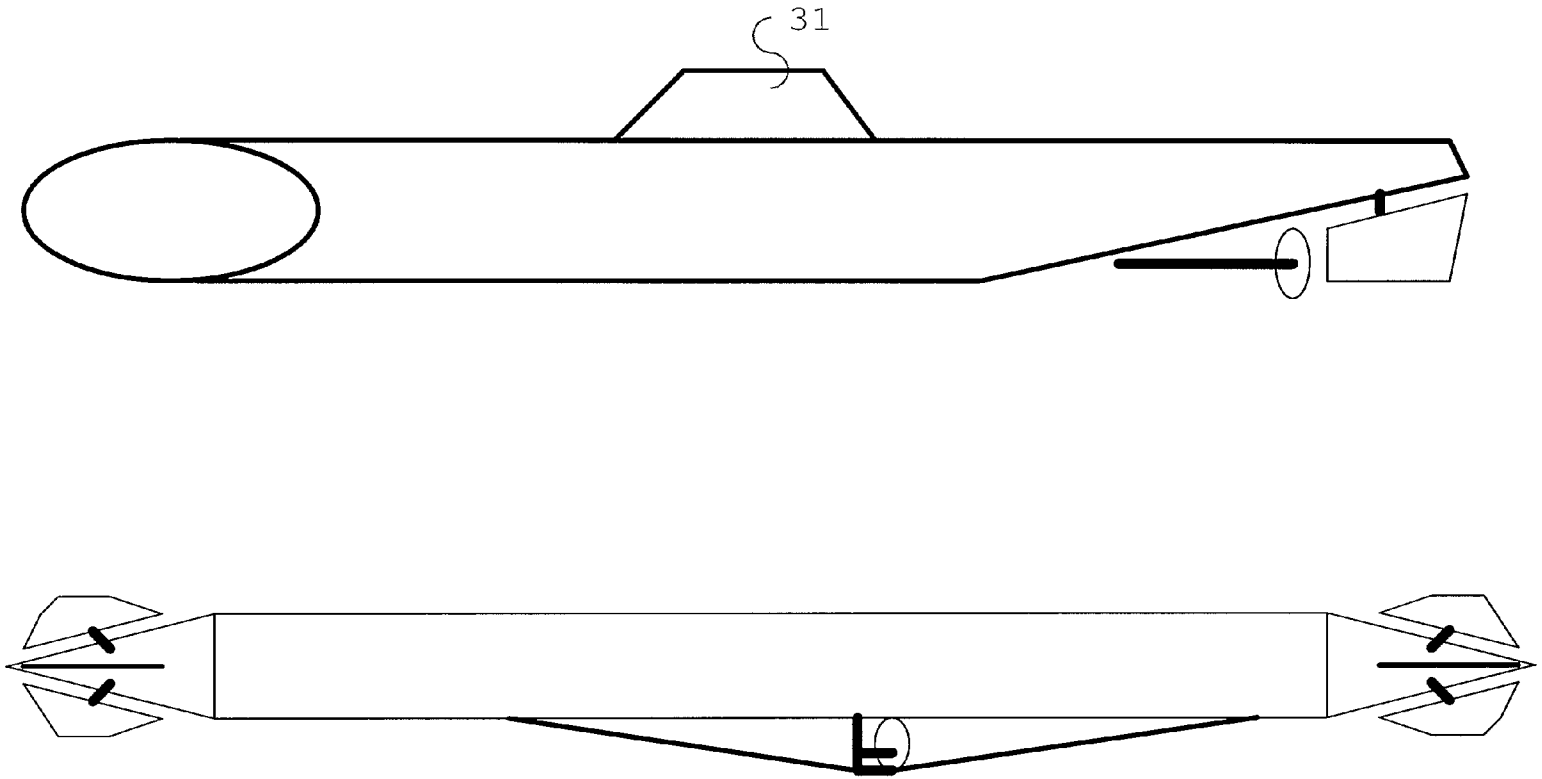
FIG. 3 is a block diagram illustrating the differences between a traditional underwater vehicle hull design and a J-Type Underwater Vehicle hull design.

FIG. 3 is a block diagram illustrating the differences between a traditional underwater vehicle hull design and a J-Type Underwater Vehicle hull design. The traditional underwater vehicle (LTV) requires a conning tower 31 or "sail" for periscope functions, positioned at the top center of the hull. The traditional UV includes a propeller and shaft attached at the stern, as well as a rudder at the stern. In contrast, the JUV has a symmetric rudder system on both the bow and the stern to increase maneuverability in the forward and aft directions. The propulsion propellers are mounted on the center bottom of the JUV. The JUV uses a remote float system for surface visual input and/or communications rather than a periscope system (described in FIGS. 25 through 35).

Figure 4:
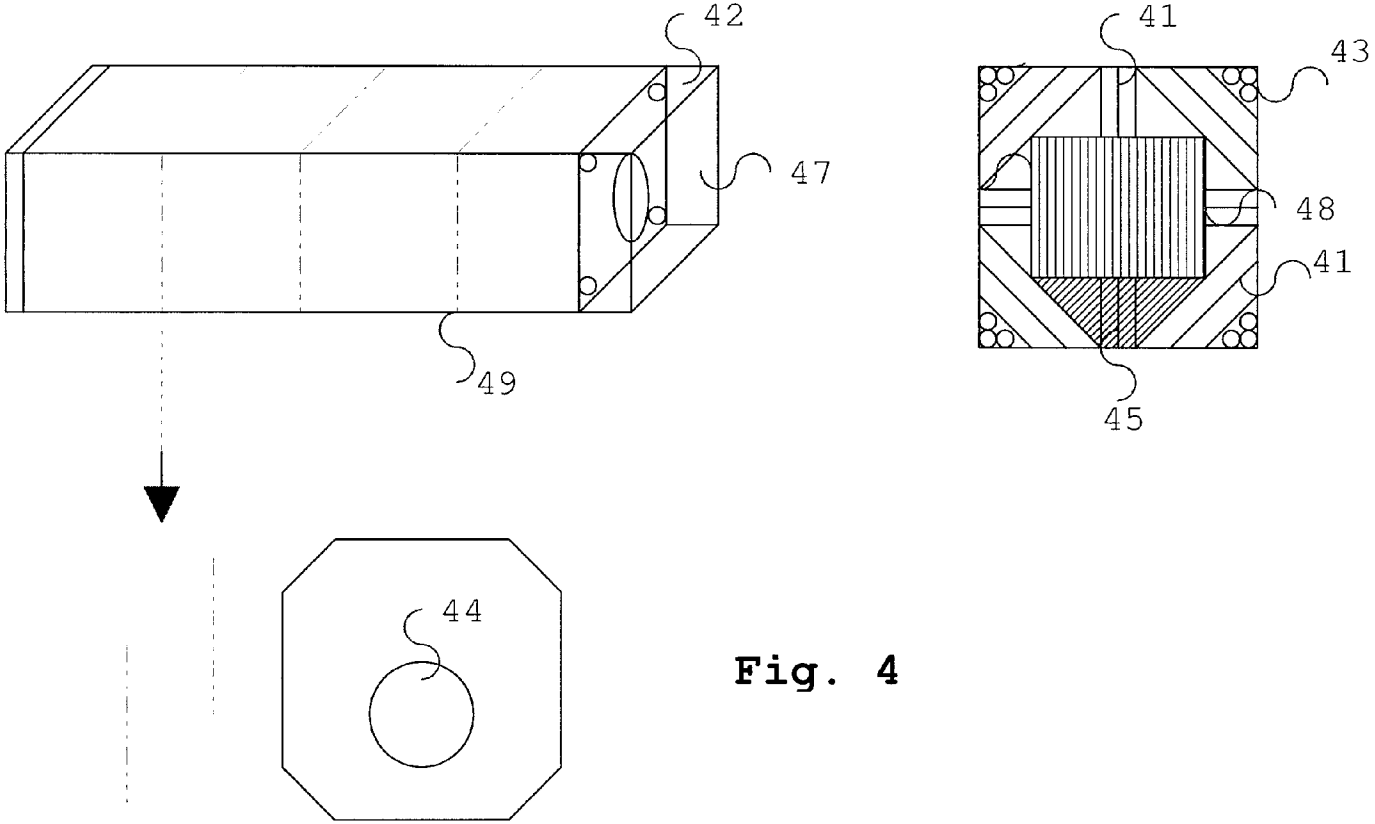
FIG. 4 is a block diagram illustrating a basic modular hull structure and interior design of a J-Type Underwater Vehicle.

FIG. 4 is a block diagram illustrating a basic modular hull structure and interior design of a J-Type Underwater Vehicle. As noted above, the JUV hull design can use COTS materials (e.g., marine grade aluminum such as 20'×80'×0.5" size sheets available through Aluminum Distributing, Inc. of Fort Lauderdale, Fla., part number 650096-5086). A standard sized JUV module, for example, may be about 8'×8'×20', while a large sized JUV module may be 8'×8'×40'. The JUV modules can be built in a hangar or warehouse positioned a considerable distance from the shipyard. The JUV modules can be individually shipped by container truck, train, or air cargo to the designated port or shipyard for final assembly. In some implementations, the JUV module can be designed to endure at least 600 psi of pressure (e.g., approximately 400 m deep sea pressure or 40.8 atmospheres).

The JUV module includes structural enforce bars 41 extending from a payload area 48 to the top and sides of the hull. The structural enforce bars 41 also extend across each corner of the hull at a 45 degree angle. As shown in FIG. 4, all four sides of the JUV hull are reinforced both at a 90 degree angle from the center of the module partition and at 45 degree angles from adjacent sides. Within the corners of the JUV hull, the open areas above the 45 degree angle enforce bars can each contain one or more manifold pipes and/or conduits 43. At the bottom of the JUV hull, where there are no 90 degree structural enforce bars 41, a modular ballast area 45 can contain one or more battery bays or water.

A module connector part 42 provides a means for connecting adjacent modules. Each JUV module also includes a modular connection working area 47 within the module connector part 42. The modular connection working area 47 provides a space large enough for a technician to enter to connect the pipelines, hoses, and electrical conduits between each module upon assembly. The modular connection working area 47 can also provide a space for a technician to enter to accomplish maintenance tasks associated with individual modules and/or the interconnections between two modules. After the JUV has been assembled, a technician can enter the modular connection working area 47.

In some implementations, the technician enters through a portal within the top region of the modular connection working area 47. For example, the portal within the modular connection working area 47 can be sealed upon assembly of the JUV. During maintenance operations, the portal can be reopened while the JUV is at the surface. Between each module a vertical partition 49 isolates the individual modules in the event of hull damage. A door 44, located within the module partition 49 between each JUV module, can be locked during normal operation and can be opened during maintenance.

Figure 5:
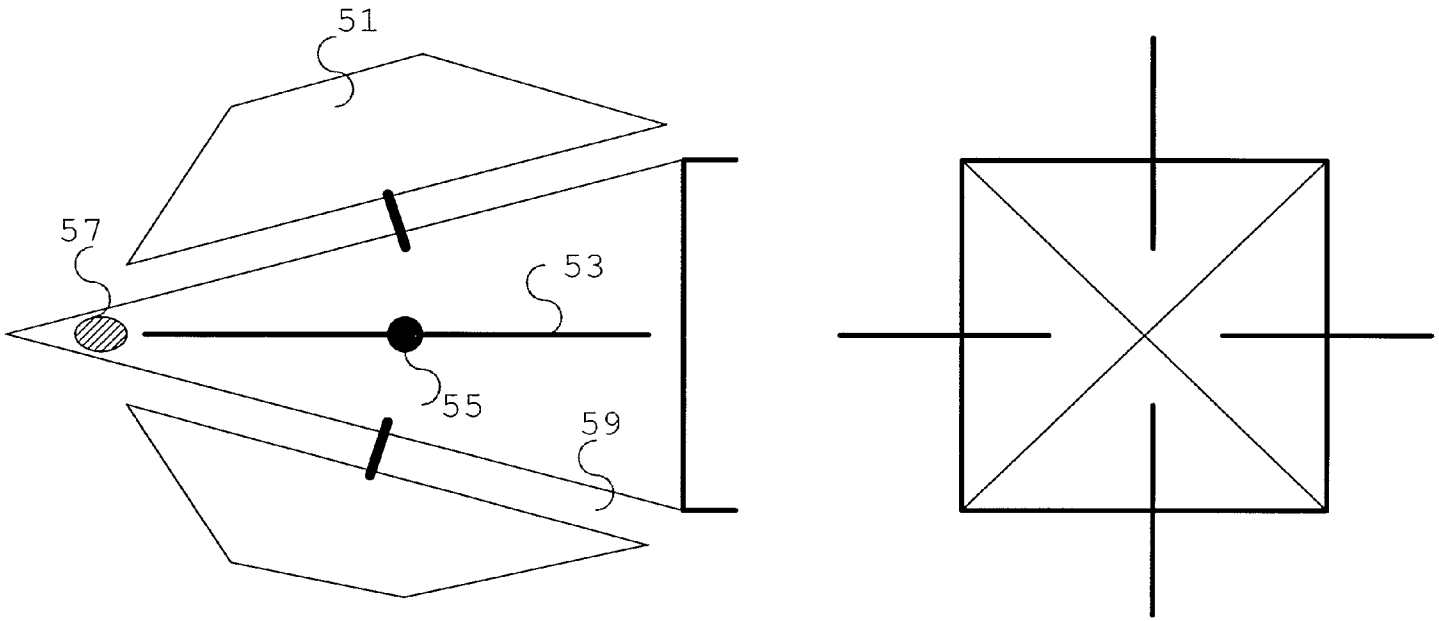
FIG. 5 is a block diagram illustrating a symmetric bow and stern structure of a J-Type Underwater Vehicle.

FIG. 5 is a block diagram illustrating the symmetric bow and stern design of a J-Type Underwater Vehicle. Due to its symmetric design, the bow and stern of the JUV are substantially the same. The bow and stern include a rudder 53 (e.g., horizontal rudder) and a worm gear 55 to steer the rudder 53. A pair of rudders 51 (e.g., vertical rudders), as well as a bottom rudder 53 (not shown), can also be controlled using a worm gear mechanism. A cross-section of the JUV bow and stern design illustrates the balanced positioning of the vertical and horizontal rudders. The bow and stern can also include an active and passive sound navigation and ranging (sonar) unit 57 and a payload area 59 that can be filled, for example, with clean water, fuel or air. In some implementations, a light and/or camera sensor can be added to the bow and/or stern for signaling communication and visual navigation.

Figure 6:
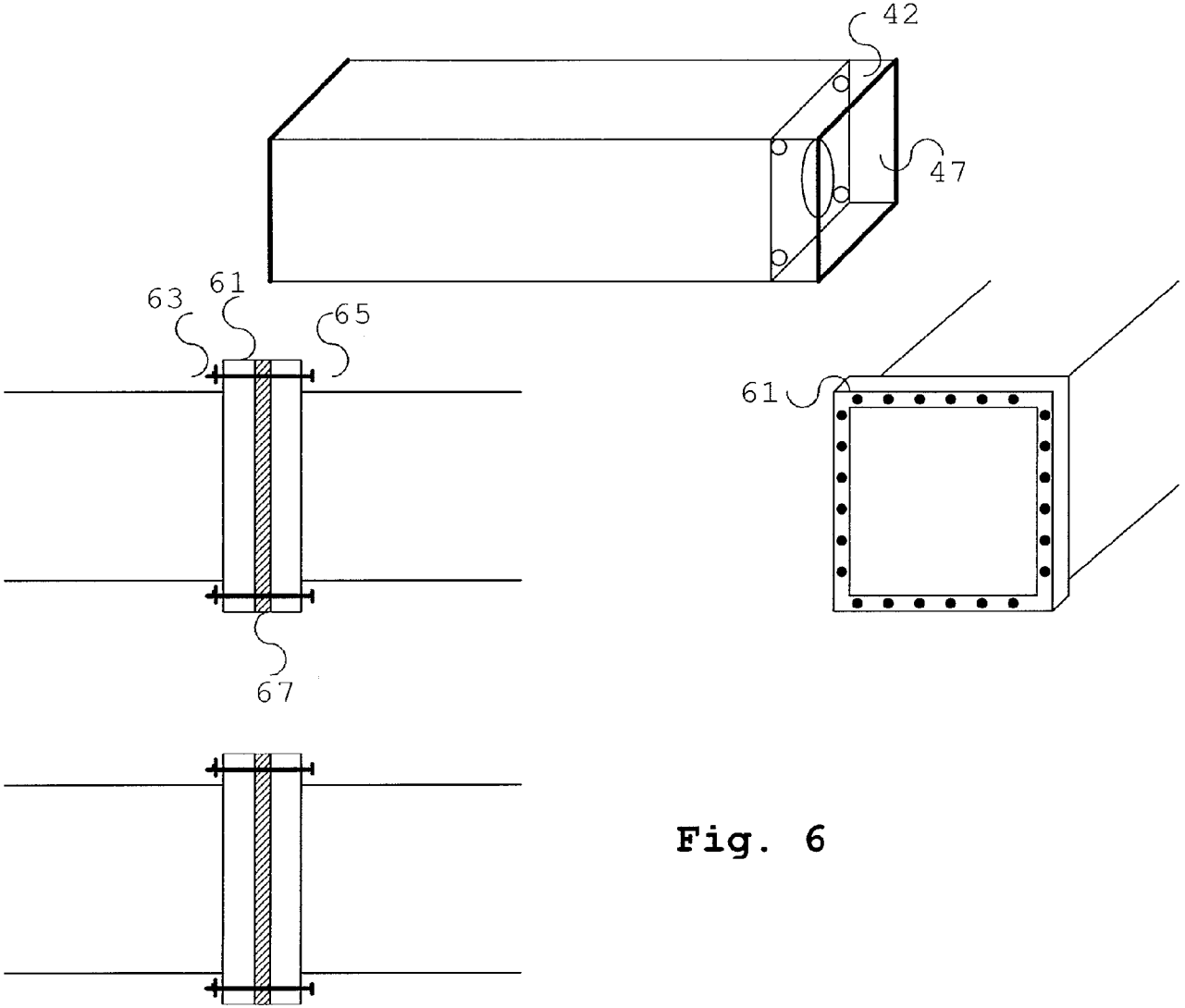
FIG. 6 is a block diagram illustrating a module connector for connecting the basic modular hull structure of a J-Type Underwater Vehicle.

FIG. 6 is a block diagram illustrating a module connector for connecting the basic modular hull structure of a J-Type Underwater Vehicle. Two JUV modules can be connected via the module connector part 42 (as shown in FIG. 4). For example, by aligning the modular connection working area 47 of two modules, a module connecting edge 61 around the hull edge is also aligned. The module connecting edge 61 includes holes for aligning connecting hardware (e.g., nut/bolt, etc.). In one example, one or more connecting nuts 63 and connecting bolts 65 can be used to secure the module connecting edges 61 of two adjacent modules. A gasket or o-ring 67 can be used to seal the connection between adjacent modules from water leakage.

Figure 7:
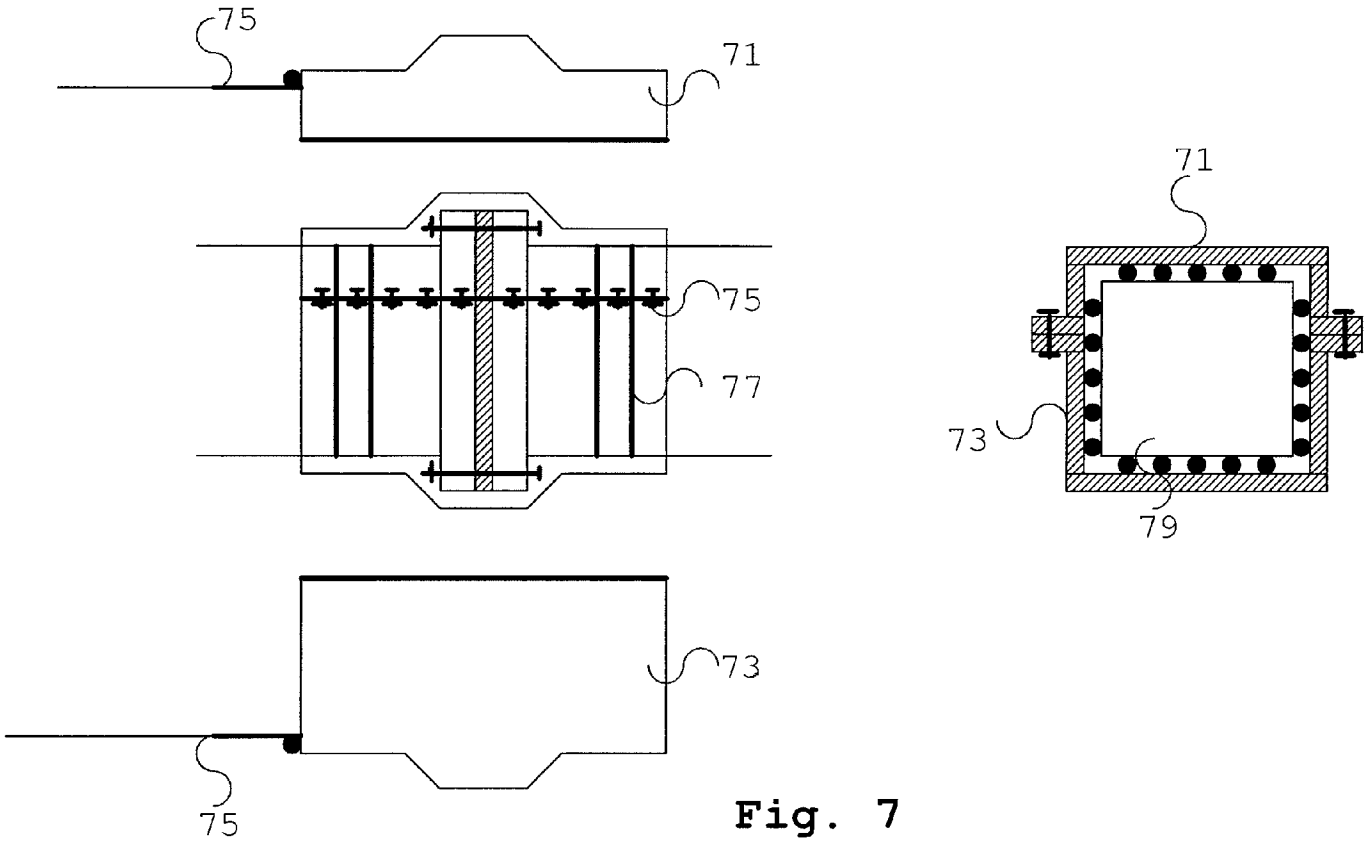
FIG. 7 is a block diagram illustrating a reinforcing outer connector for connecting the basic modular hull structure of a J-Type Underwater Vehicle.

FIG. 7 is a block diagram illustrating a reinforcing outer connector for connecting the basic modular hull structure of a J-Type Underwater Vehicle. A module connection reinforcement connector 71 can be used for the top part of the module connection and another module connection reinforcement connector 73 can be used for the bottom part of the module connection. In some implementations, the top and bottom parts of the JUV module reinforce connector 71, 73 can be identical to reduce cost. In one implementation, the height of the top reinforcement connector 71 can be shorter than bottom reinforcement connector 73, because the installation of the reinforcement connector 71 can be done above the water. In the case that more than half of the hull is submerged while installing the top reinforcement connector 71, it can be easier for the work to be done above the water level. Connector hinges 78 attached to the top reinforcement connector 71 and the bottom reinforcement connector 73 can be used for easier connection between the two half connectors.

A series of nuts and bolts 75 can be used to tighten the reinforce connector. One or more o-rings 77 are included within the reinforcing outer connector for water proof design. The o-rings 77, in some examples, can consist of a sheet of o-rings or multiple individual o-rings. A cross-section 79 depicts the cross section of reinforce connector. As is illustrated within the cross-section 79, the top reinforcement connector 71 is shorter than the bottom reinforcement connector 73.

Figure 8:
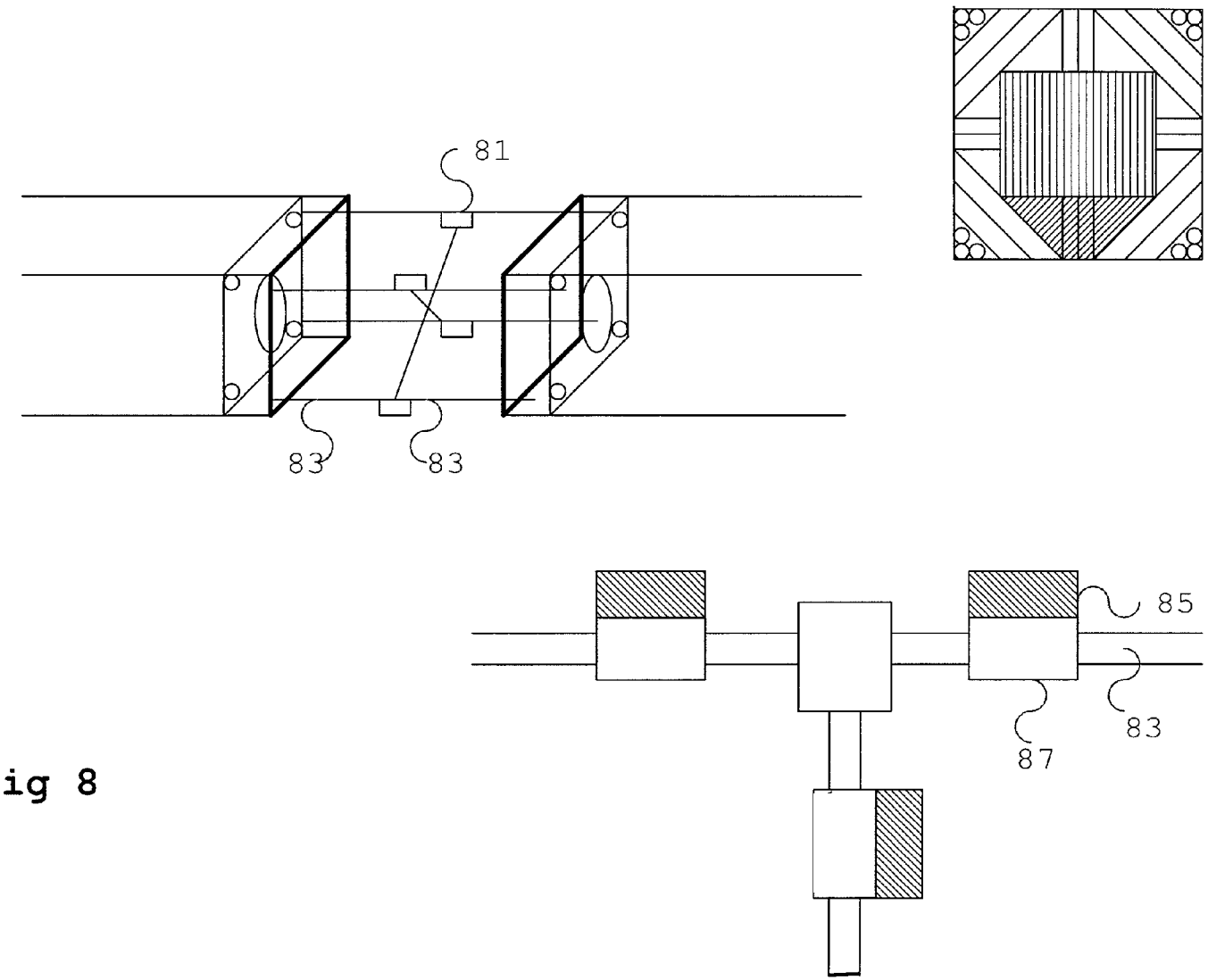
FIG. 8 is a block diagram illustrating a redundant pipeline system for use within the basic modular hull structure of a J-Type Underwater Vehicle.

FIG. 8 is a block diagram illustrating a redundant pipeline system for use within the basic modular hull structure of a J-Type Underwater Vehicle. The redundant pipeline system utilizes common off-the-shelf parts where applicable to reduce the cost of the design. A three-way valve 81 provides redundancy to the pipeline system. A main pipeline 83 (e.g., high pressure pipeline or hose) is shown extending between JUV modules. Redundant pipelines 83 extend through each of the four corners of the JUV hull. The three-way valves 81 cross-connect between redundant pipelines 83 (e.g., upper left to lower right and upper right to lower left). By switching the activity of two of the three-way valves 81 (e.g., both the upper left and the lower right three-way valves 81, etc.), the normal main lines 83 can be switched to the backup redundant lines 83.

The three-way valve 81 includes three Micro-second Synchronized Power Ethernet Control & Monitoring (USPECM) valve controls coordinated to perform 3-way switching. The USPECM valve controls, for example, can be created using a USPECM wheel-based actuator 85 controlling a common off-the-shelf valve 87. The three-way valve 81 performs three-way switching between the pipelines 83 (e.g., high pressure pipe or hose).

Figure 9:
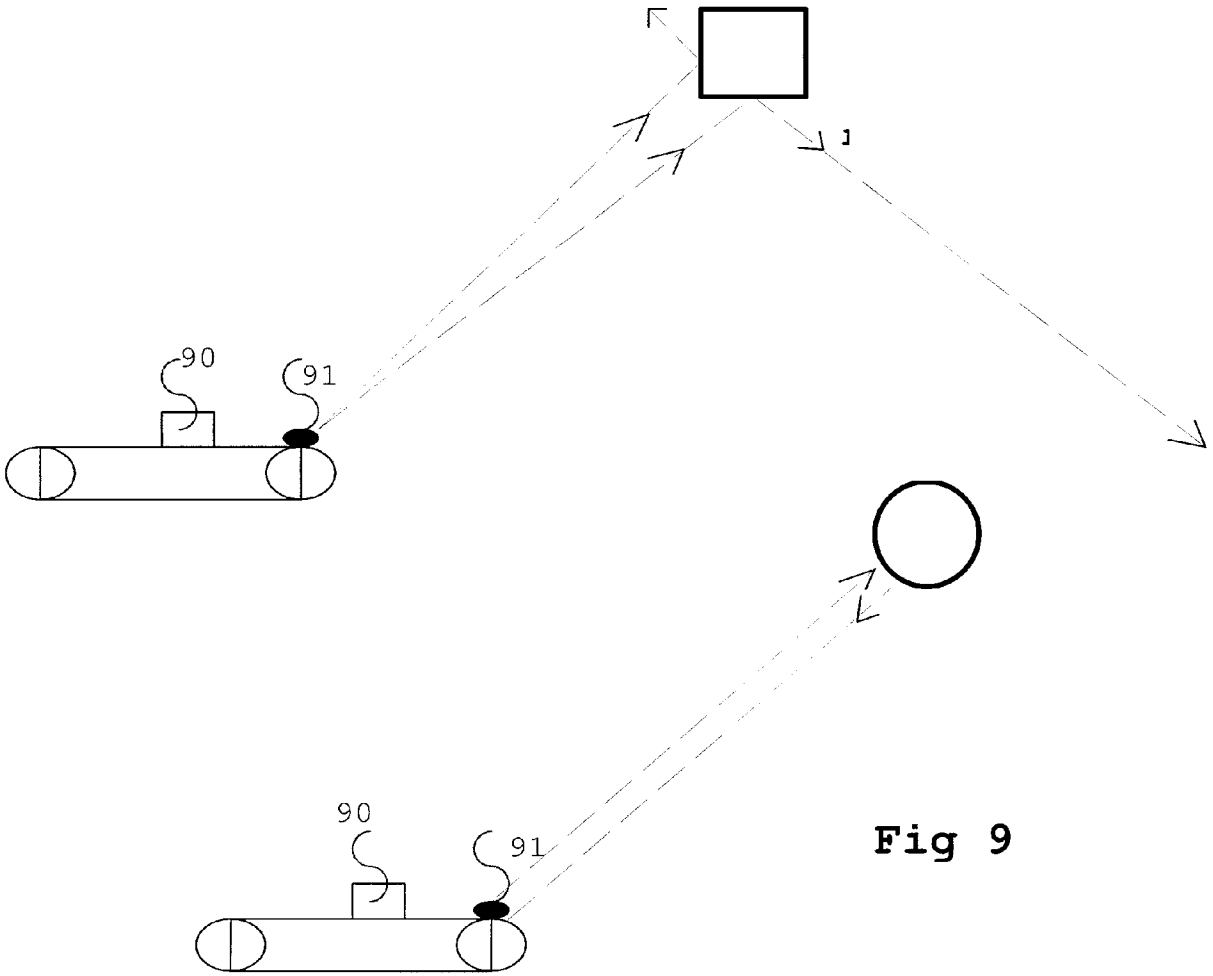
FIG. 9 is a block diagram illustrating a comparison of sonar reflection patterns between a traditional underwater vehicle hull design and a J-Type Underwater Vehicle hull design.

FIG. 9 is a block diagram illustrating a comparison of sonar reflection patterns between a traditional underwater vehicle hull design and a J-Type Underwater Vehicle hull design. An adversary submarine 90 uses a directional sonar 91 to locate other underwater vehicles. Sonar waves are reflected away from the adversary submarine 90 by the JUV due to the angular design of the JUV hull, while sonar waves are reflected towards the adversary submarine 90 by the traditional UV because of the circular hull design of the traditional UV. In this manner, the angular design of the JUV hull can be used to successfully evade sonar from adversary submarines.

Figure 10:
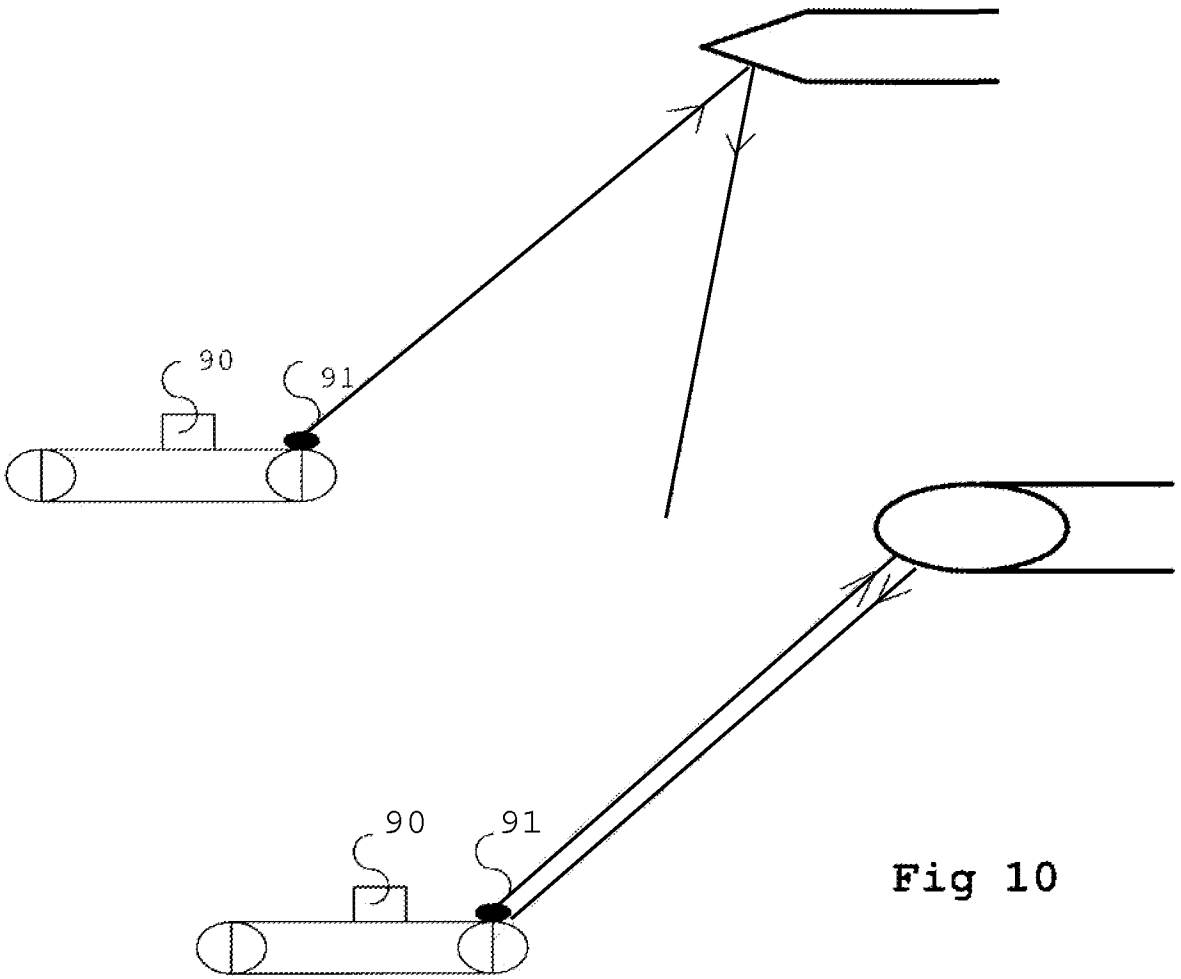
FIG. 10 is a block diagram illustrating a comparison of sonar reflection patterns between a traditional underwater vehicle bow and stern design and a J-Type Underwater Vehicle bow and stern design.

FIG. 10 is a block diagram illustrating a comparison of sonar reflection patterns between a traditional underwater vehicle bow and stern design and a J-Type Underwater Vehicle bow and stern design. As shown in FIG. 10, sonar waves emitted by the directional sonar 91 are reflected away from the adversary submarine 90 by the JUV bow and stern due to the flat surfaces of the angular design of the JUV bow and stern. Sonar waves are reflected towards the adversary submarine 90 by the traditional UV because of the rounded design of the traditional bow and stern. In this manner, the angular design of the JUV bow and stern can be used to successfully evade sonar from adversary submarines.

Figure 11:
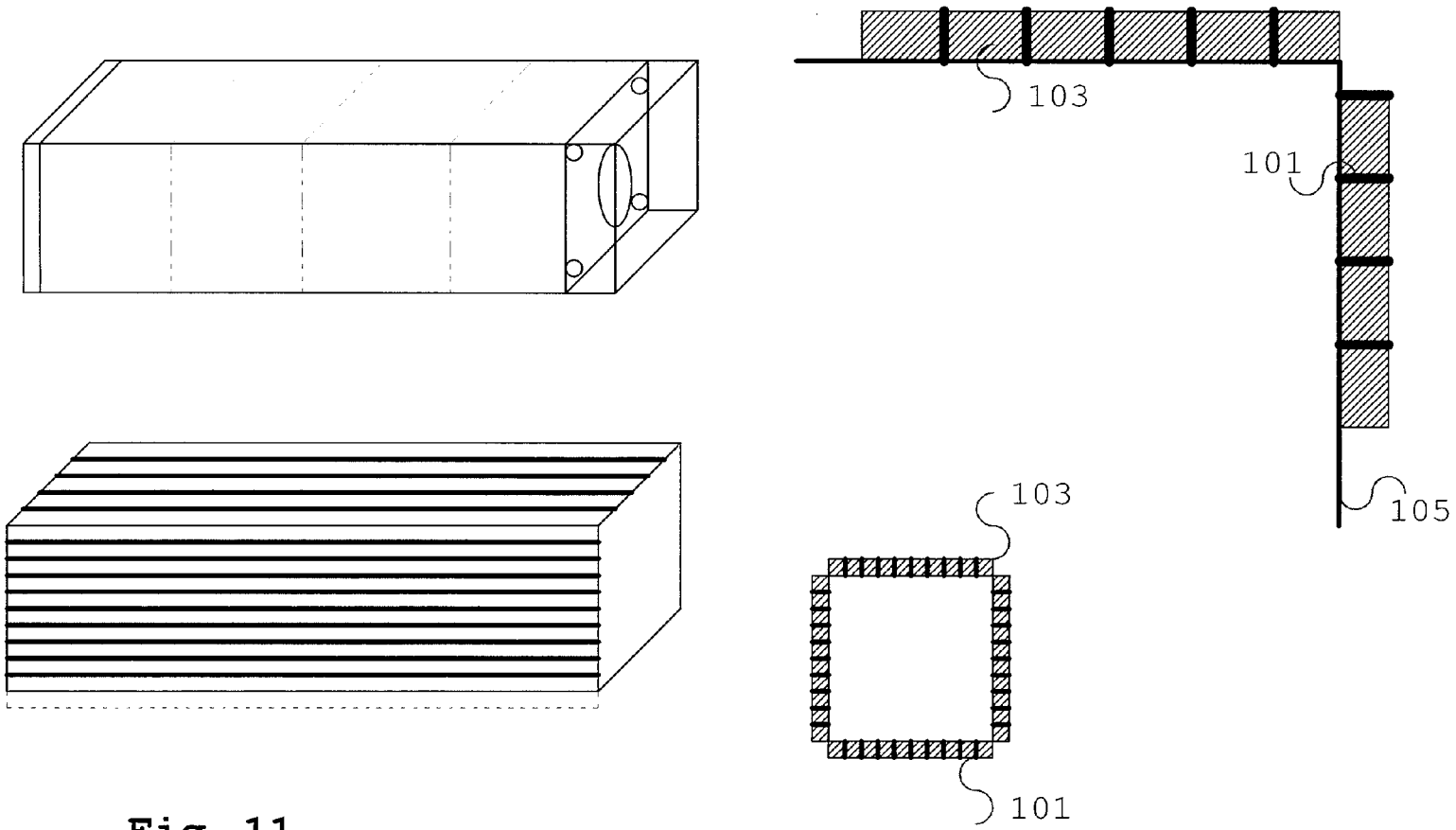
FIG. 11 is a block diagram illustrating a hull reinforcement and silencing design for use within the basic modular hull structure of a J-Type Underwater Vehicle.

FIG. 11 is a block diagram illustrating a hull 105 reinforcement and silencing design for use within the basic modular hull structure of a J-Type Underwater Vehicle. A set of reinforcement strips 101, used to reinforce the outer hull 105 of the JUV, can also perform a "bumper effect" for the JUV by protecting the main hull from damage in the case of a minor collision. The reinforcement strips 101, for example, can be manufactured as an L-shaped strip of solid bar or formed marine-grade aluminum frame. The reinforcement strips 101 can be welded or installed upon the outer hull 105 of an individual module, for example, after the module has been assembled.

A cross-view of the JUV hull 105 illustrates an acoustic absorbing material 103 (e.g., sponge or foam type of material), embedded between the reinforcement strips 101. The acoustic absorbing material 103 can help to absorb the ultrasonic waves from adversary sonar detection and can also provide noise isolation (e.g., voice, engine, etc.) from within the hull of the JUV.

JUV Modular Assembly Procedure

Figure 12:
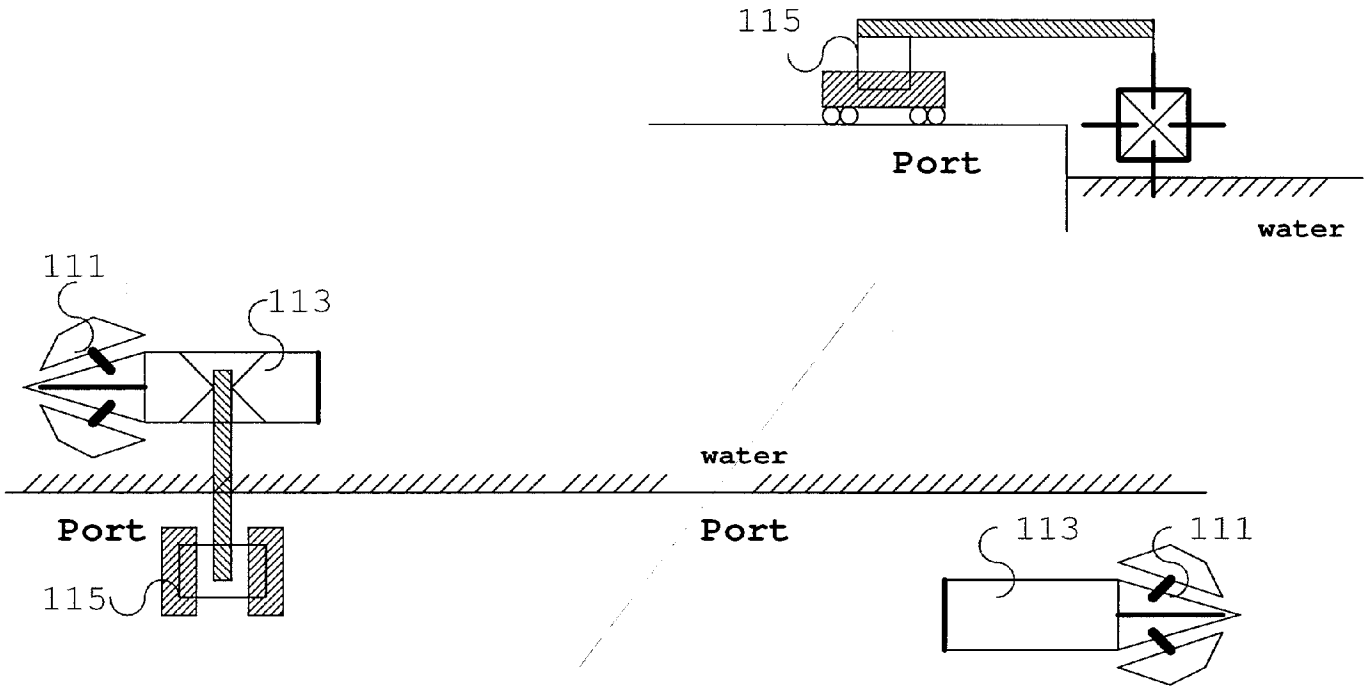
FIG. 12 is a diagram illustrating a bow and stern assembly procedure of a J-Type Underwater Vehicle.

FIG. 12 is a diagram illustrating a bow and stern assembly procedure of a J-Type Underwater Vehicle. The first step of the modular JUV assembly can be assembling the bow and stern portions of the JUV. For example, a bow or stern module 111 and a hull module 113 (e.g., buoyancy module 11 as shown in FIG. 2) can be built and assembled in a manufacturing hangar or warehouse, remotely located from the shipyard or port. Both the bow or stern module 111 and the hull module 113 can be shipped to the port upon completion. After the hull module 113 and the bow or stern module 111 are connected together (e.g., by welding) then a hoist crane 115 can be used to hoist the first module-bow combination into the water of the port. In some implementations, each JUV hull module can include hooks on each side and/or four corners for ease of repositioning using the strong hanging chains of the crane 115. This first section of the JUV (e.g., the hull module 113 connected to the bow or stern module 111) can be held in position using the crane 115 so that the section floats on the water.

Figure 13:
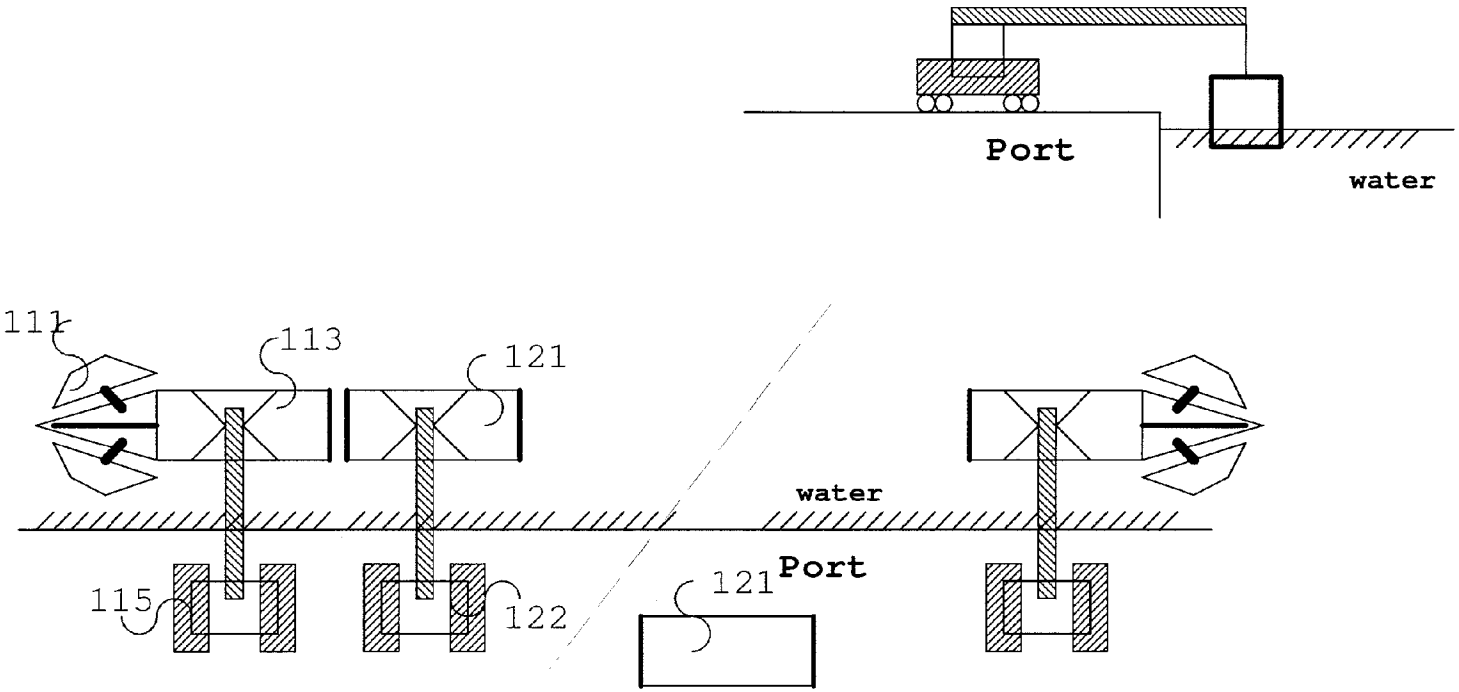
FIG. 13 is a diagram illustrating a modular hull unit assembly procedure of a J-Type Underwater Vehicle.

FIG. 13 is a diagram illustrating a modular hull unit assembly procedure of a J-Type Underwater Vehicle. The second step of the modular JUV assembly can be adding a JUV module 121 next to the first portion (e.g., the hull module 113 and the bow or stern module 111 as described in FIG. 12) being held on the water (e.g., by the crane 115). As noted above, the JUV modules can be built and assembled in a manufacturing hangar or warehouse, away from the shipyard or port, and be shipped to the port upon completion. The module 121 can be hoisted by an additional crane 122 and held still right next to existing modules on the water.

Figure 14:
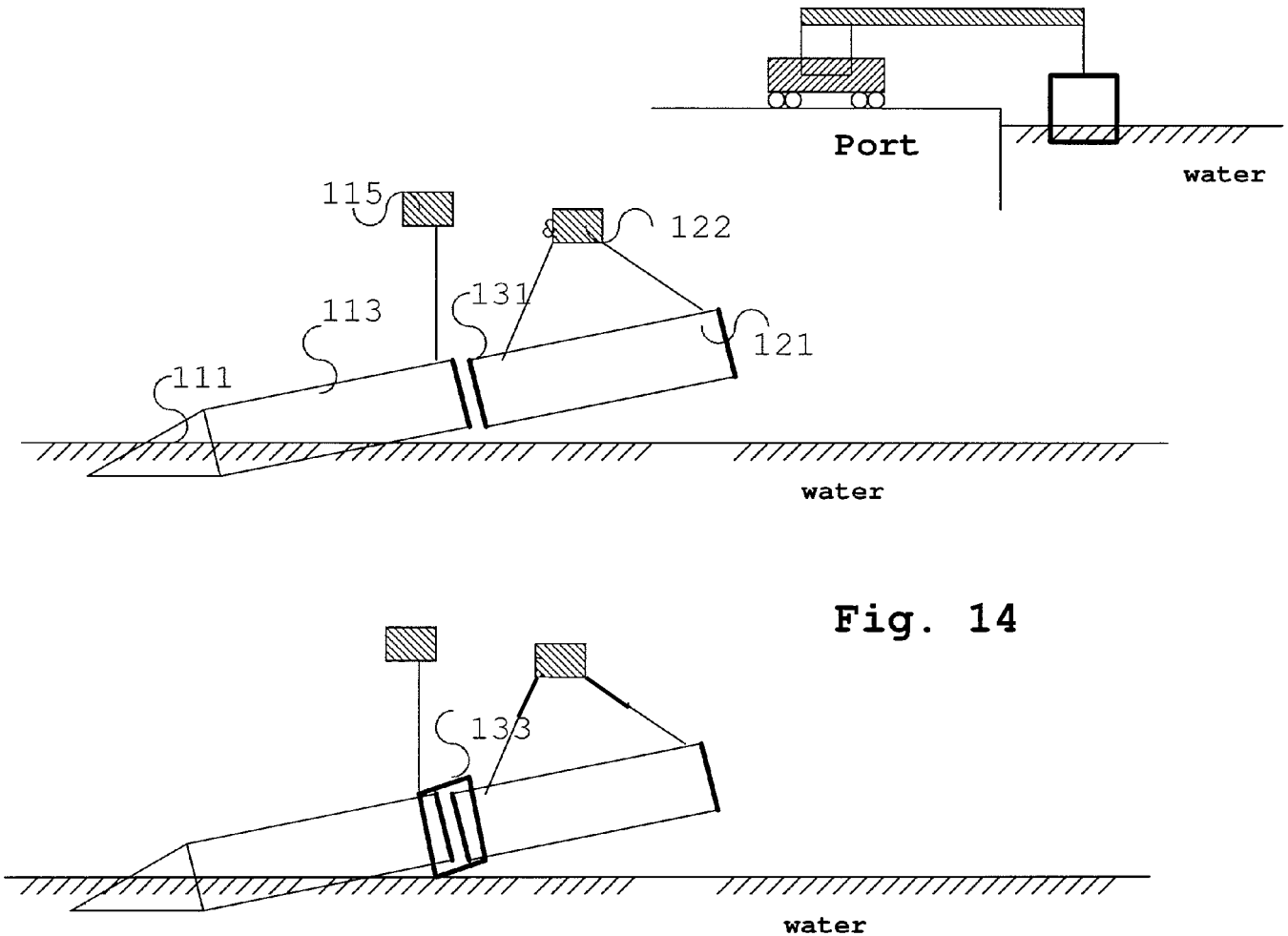
FIG. 14 is a diagram illustrating an assembly procedure for securing the connection between modular hull units of a J-Type Underwater Vehicle.
Figure 15:
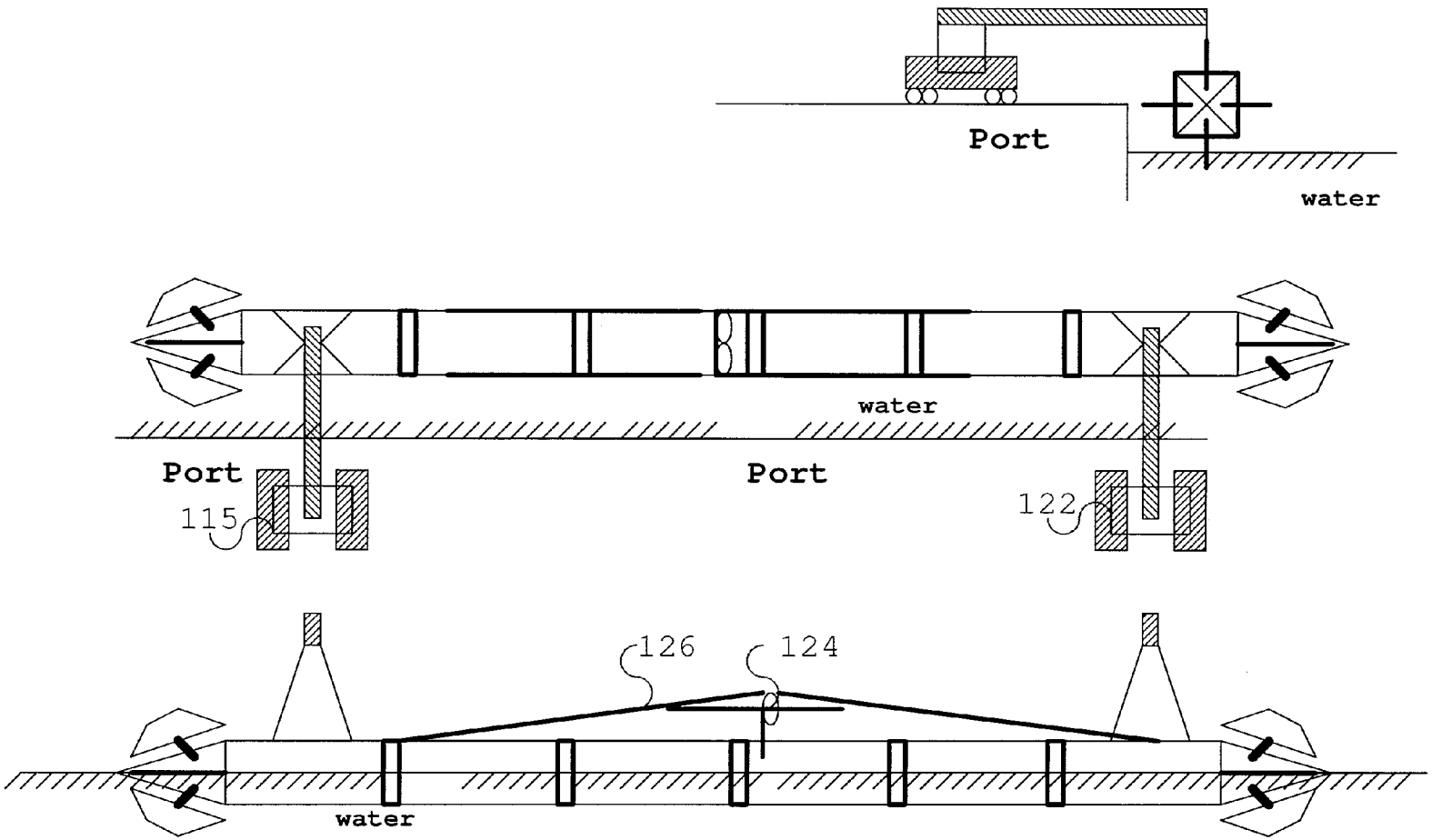
FIG. 15 is a diagram illustrating an assembly procedure for adding propulsion propellers to a J-Type Underwater Vehicle.

FIG. 14 is a diagram illustrating an assembly procedure for securing the connection between modular hull units of a J-Type Underwater Vehicle. The existing line of modules (e.g., the bow or stern module 111 connected to the buoyancy module) can be lifted up by the associated crane 115 and held at an angle. Additionally, the module to be added to the JUV assembly (e.g., module 121) can also be lifted up by the second crane 122 and held at the same angle as the existing line. The existing line of modules can be easily lifted up at an angle on the water because of the buoyancy of the modules. The connecting area can be positioned above the water by the cranes for the technicians to tighten the connecting hardware (e.g., as described in FIG. 6). In this manner, for example, a technician can tighten all of the nuts and bolts 131 on the edge of the module. Next, a technician can tighten up the reinforcement module connector 133 to further secure the connection and to improve the JUV total hull structural integrity (e.g., as described in FIG. 7). Any number of additional modules can be added to the JUV in this manner, followed by the ending bow or stern module to complete the JUV assembly.

Once a complete JUV modular hull has been assembled according to the steps illustrated in FIGS. 12 through 14, FIG. 15 illustrates an assembly procedure for adding propulsion propellers to a J-Type Underwater Vehicle. The entire JUV assembly can be rotated upside down, using the two hoist cranes 115, 122 to install a set of propulsion propellers 124 and a supporting frame 126 on the bottom side of the JUV. In this manner, the technicians can install the propellers 124 and the frame structure 126 on the JUV above the water.

Figure 16:
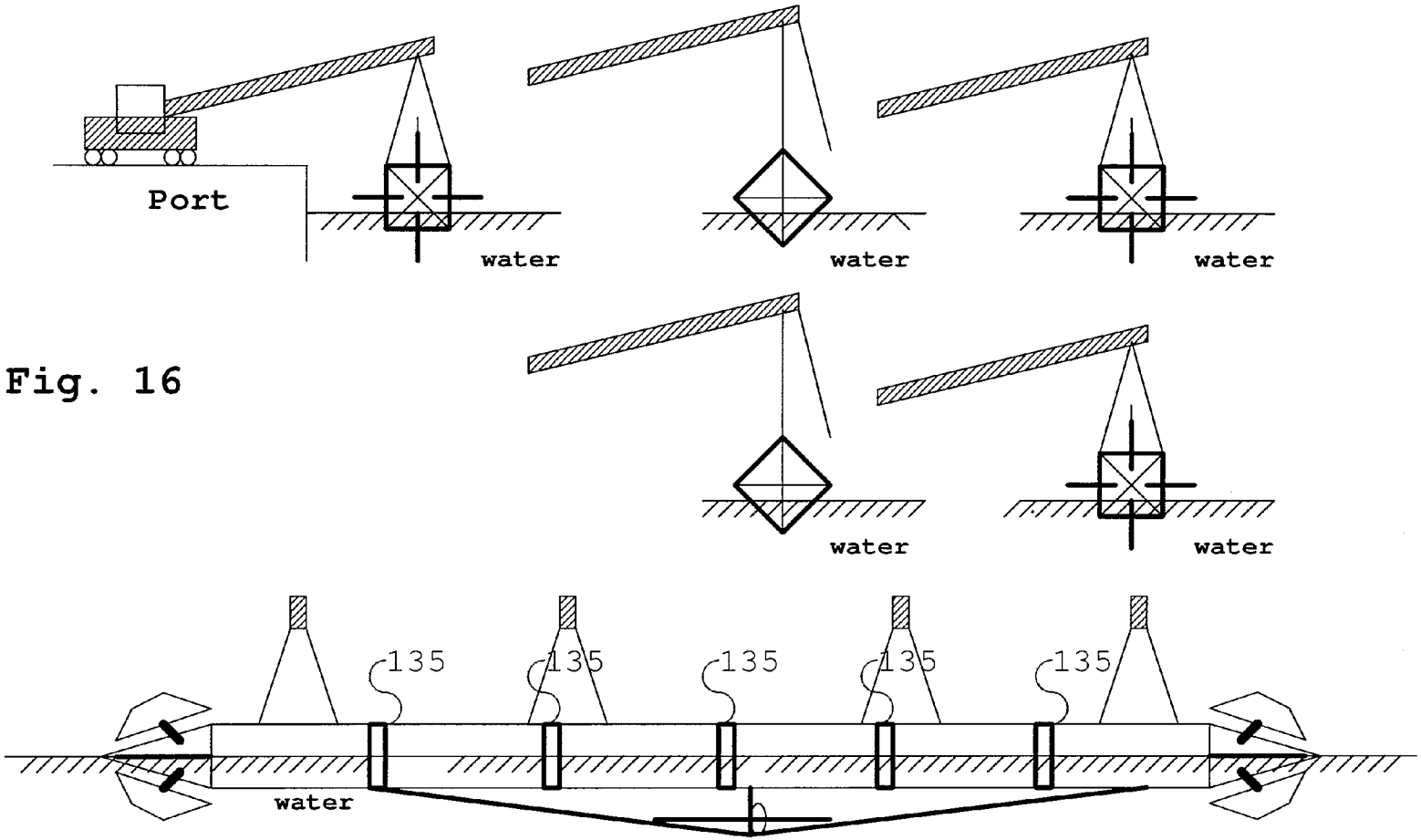
FIG. 16 is a diagram illustrating a procedure for rotating an assembled J-Type Underwater Vehicle.

FIG. 16 is a diagram illustrating a procedure for rotating an assembled J-Type Underwater Vehicle. Once the propulsion propellers have been installed, the JUV can be rotated again so that the propellers are below the water. In some implementations, the JUV can be carefully rotated in 45 degree increments by adjusting the lengths of the two chains of the one or more hoist cranes (e.g., crane 115) in use. After rotating the JUV, a technician can open each modular section of the hull (e.g., as described in FIG. 4) to enter the redundant manifold pipeline system. Within each modular connection area 135, a technician can complete the JUV assembly procedure by interconnecting the pipes, hoses, and/or conduits (e.g., as shown in FIG. 8).

In some implementations, one or more of the assembly steps described within FIGS. 12 through 16 can be used when reconfiguring a JUV unit. For example, in the event of damage to one or more modules, the damaged module(s) can be replaced at dockside for quick turnaround to redeployment. In another example, a JUV unit can be reconfigured for a different mode of operation (e.g., replacing one style weaponry module with another, installing a crew cabin module, etc.) by swapping individual modules out at dockside.

Detailed Design of JUV Modules

FIGS. 17 through 24 describe in detail particular types of modules which can be included within the assembly of a JUV. Certain modules, such as a buoyancy module, are integral to the functionality of the JUV. Other modules, such as a weaponry module, are optional based upon the desired configuration of the JUV. The modules described in FIGS. 17 through 24 are examples of potential modules. More, fewer, and/or different modules may be used when designing and assembling a module-based JUV. In some implementations, the functionality of two or more different modules may be included within a single module space.

Figure 17:
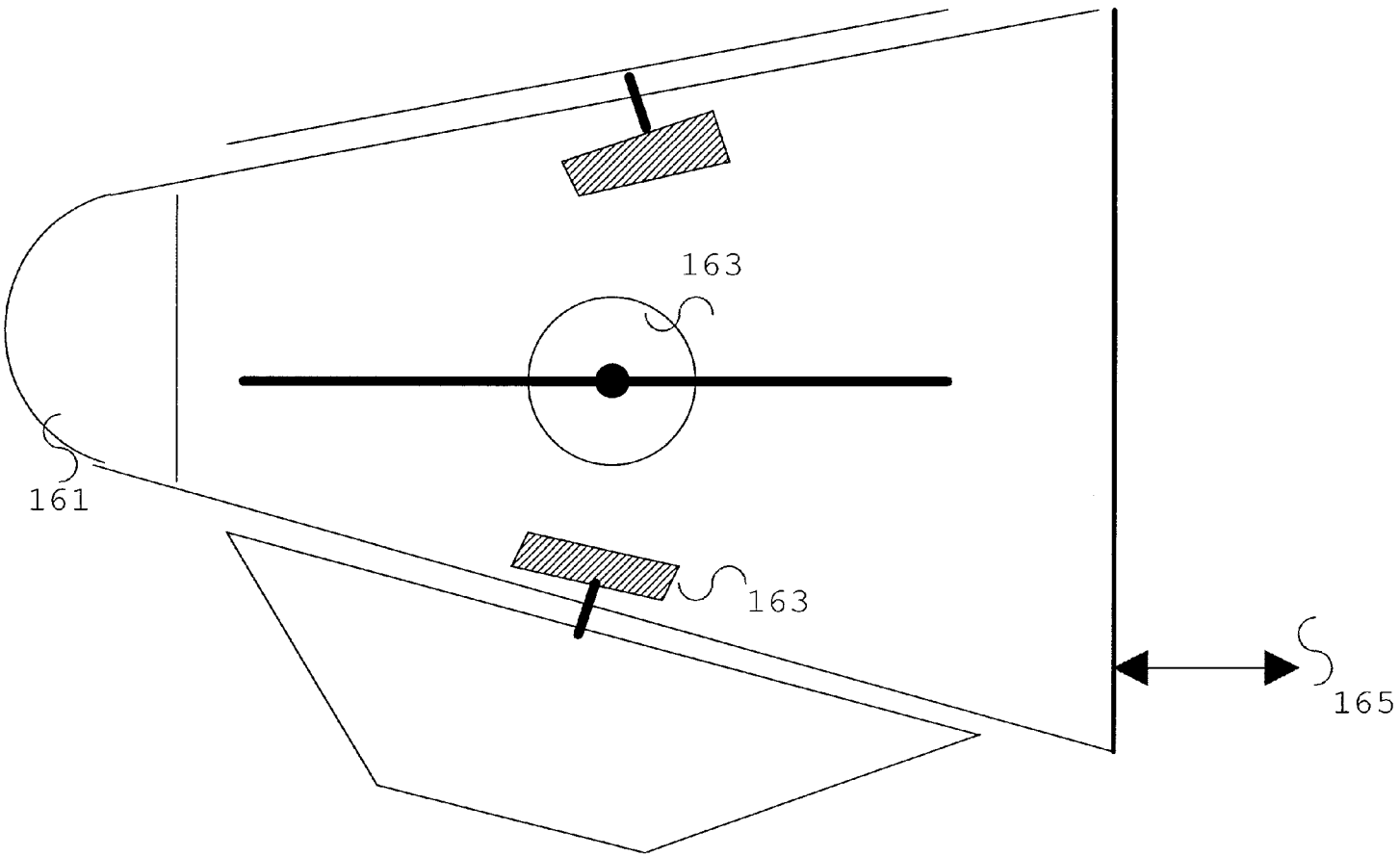
FIG. 17 is a block diagram illustrating a bow and stern module of a J-Type Underwater Vehicle.

As shown in FIG. 17, a block diagram illustrates a bow and stern module of a J-Type Underwater Vehicle. As noted previously, the JUV can have a symmetric bow and stern design, so that the bow and stern are substantially the same. Therefore, the details described herein, referenced as the bow for simplicity only, can pertain equally to the bow and stern portions of the JUV. An active and passive sonar system 161 is located at the tip of the bow. A light and/or camera sensor can optionally be added at the tip of the bow as well (e.g., for signaling communication and visual navigation).

A USPECM wheel-based actuator 163 is individually mounted on each rudder for steering control. A bi-directional arrow denotes the USPECM interface 165 with the remainder of the JUV. The USPECM interface 165 is DC-power fed and Ethernet-based. If there are multiple USPECM devices in a module (e.g., the bow or stern module, buoyancy module, etc.), a USPECM Ethernet switching system can be provided (described in FIG. 54). The Ethernet interface, in some examples, can be copper-based twisted pair (e.g., 10/100/1000 Base-T Gigabit Ethernet (GbE) or 10/100Base-TX) or fiber optic Ethernet.

Figure 18:
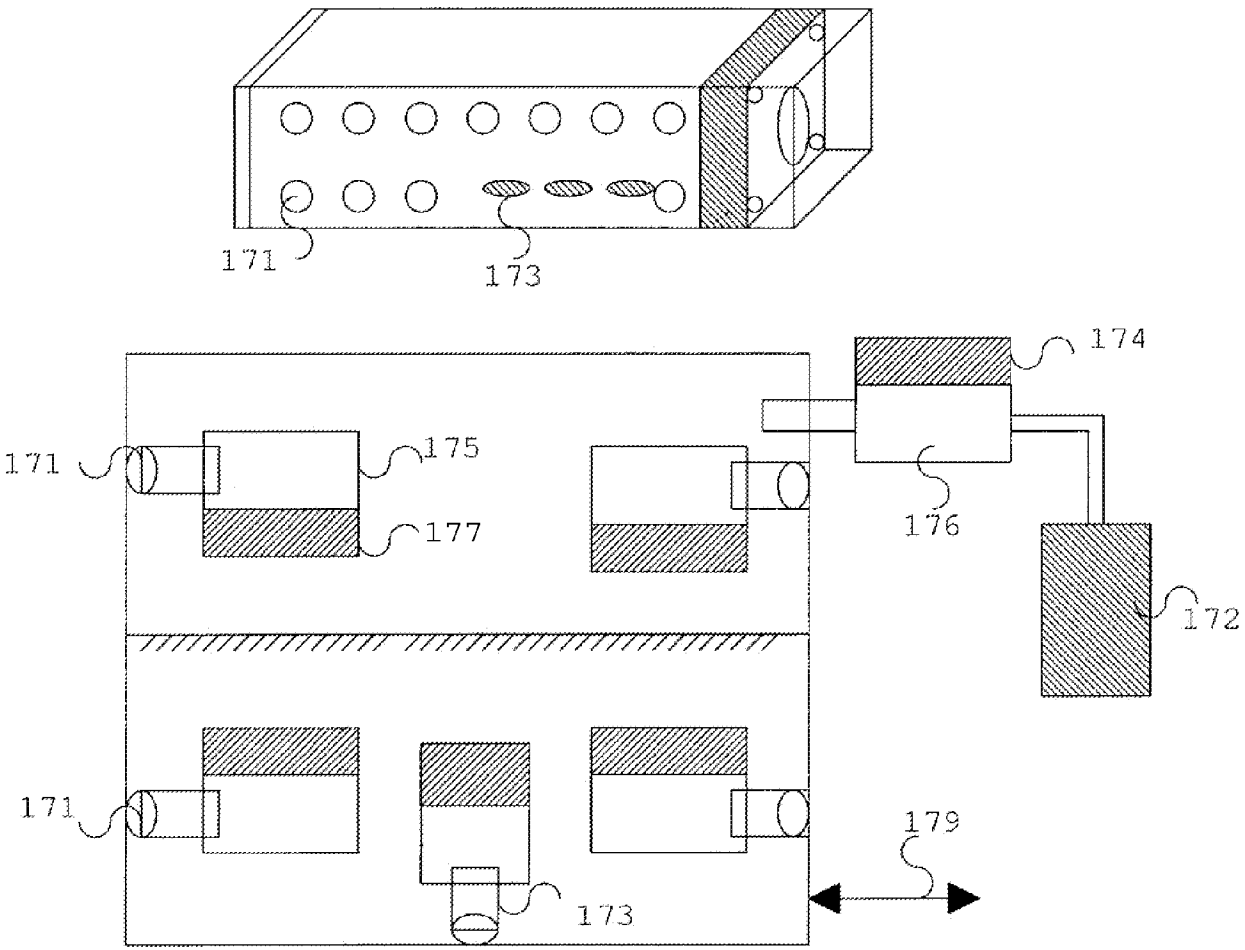
FIG. 18 is a block diagram illustrating a buoyancy module of a J-Type Underwater Vehicle.

FIG. 18 is a block diagram illustrating a buoyancy module of a J-Type Underwater Vehicle. The buoyancy module provides submerge and resurface capability for the JUV. In some implementations, for example, two buoyancy modules can be balanced at either end of the JUV (e.g., buoyancy modules 11 as shown in FIG. 2) to provide even buoyancy control to the JUV.

The buoyancy module includes a set of upper air holes 171 along the sides of the module. The buoyancy module additionally includes a set of lower air holes 173, positioned along the bottom of the buoyancy module. While submerging, the upper and lower air holes 171, 173 are opened so that water can fill the buoyancy module. After filling, the air holes 171, 173 are closed. Until the point of neutral buoyancy is reached, all of the air holes 171, 173 can remain closed while the JUV submerges to any depth in the water (e.g., to depths associated with pressure rated limits determined by manufacturing choices).

While surfacing, high pressure air can be introduced into the buoyancy module(s) (e.g., provided by the pressured air module 19 as shown in FIG. 2). In some implementations, only the lower air holes 173 are open to the water during surfacing. In this manner, the water in the buoyancy module can be squeezed out by the pressurized air and the JUV will lift. The lower air holes 173 provide more emergence force because the water within the buoyancy module is forced in a downward direction by the pressurized air filling the buoyancy module.

In some implementations, an individual air hole can be controlled by a USPECM wheel-based actuator 177, which can be attached to a common off-the-shelf valve 175. For example, the valve 175 can be a 90 degree angle ball valve with a 600 psi rating. Selection of the style of valve 175, for example, can be made based upon reduced material cost. In other implementations, a single USPECM controller (e.g., wheel-based actuators, etc.) can be used to control the position of more than one air holes 171, 173 (e.g., a row of air holes, a cluster of four air holes, etc.). A USPECM wheel-based actuator 174 can also be used to control a high pressure air valve 176. The high pressure valve 176 can be any common off-the-shelf valve. In some implementations, the high pressure valve 176 can be designed using an off-the-shelf pneumatic valve.

A common off-the-shelf high pressure air compressor 172 provides pressurized air to the buoyancy module. The pressurized air is provided through the high pressure pipe from the air compressor within the pressurized air module 19 (e.g., described in FIG. 20). The high pressure pipe, for example, can be routed to the buoyancy module through the manifold pipes, conduits, and/or payload space 43 (as shown in FIG. 4). The modular connection working area 47 provides a space where a technician can enter between assembled modules to install the redundant manifold pipeline system in the modular connection. A bi-directional arrow illustrates a main USPECM interface 179 for the buoyancy module. The USPECM interface 179, for example, provides power and control signals to the USPECM actuators 174, 177.

Figure 19:
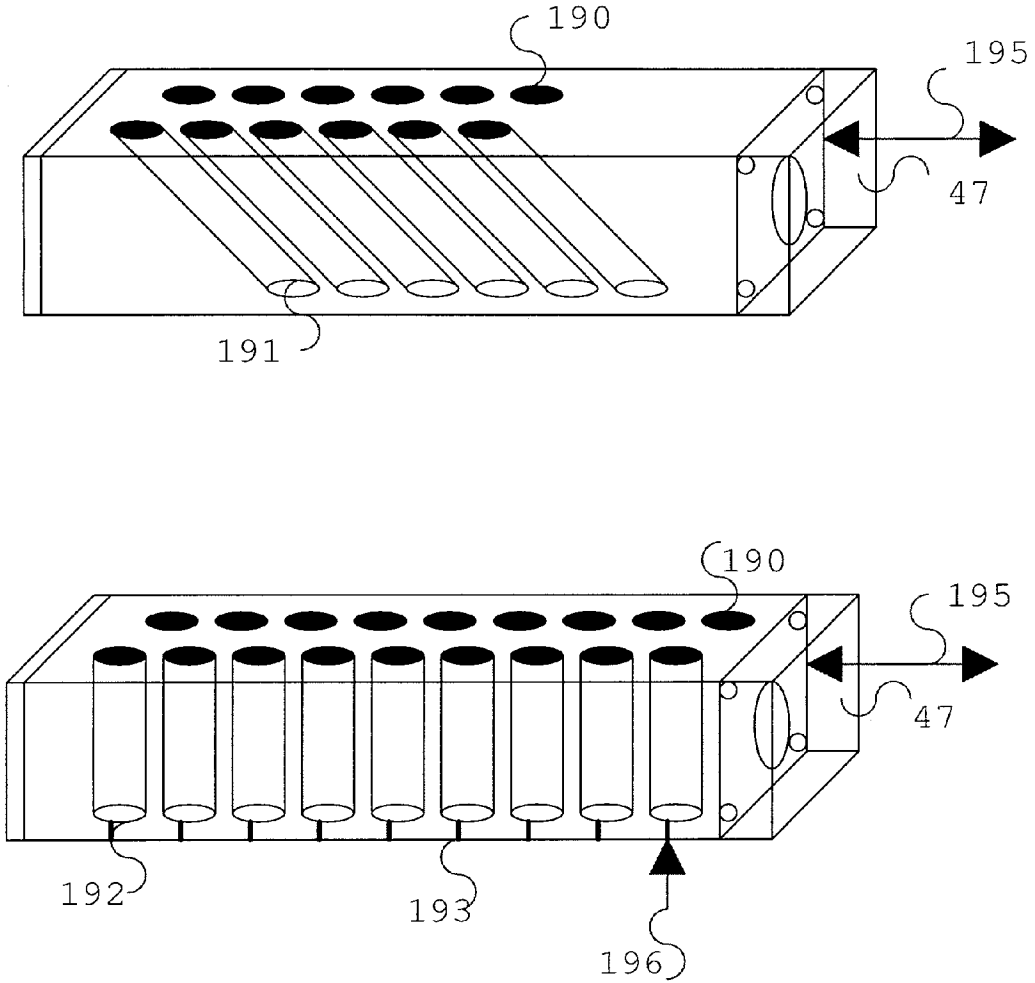
FIG. 19 is a block diagram illustrating a weaponry module of a J-Type Underwater Vehicle.

FIG. 19 is a block diagram illustrating a weaponry module of a J-Type Underwater Vehicle. The weaponry module (e.g., weaponry module 12 as shown in FIG. 2) can provide the JUV with the capability of storing and launching torpedoes and/or missiles. A first configuration of the weaponry module includes a set of angled launch tubes 191. The angled launch tubes 191 can be designed for launching any size of weaponry. In some implementations, angled launch tubes 191 are used to support the length of large sized weaponry.

A second configuration of the weaponry module includes a set of vertical launch tubes 192. The vertical launch tubes 192 can be designed for launching any size of weaponry. In some implementations, angled launch tubes 191 and vertical launch tubes 192 can be combined to support varying sizes of weaponry. For example, two rows of vertical launch tubes 192 could be arranged on the outside of the weaponry module, while a single row of angled launch tubes 191 could be arranged down the center of the weaponry module, to support both larger and smaller weapon launching.

At the top surface of the weaponry module, a USPECM autonomous cap 190 (e.g., described in FIGS. 57-59) seals the exit opening for each launch tube. A bi-directional arrow denotes the main USPECM interface 195 for the weaponry module. A USPECM pneumatic valve 193 can provide the triggering for a launch tube 191, 192. For example, the USPECM pneumatic valve 193 can open to allow pressurized air in (e.g., from the pressured air module as described in FIG. 20). The pressurized hair can be used to push the weapon (e.g., torpedo or missile) out of the launch tube 191, 192. The USPECM interface 195 can provide the final programming to the torpedo and/or missile before launch. Additionally, the USPECM interface 195 can provide storage status monitoring of the weapons housed within the weaponry module. The modular connection working area 47 provides a technician with a space to enter into when installing or maintaining the redundant manifold pipeline system in the modular connection.

Figure 20:
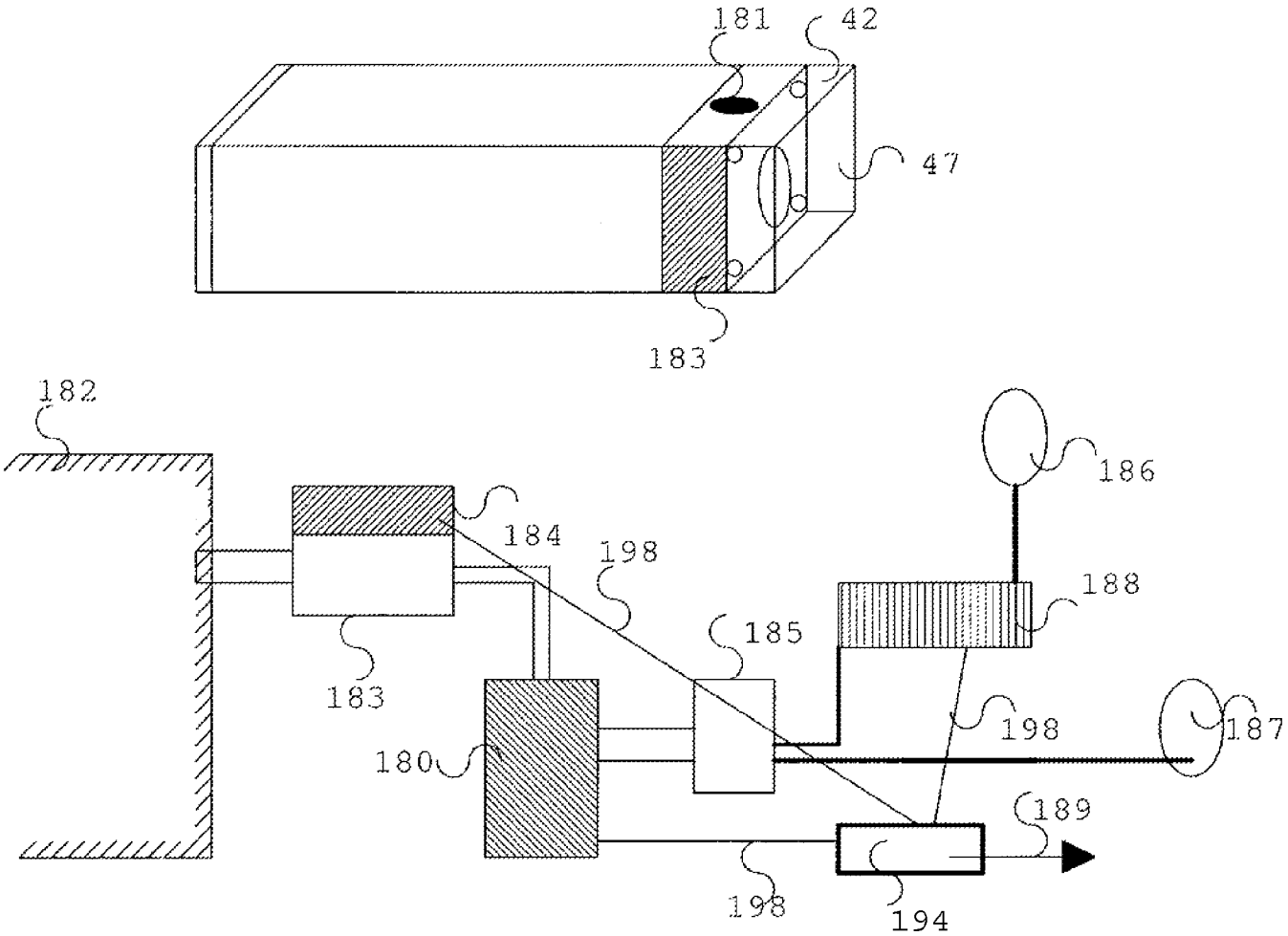
FIG. 20 is a block diagram illustrating an air module of a J-Type Underwater Vehicle.

FIG. 20 is a block diagram illustrating an air module of a J-Type Underwater Vehicle. The air module (e.g., pressured air module 19 as shown in FIG. 2) provides the storage of high pressure air for various functions, including the buoyancy module, diesel/gas engine module, torpedo/missile launch within the weaponry module, and fresh breathing air for the crew within the crew cabin module. Fresh air can be introduced into the JUV from a Fixed Wireless communication Periscope (FWP) 187 (as described in FIGS. 31 through 35) or a Retractable Snorkeling System (RSS) 186 (as described in FIGS. 36 and 37) with a winch 188. When the RSS 186 is in use, for example, a USPECM cap 181 is opened within the top of the air module to release the RSS 186 float.

The air module includes a high pressure air container 182. In some implementations, the high pressure air container 182 can be a common off-the-shelf circular column which fits into the square JUV air module space. The air container 182, for example, can be rated to hold air which is pressurized to a ratio which allows for high-speed triggering of underwater weaponry such as torpedoes or missiles.

Air coming from the FWP 187 or the RSS 186 enters an air filter 185. The air filter 185 removes moisture from the air. Next, the dehumidified air enters a high pressure air compressor 180. In some implementations, the air compressor 180 is a common off-the-shelf air compressor unit. The pressurized air enters the high pressure air container 182 through a common off-the-shelf pneumatic valve 183. The pneumatic valve 183 is controlled by a USPECM actuator 184. The USPECM actuator 184 releases the pneumatic valve 183 to transfer pressurized air from the air compressor unit 180 to the high pressure air container 182. The pneumatic valve 183 then holds the pressurized air in the high pressure air container 182.

The USPECM actuator 184, air compressor 180, and winch 188 receive commands via a set of USPECM interfaces 198. The commands are relayed to the individual devices (actuator 184, air compressor 180, and winch 188) from a USPECM main interface 189 through a USPECM concentrator/switch 194. The USPECM concentrator/switch 194 routes USPECM device communications to and from the USPECM command control.

Figure 21:
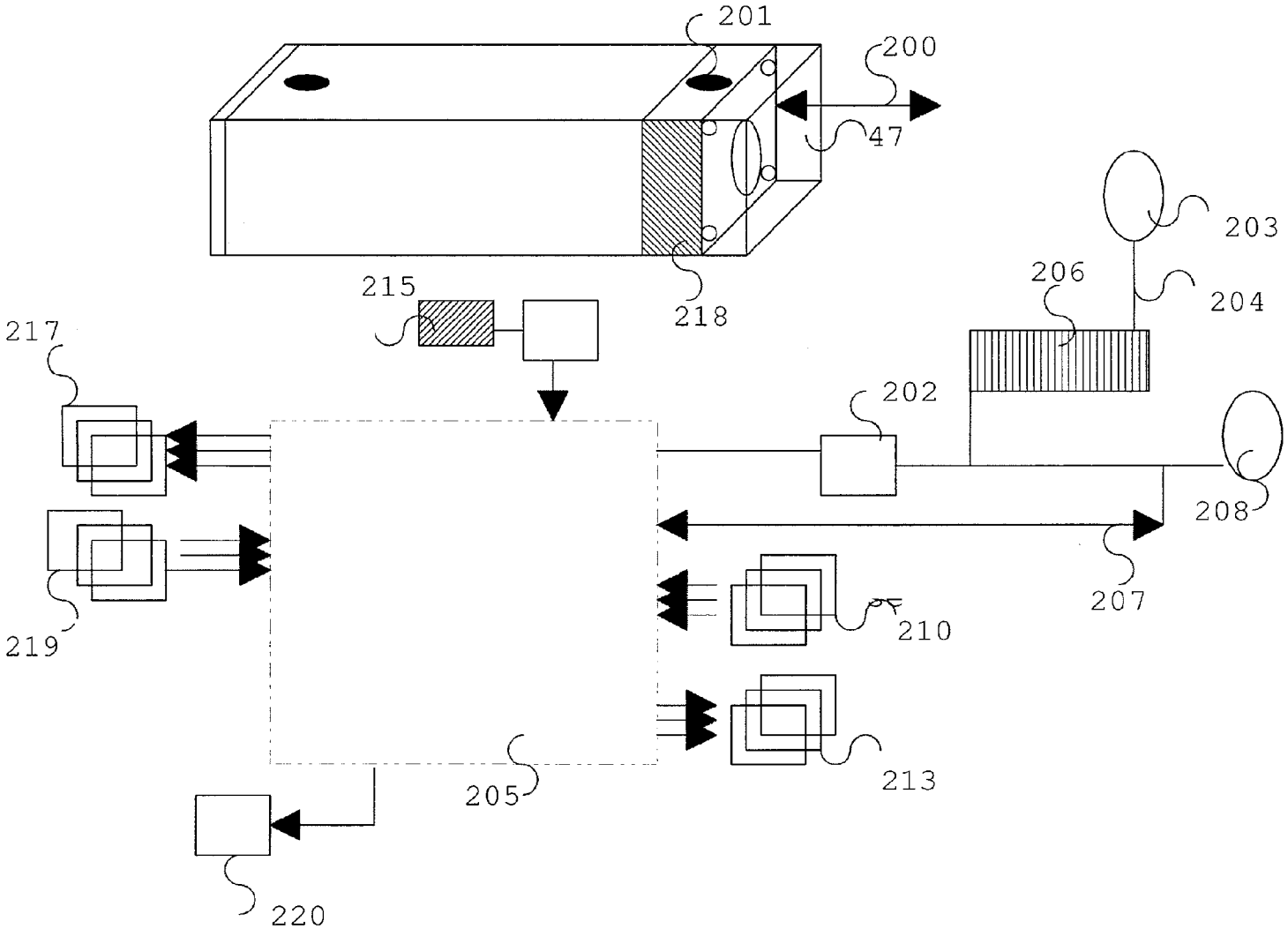
FIG. 21 is a block diagram illustrating a command, control and communication module of a J-Type Underwater Vehicle.

FIG. 21 is a block diagram illustrating a command, control and communication (C3) module (e.g., C3 module 15 as shown in FIG. 2) of a J-Type Underwater Vehicle. Various modes of operation for the JUV can include autonomous mode, fiber-optic remote control (FRC) mode, wireless remote control (WRC) mode, or crew manual mode. The configuration of the C3 module can, in part, be determined upon the desired operational mode.

A bi-directional arrow illustrates a main USPECM interface 200 for the C3 module. The USPECM command control is included within the C3 module. A USPECM distributed Ethernet switching system 205 provides a main interface for controlling a set of USPECM actuators 213 (e.g., the rudder actuators 163 as shown in FIG. 17, the water hole actuators 177 as shown in FIG. 18, etc.). The USPECM distributed Ethernet switching system 205 also controls a set of USPECM sensors 210 (e.g., temperature sensors, light or camera sensors, weaponry launch tube monitoring sensors, valve pressure sensors, oxygen level sensors, etc.). A USPECM interface is additionally provided for a three-axis digital compass 215. The three-axis digital compass 215, for example, can be a common-off-the-shelf compass capable of providing accurate readings within three dimensions.

The USPECM distributed Ethernet switching system 205 provides a main interface for controlling a retractable wireless communication periscope system (RWPS) electronics interface 202. The RWPS can be housed, for example, with an RWPS area 218 of the C3 module. The RWPS includes a float 203. The float can be released, for example through a USPECM autonomous cap 201 at the top of the RWPS area 218 of the C3 module. An RWPS winch 206 can be used to control the release and re-stowing of the RWPS float 203. When the JUV is enabled to run in FRC mode, a fiber optic link 207 connects the USPECM distributed Ethernet switching system 205 to both the RWPS electronics interface 202 and a fixed wireless communication periscope (FWP) 208. In some implementations, the FWP 208 is housed within the air module (e.g., FWP 187 as shown in FIG. 20).

When the JUV is enabled to be run by crew members, one or more USPECM monitoring stations 217 can display status information for the crew. For example, the USPECM monitor stations 217 can provide data regarding the reading of the digital compass 215, the state of the USPECM sensors 210, the state of the USPECM actuators 213, and the functioning of the RWPS system. The crew can provide commands to sensors 210, actuators 213, and/or the RWPS system through the USPECM distributed Ethernet switching system 205 using one or more USPECM command and control input devices 219. The command and control input devices 219, for example, can include steering mechanisms, switches, buttons, joystick controls, a keyboard interface, and/or other manual input devices.

A USPECM black box 220 collects detailed time stamped entries of the entire journal recording including, but not limited to, information regarding the surveillance cameras, sensors, engine room activities, and navigational readings. In a catastrophic event, the USPECM black box 220 can be recovered and read to determine the series of events which occurred on the JUV.

Figure 22:
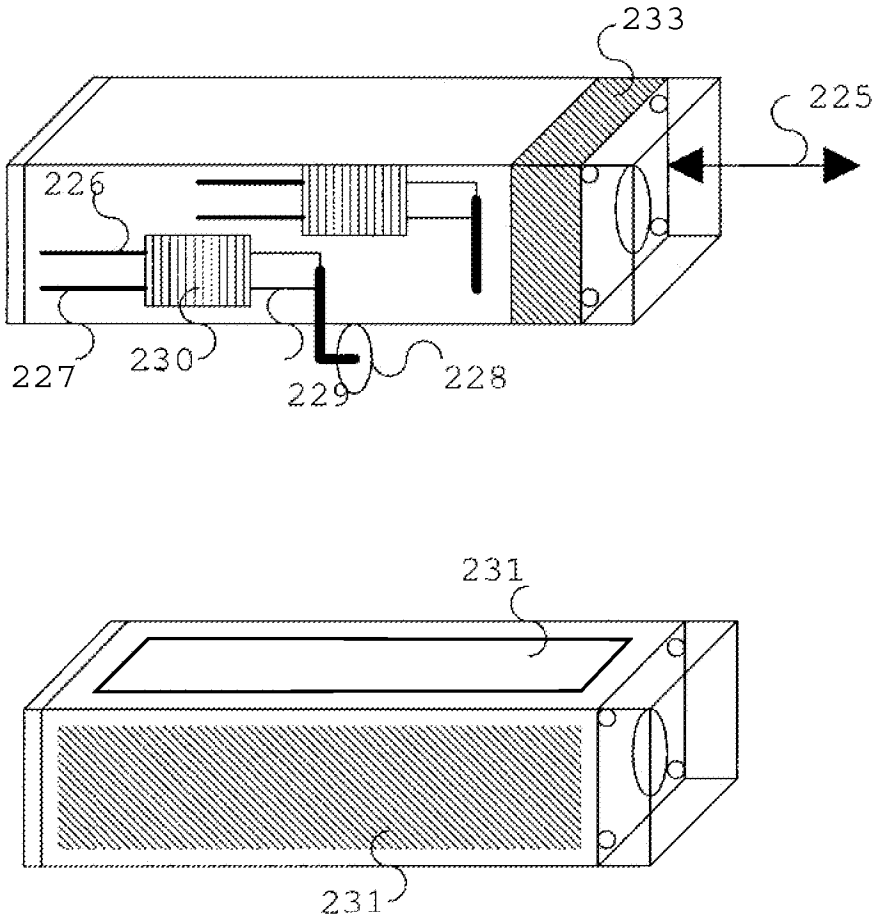
FIG. 22 is a block diagram illustrating an engine module of a J-Type Underwater Vehicle.

FIG. 22 is a block diagram illustrating an engine module (e.g., engine module 17 of FIG. 2) of a J-Type Underwater Vehicle. The JUV can include, for example, an engine 230 based on diesel, gas, hydrogen, nuclear, electric, hybrid, or a non-oxygen fuel for air-independent propulsion (AIP). Although only one engine 230 is illustrated in FIG. 22, any number of engines can be included within the engine module. A fuel line 227 and an air hose line 226 lead to the engine 230. The engine powers a transmission 229. The transmission drives a propeller system 228. The propeller system (e.g., the set of propulsion propellers 5, as shown in FIG. 1) is located centrally beneath the hull. An optional muffler and carbon dioxide ($CO_2$) storage and discharge area 233, for example used with a diesel, gas, or hybrid engine, is shown segregated from the main engine compartment of the engine module.

A set of acoustic ceiling material panels 231 can be used to isolate the engine noise and prevent it from being transmitted out of the room, module, and/or hull, depending upon the engine module configuration and/or the positioning of the acoustic panel(s) 231. For example, with a diesel engine, the acoustic ceiling material panels 231 could be mounted within the engine room, separate from the muffler and $CO_2$ storage and discharge area 233. A bi-directional arrow illustrates a USPECM interface 225 for interfacing the USPECM sensors and other devices used within the engine module with the USPECM central monitor system.

Figure 23:
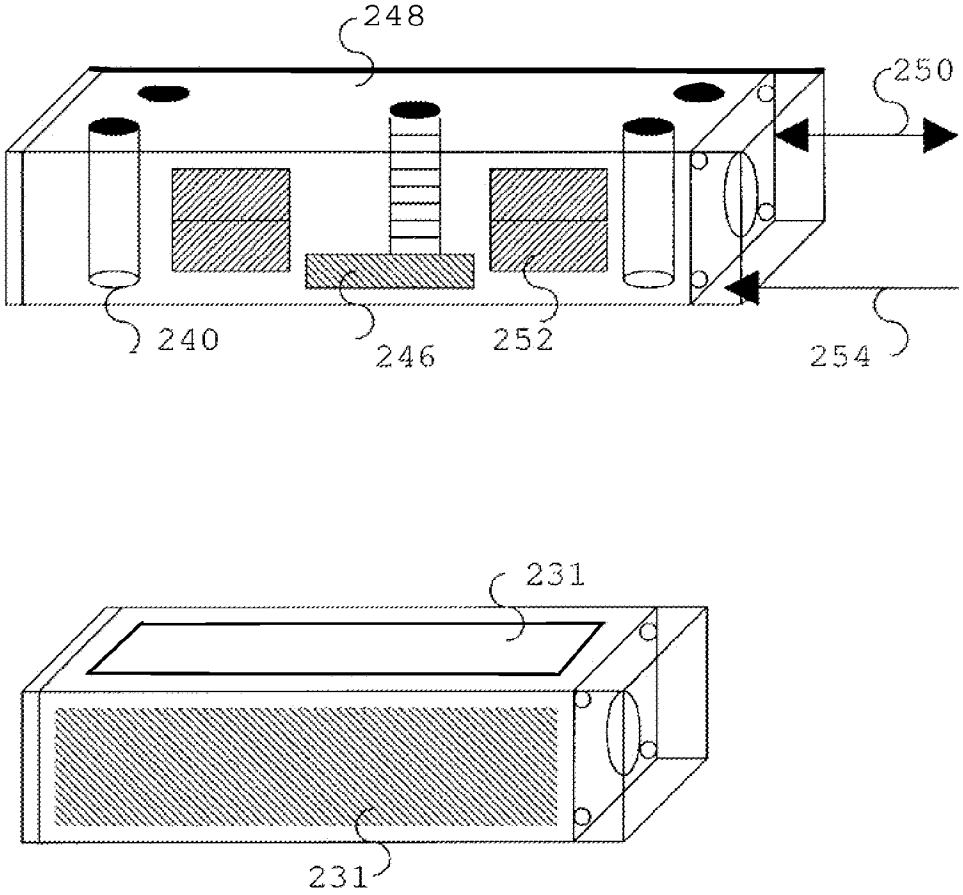
FIG. 23 is a block diagram illustrating a crew cabin module of a J-Type Underwater Vehicle.

FIG. 23 is a block diagram illustrating a crew cabin module of a J-Type Underwater Vehicle. The crew cabin module (e.g., crew cabin module 15 as shown in FIG. 2) provides the living, dining and sleeping space for the crew. A set of bunk bed suites 252 provide the crew with sleeping area. A refrigerator 246 can be used for food storage. The refrigerator 246 can be placed on the bottom side of the module, in some implementations, to increase the ballast capability of the module. A loft area 248 can include a kitchen, living area, physical exercise space, and bathroom.

In the case of emergency, a set of vertical launch tubes 240 each contain an emergency escape capsule (EEC) for evacuating the crew members. An AC/DC power feed 254 supplies electricity to the module (e.g., for refrigeration, etc.). A set of acoustic ceiling material panels 231 can be installed on the walls of the crew cabin module to prevent the crew's noise from being transmitted out of the room, module, or hull. A bi-directional arrow illustrates a USPECM interface 250 for interfacing the USPECM sensors and other devices used within the crew cabin module with the USPECM central monitor system.

Figure 24:
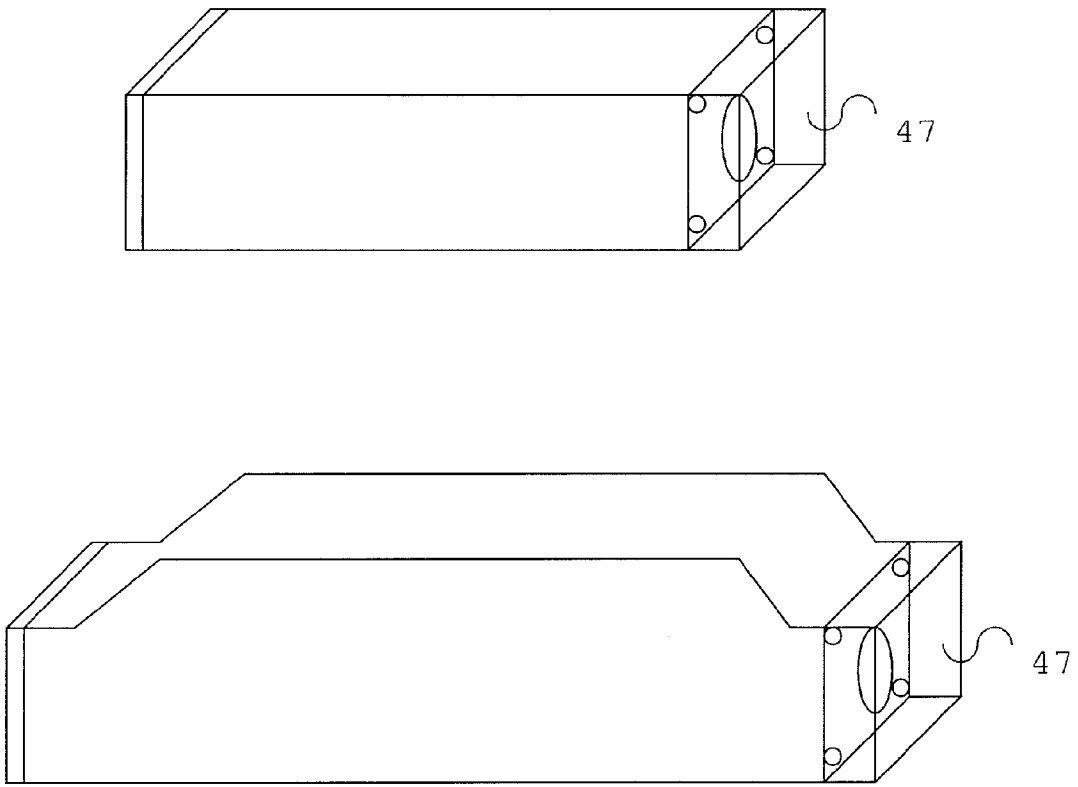
FIG. 24 is a block diagram illustrating an oversized module of a J-Type Underwater Vehicle.

FIG. 24 is a block diagram illustrating an oversized module of a J-Type Underwater Vehicle. One or more JUV modules can be built using an oversized design version to accommodate a large volume of payload. In some implementations, the vertical space can be increased between the module connection areas 47. The modification of the oversized module includes an angular structural design to maintain sonar deflection.

Retractable Wireless Communications Periscope System (RWPS) Design

Figure 25:
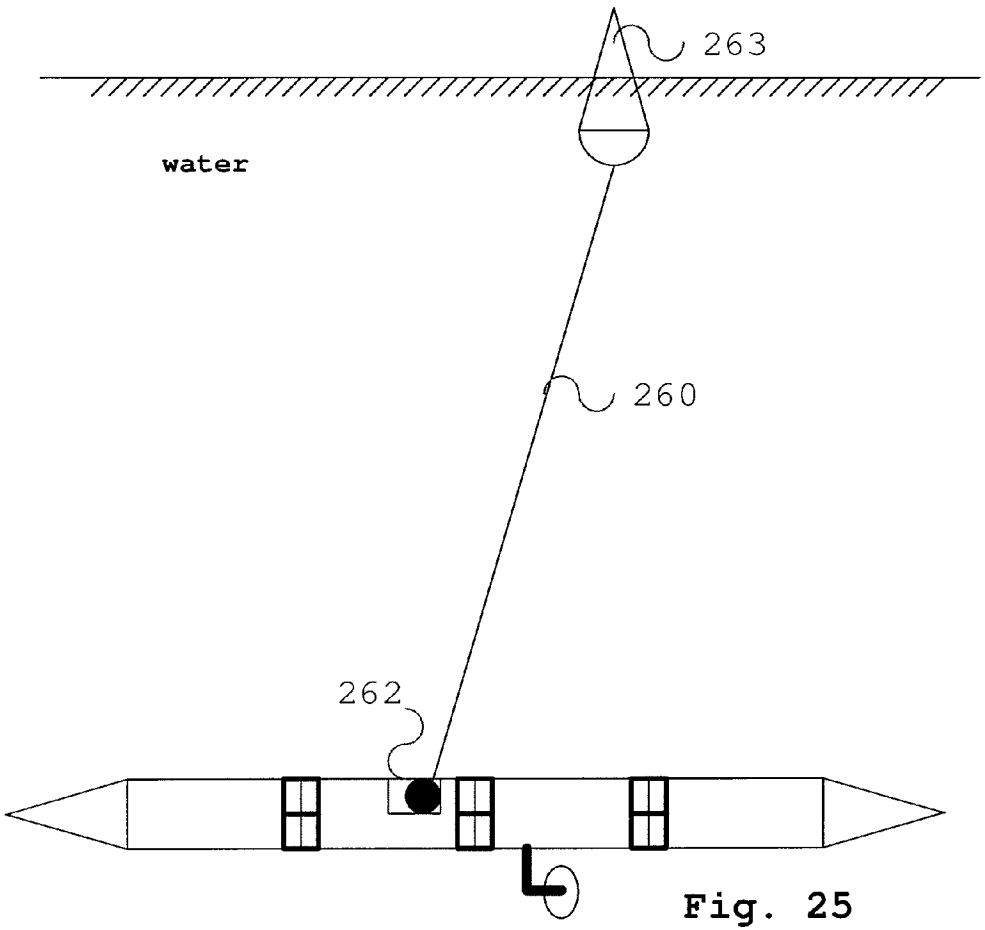
FIG. 25 is a block diagram illustrating an overview of a retractable wireless communication periscope system for use with a J-Type Underwater Vehicle.

FIG. 25 is a block diagram illustrating an overview of a retractable wireless communications periscope system (RWPS) for use with a J-Type Underwater Vehicle. The RWPS includes an RWP float 263, an RWP media wire 260, and an RWP base 262. The RWP float 263 of the RWPS can provide deep sea high speed wireless communication and visual surveillance capability for the JUV. A traditional periscope is typically limited to 50 feet in length. In contrast, the RWPS can provide up to one kilometer or more in periscope length using the RWP media wire 260. The length of the RWP media wire 260, in some examples, may be limited by float buoyancy, media transmission speed (e.g., fiber optic or very high bitrate digital subscriber line (VDSL)), and/or DC power feed. The RWP base 262, in some examples, can be powered by Power over Ethernet (PoE), VDSL with DC power over Cat-5 cable, or 1000 Base-X with DC power. The RWP base 262 includes a winch and spool for the RWP media wire 260. The RWP float 263 can be deployed by the JUV by releasing the RWP media wire 260 using the winch and spool within the RWP base 262. While the RWP float 263 is deployed, in some examples, the JUV can communicate in a wireless manner with surrounding JUV units and/or a control base (e.g., air craft carrier, nearby island control unit, etc.). During RWP float deployment, the JUV can also survey surface images.

Figure 26:
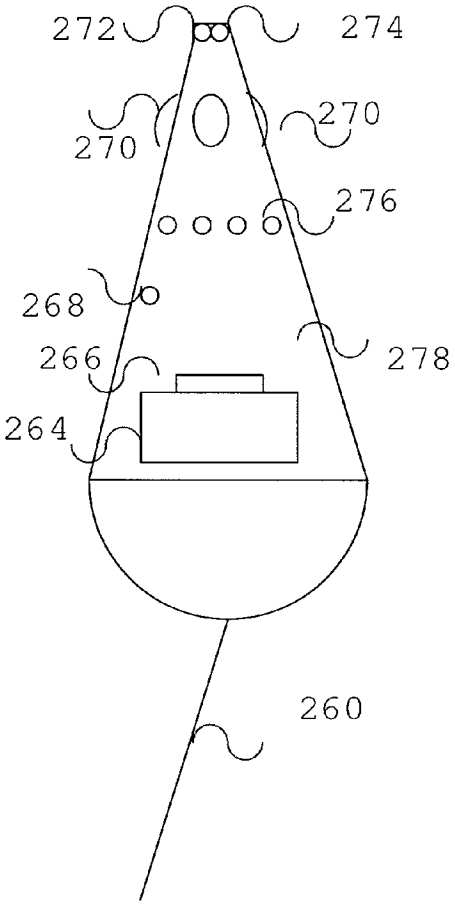
FIG. 26 is a block diagram illustrating a retractable wireless communication periscope float for use with a J-Type Underwater Vehicle.

FIG. 26 is a block diagram illustrating a retractable wireless communication periscope float for use with a J-Type Underwater Vehicle. The RWP float (e.g., RWP float 263 as shown in FIG. 25) provides the buoyancy for the RWPS on the surface of the water. The RWP float is tethered to the JUV by the media wire 260. The RWP float includes RWP float electronics 264 for controlling the peripheral units (e.g., one or more communications antennas, sensors, etc.) of the RWP float.

The RWP float includes a wireless communications antenna 272. The wireless communications antenna 272, in some examples, can enable communication between the JUV and a command base or JUV peer using WiMAX 802.16, Satellite, and/or WiFi 802.11 wireless communication standards. A global positioning system (GPS) antenna 274 enables GPS reception for positioning reading. One or more camera lenses 270 can provide omni-directional surveillance. One or more beacons 276 (e.g., flash light emitting diodes (LEDs), etc.) can be used to provide a visual indicator on the surface (e.g., to verify position during remote control deployment). A hydrophone 268 can be used, for example, to detect an approaching object, such as a vessel, during the deployment of the RWP float. A three-axis digital compass 266 can be used for RWP float orientation.

Figure 27:
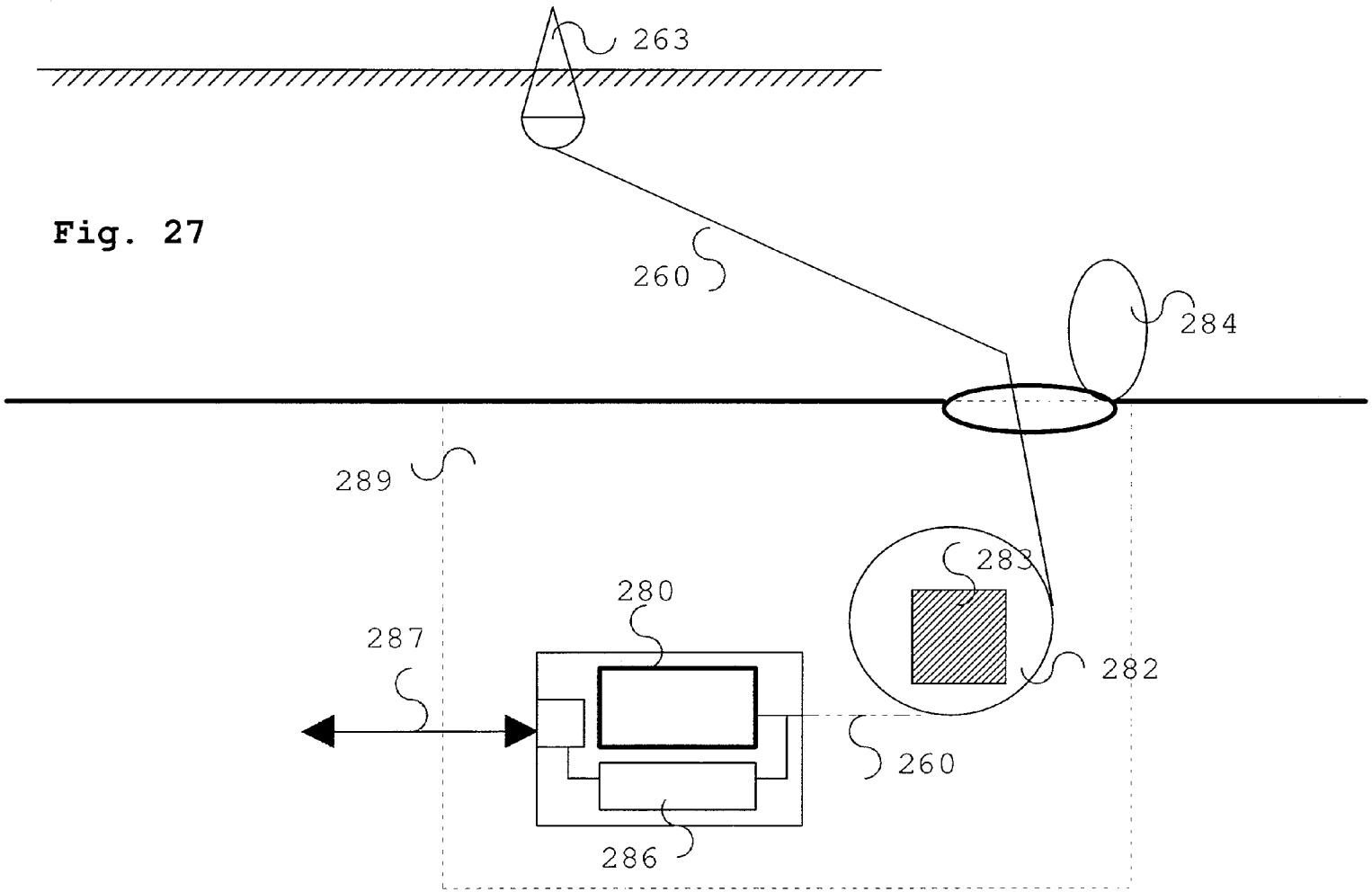
FIG. 27 is a block diagram illustrating a base design for the retractable wireless communication periscope float used with a J-Type Underwater Vehicle.

FIG. 27 is a block diagram illustrating a base design for the retractable wireless communication periscope float 263 used with a J-Type Underwater Vehicle. The RWP base 262 (as shown in FIG. 25) provides the winch function for the RWP float 263. The RWP base enclosure 289 includes a winch 282 and a USPECM winch controller 283. The media wire 260 is spooled on the winch 282. When the RWP float is deployed, an RWP base electronics unit 280 within the RWP base enclosure 289 provides a command to open a USPECM autonomous cap 284 (described in FIGS. 57 through 59).

The electronics unit 280 then commands the winch controller 283 to release media wire 260 from the winch 282. The electronics unit 280 is powered by a DC power unit 286. The DC power unit 286 provides the power required for the entire RWPS. A bi-directional arrow illustrates a USPECM interface 287 between the RWP base enclosure 289 and the USPECM central monitor (e.g., the USPECM distributed Ethernet switching system 205 as shown in FIG. 21).

Figure 28:
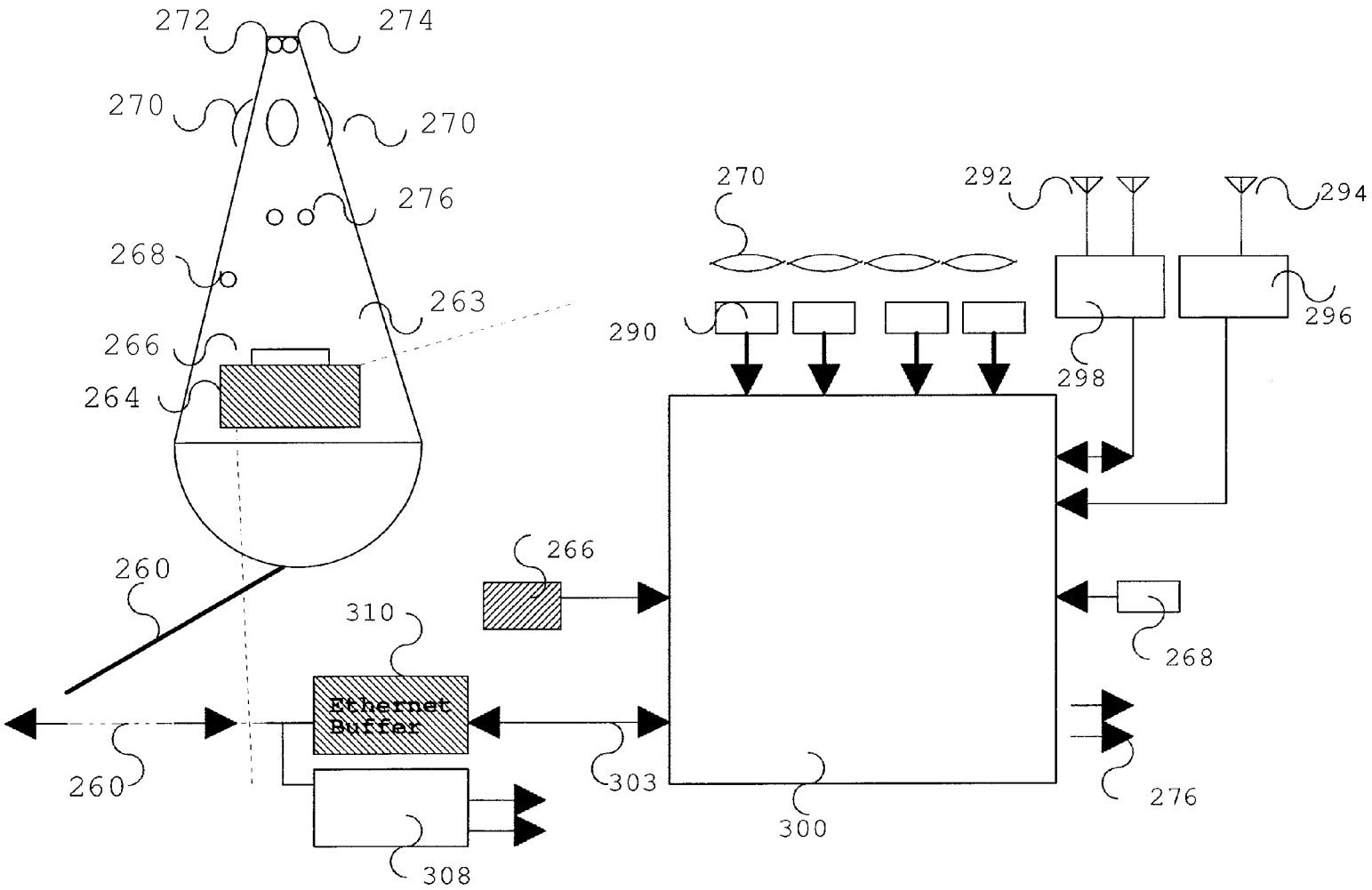
FIG. 28 is a block diagram illustrating an electronics design for the retractable wireless communication periscope float used with a J-Type Underwater Vehicle.

FIG. 28 is a block diagram illustrating an electronics design for the retractable wireless communication periscope float used with a J-Type Underwater Vehicle. As illustrated in FIG. 26, the RWP float electronics 264 can provide control for a number of peripherals, including but not limited to one or more wireless communications antennas 272, the GPS antenna 274, camera lenses 270, the hydrophone 268, the beacon 276, and/or the three-axis digital compass 266. The RWP float is tethered by the RWP media wire 260.

Within the electronics 264, a Field Programmable Gate Array (FPGA) or Application Specific Integrated Circuit (ASIC) 300 provides the main electronics control for the FWP float peripherals. The FPGA/ASIC 300, in some implementations, can be designed as a system on chip (SoC). The FPGA/ASIC 300 can be designed to implement the orthogonal frequency-division multiplexing (OFDM) wireless communication processing, Joint Photographic Experts Group (JPEG) and/or Moving Picture Experts Group (MPEG) compression processing and Ethernet media access control (MAC) communication processing.

The FPGA/ASIC 300 receives DC power from a DC-power extraction and conversion unit 308. The DC-power extraction and conversion unit 308 extracts DC power from the media wire 260 and converts to one or more DC power levels as required by the RWP float electronics 264. The FPGA/ASIC 300 communicates with the RWPS base through an Ethernet buffer 310. The Ethernet buffer 310 provides buffering between the media wire 260 and a digital Ethernet interface 303. The Ethernet buffer 310 is connected between the media wire 260 and a digital Ethernet interface 303 of the FPGA/ASIC 300. The digital Ethernet interface 303 provides physical layer independent connectivity from the FPGA/ASIC 300 to the JUV network controller. The digital Ethernet interface 303, in some examples, can be a Media Independent Interface (MID, Reduced Media Independent Interface (RMII), Gigabit Media Independent Interface (GMII), or a Reduced Gigabit Media Independent Interface (RGMII).

The FPGA/ASIC 300 is in bi-directional communication with a wireless communications antenna 292 (e.g., WiMAX, WiFi, satellite, etc.). A WiMAX communications antenna, for example, can provide long range communications of up to thirty-five miles using the WiMAX 802.16 communications protocol. A WiFi communications antenna, on the other hand, can provide short range communications of approximately two hundred meters using the WiFi 802.11 communication protocol. In other implementations, the wireless communications antenna 292 may be a satellite communication antenna. A wireless low noise amplifier (LNA) 298 provides amplification to the signals provided to and from the wireless communications antenna 292. The FPGA/ASIC 300 also receives communications from a GPS antenna 294. A GPS LNA 296 provides amplification to the signals provided from the GPS antenna 294.

The FPGA/ASIC 300 receives input from one or more image sensors 290 (e.g., charge-coupled device (CCD), complementary metal-oxide-semiconductor (CMOS), etc.). The image sensors 290 are connected to the lenses 270. In some implementations, the image sensors 290 are black and white sensors. Using the input from the image sensors 290, in some examples, the FPGA/ASIC 300 can process the information into JPEG or MPEG compressed image format. The FPGA/ASIC 300 additionally receives readings from the three-axis digital compass 266, the hydrophone 268, and the beacon 276.

Figure 29:
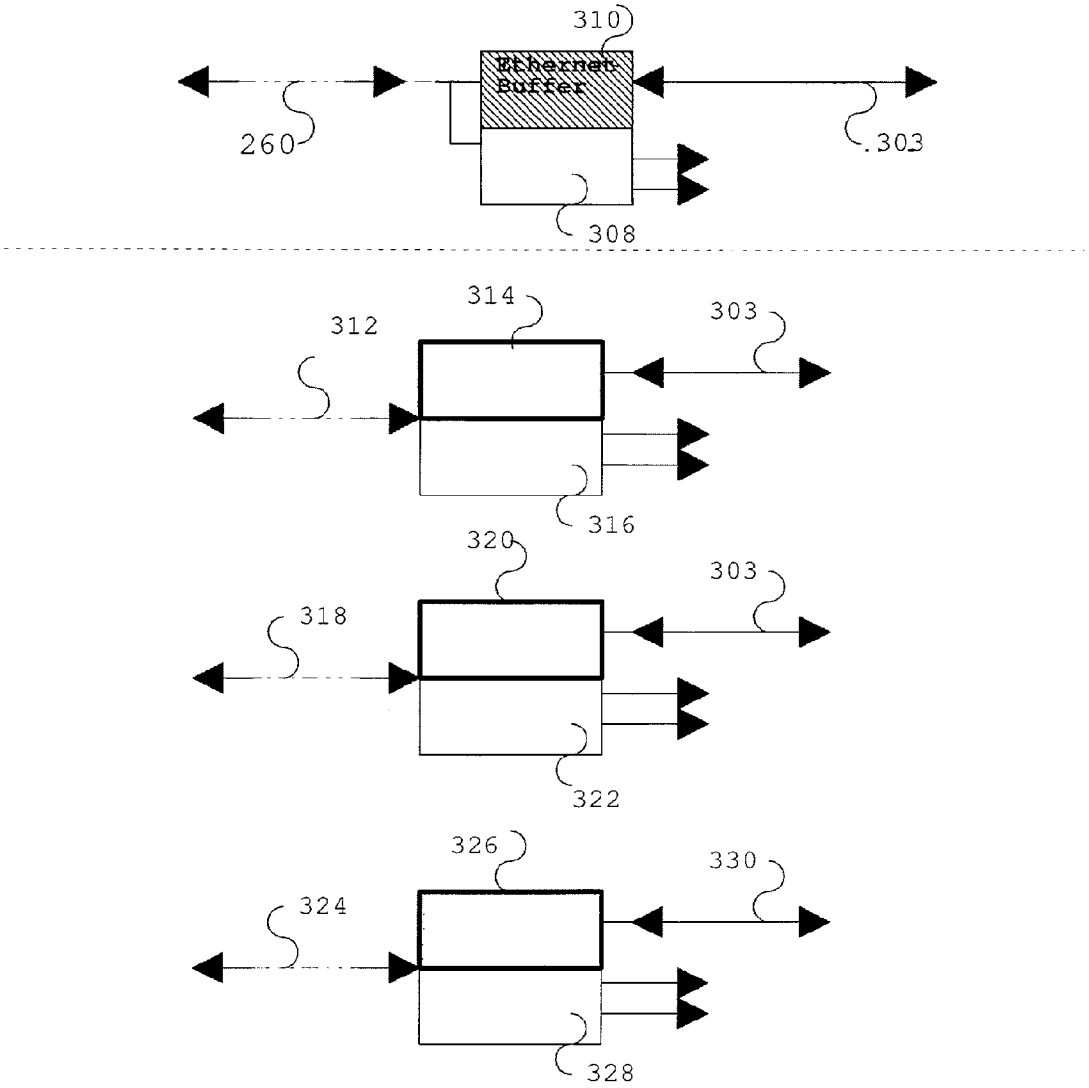
FIG. 29 is a block diagram illustrating various Ethernet buffers for use in the electronics of the retractable wireless communication periscope float.

FIG. 29 is a block diagram illustrating various Ethernet buffers which could be used in the electronics of the retractable wireless communication periscope float. In a general configuration, the Ethernet buffer 310 and the DC-power unit 308 are installed between the media wire 260 which tethers the RWP float to the JUV and the digital Ethernet interface 303 which interfaces with the RWP float electronics (e.g., float electronics 264 as shown in FIG. 28). The DC-power unit 308 derives power from the media wire 260 to power the RWP float electronics. The DC-power unit 308 can provide any number of voltage levels as required by the RWP float electronics (e.g., +3V, +5V, etc.). Depending upon the type media wire 260 used, different types of Ethernet buffers 310 and/or DC-power units 308 may be selected for optimal functionality.

In a first exemplary configuration, the media wire 260 is shown as a Cat-5 Ethernet cable 312 with a maximum length PoE transmission of 100 meters. A common off-the-shelf Ethernet switching ASIC 314, such as a 100 Base-TX PHY buffer (e.g., Kendin-KS8995XA available through Micrel, Inc. of San Jose, Calif.) is provided as the Ethernet buffer 310. A DC-Power unit 316 interfaces with the Ethernet switching ASIC 314 to derive power from the Cat-5 Ethernet cable 312. The Ethernet switching ASIC 314 provides buffering between the Cat-5 Ethernet cable 312 and the digital Ethernet interface 303 (e.g., MII, RMII).

In a second exemplary configuration, the media wire 260 is shown as a Cat-5 Ethernet cable 318 with a maximum length Ethernet over VDSL transmission of 4 kilometers. A common off-the-shelf Ethernet over VDSL ASIC 320 (e.g., Infineon PEF22827 available through Infineon Technologies of Munich, Germany) is provided as the Ethernet buffer 310. A DC-Power unit 322 interfaces with the Ethernet over VDSL ASIC 320 to derive power from the Cat-5 Ethernet cable 318. The Ethernet over VDSL ASIC 320 provides buffering between the Cat-5 Ethernet cable 318 and the digital Ethernet interface 303 (e.g., MII, RMII).

In a third exemplary configuration, the media wire 260 is shown as a single mode fiber cable added to a DC power line 324 with a maximum length 1000Base-X transmission of 10 kilometers. A common off-the-shelf Gigabit Ethernet switching ASIC 326 (e.g., available through Marvell Technology Group Limited of Santa Clara, Calif. or Vitesse Semiconductor Corporation of Camarillo, Calif.) is provided as the Ethernet buffer 310. A DC-Power unit 328 interfaces with the GbE switching ASIC 326 to derive power from the single mode fiber cable plus DC power line 324. The GbE switching ASIC 326 provides buffering between the single mode fiber cable plus DC power line 324 and a digital Ethernet interface 330 (e.g., RGMII, GMII).

Figure 30:
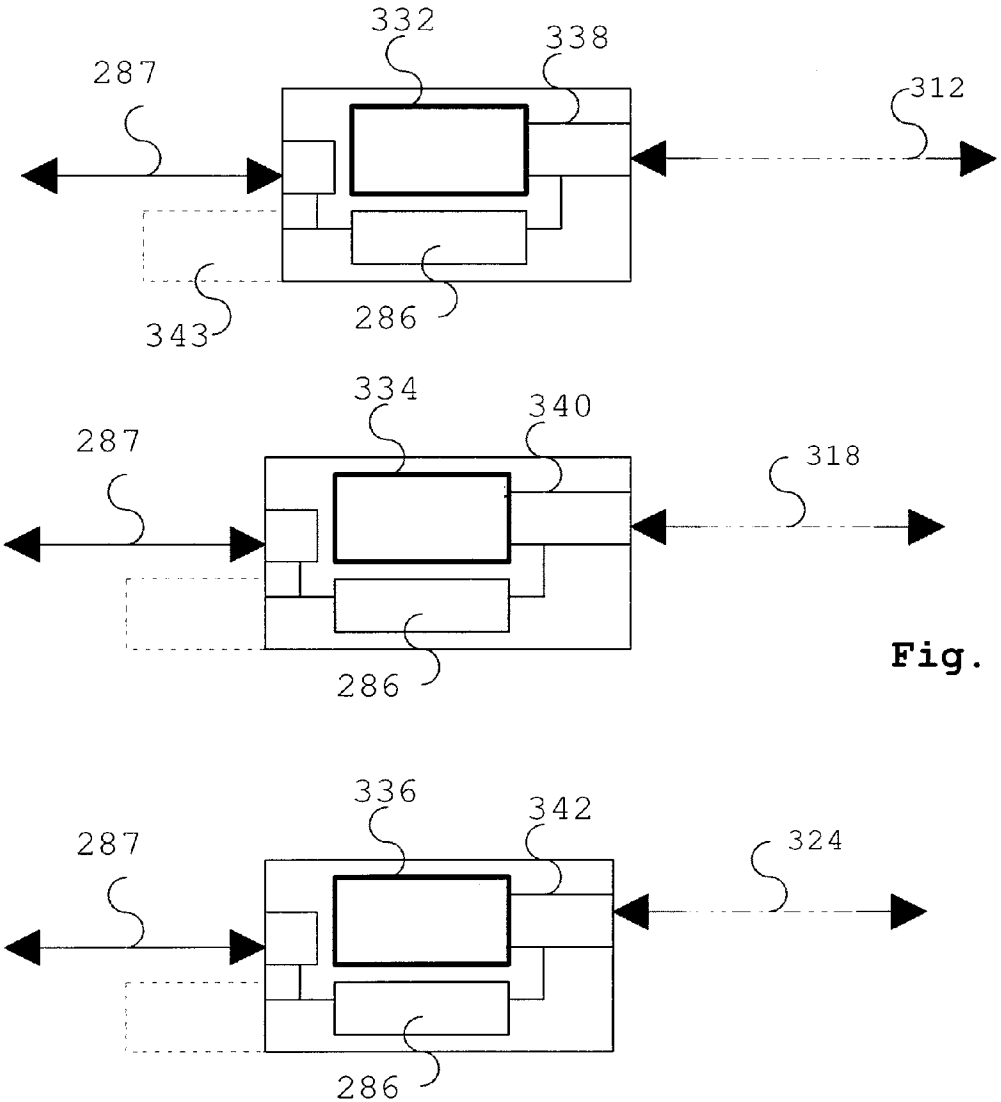
FIG. 30 is a block diagram illustrating electronics designs incorporating the various Ethernet buffers for use in the electronics of the retractable wireless communication periscope float.

FIG. 30 is a block diagram illustrating electronics designs incorporating the various Ethernet buffers for use in the electronics of the retractable wireless communication periscope float. The RWP base electronics (e.g., RPW base electronics 280 as shown in FIG. 27) provide the USPECM interface and DC power for the RWP float deployment peripherals (e.g., the RWP media wire 260, winch controller 283, and winch 282 as shown in FIG. 27). The source USPECM interface 287 (as shown in FIG. 27) is illustrated in FIG. 30 as interfacing with various exemplary Ethernet buffer configurations to provide communications for the USPECM control signals to and from the RWP base electronics.

In a first exemplary configuration, the USPECM interface 287 interfaces with an Ethernet buffer/switch 332. The DC-power unit 286 (as shown in FIG. 27) derives power from the CAT-5 Ethernet cable 312 (as shown in FIG. 29) to power the Ethernet buffer/switch 332 and the RWP base electronics. In addition to a DC-Power unit 286, a local DC power source 343 can be provided as a backup local DC power. For example, the local DC-power source 343 can be used if the DC-Power unit 286 cannot provide enough DC power to power the various electronics within the RWP base. An Ethernet physical layer transceiver (PHY) 338 implements the physical layer (e.g., 100Base-TX, etc.).

In a second exemplary configuration, the USPECM interface 287 interfaces with an Ethernet over VDSL buffer 334. The DC-power unit 286 derives power from the CAT-5 Ethernet cable 318 (as shown in FIG. 29) to power the Ethernet over VDSL buffer 334 and the RWP base electronics. A PHY 340 implements the physical layer (e.g., EoVDSL, etc.).

In a third exemplary configuration, the USPECM interface 287 interfaces with an Ethernet buffer/switch 336. The DC-power unit 286 derives power from the single mode fiber cable plus DC power line 324 (as shown in FIG. 29) to power the Ethernet buffer/switch 336 and the RWP base electronics. A PHY 342 implements the physical layer (e.g., GbE PHY, etc.).

Fixed Wireless-Communications Periscope (FWP) and Snorkel System Design

The JUV FWP provides a simple alternative to the RWPS (e.g., as described in FIGS. 25 through 30). The FWP can be a long pole stowed flat against the hull of the JUV while not in use. When the JUV is submerged within the FWP pole length (e.g., equivalent to a typical periscope length), the FWP can be elevated to the surface to perform periscope functionality, wireless communication functionality and/or snorkeling functionality.

Figure 31:
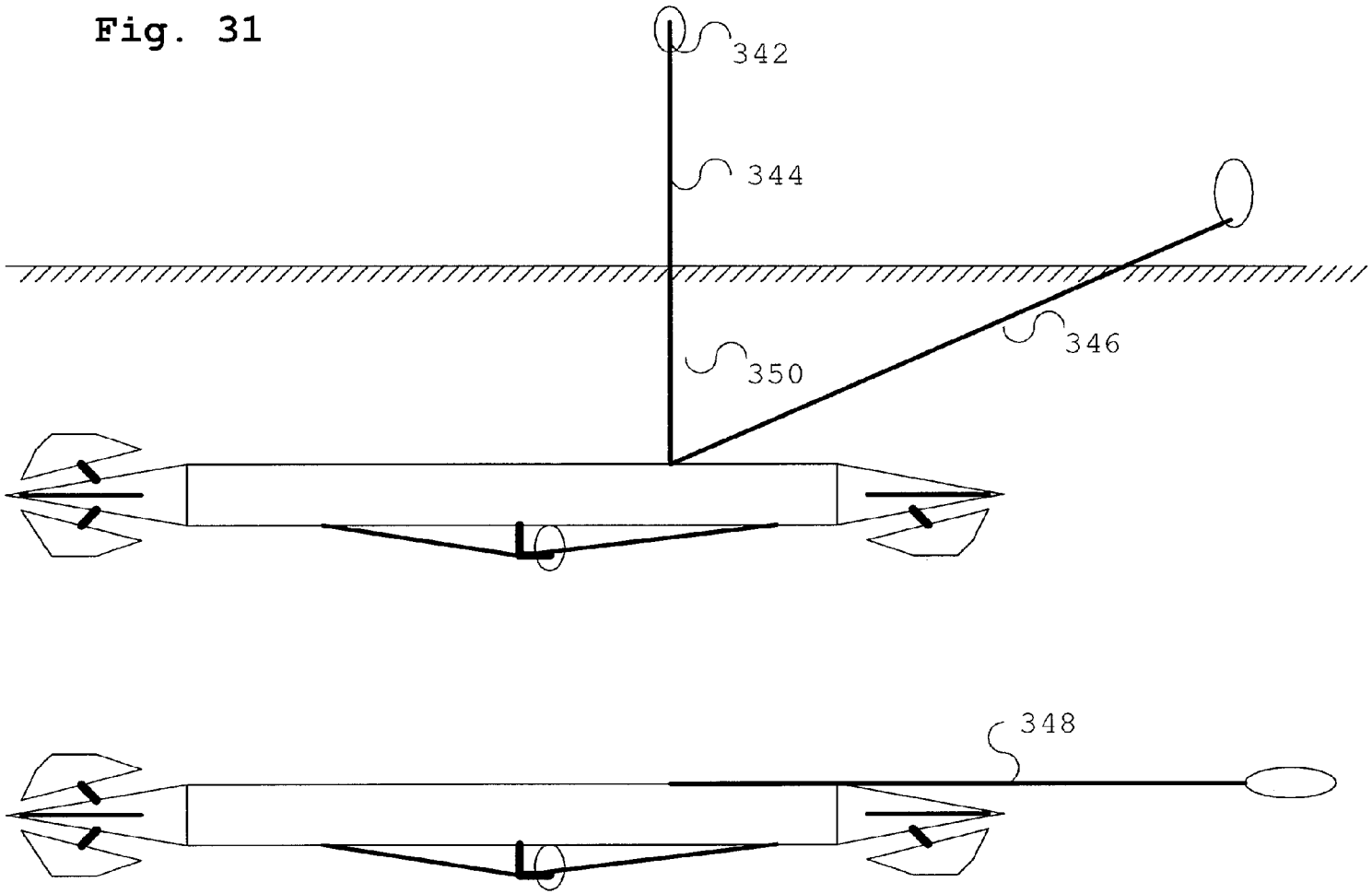
FIG. 31 is a block diagram illustrating a fixed wireless communications periscope with a snorkel system.

As shown in FIG. 31, a block diagram illustrates a fixed wireless communications periscope (FWP) with a snorkel system. The FWP includes a pole 344 with a tip 342. While submerged and cruising, the pole 344 is stowed at a 0 degree angle 348 to the hull of the JUV. The FWP tip 342 extends off the end of the stern of the JUV. As the pole 344 is lifted to the surface, it is shown at a 30 degree rising position 346 and again at a full upright 90 degree position 350. Within the 90 degree position 350, for example, the FWP is ready to perform the periscope, wireless communications, and/or snorkeling tasks desired.

Figure 32:
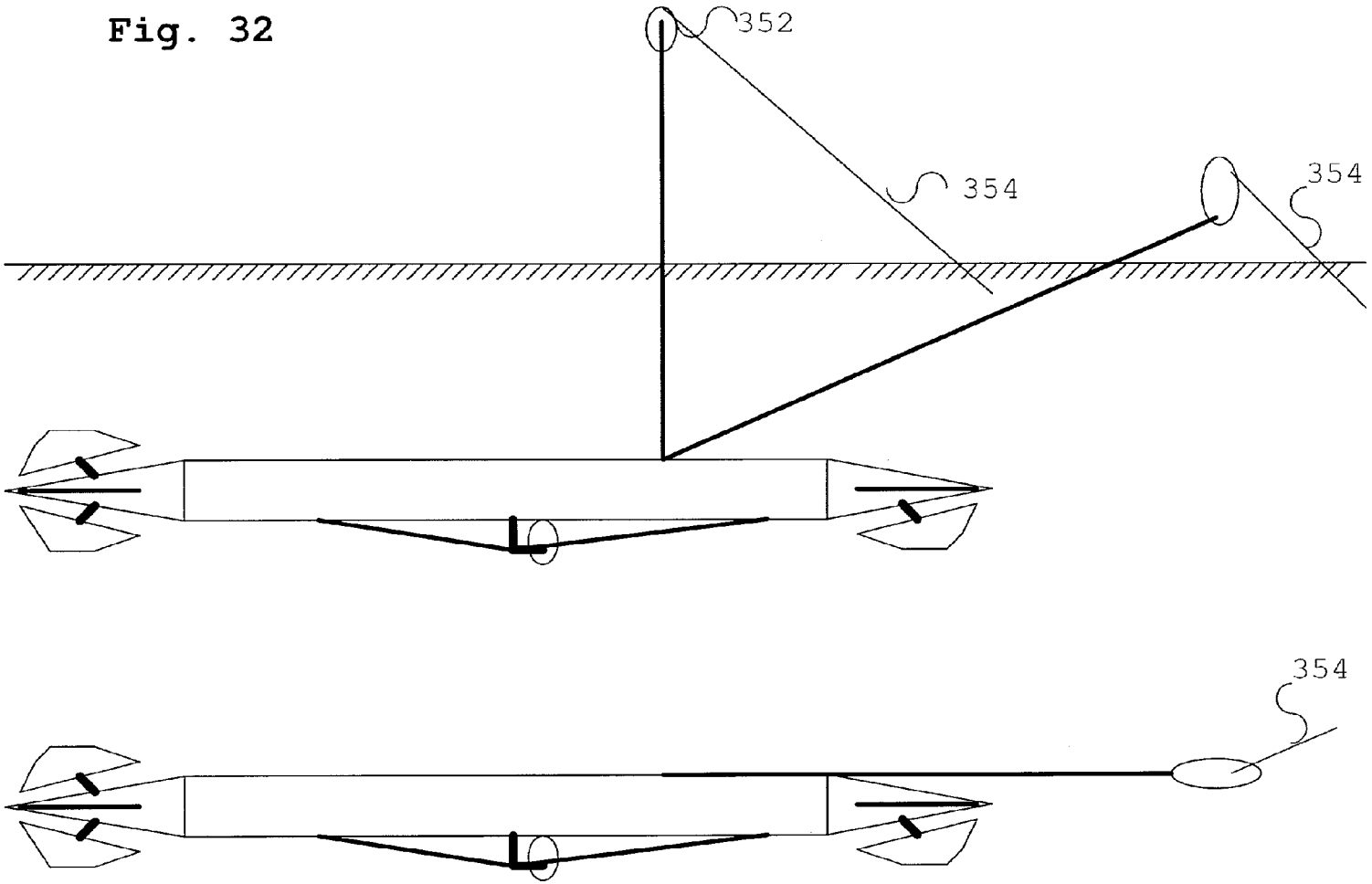
FIG. 32 is a block diagram illustrating a fixed wireless communications periscope with a snorkel system and fiber optic remote control.

FIG. 32 is a block diagram illustrating a fixed wireless communications periscope with a snorkel system and fiber optic remote control. An advanced FWP 352 can be designed based on the FWP 342 (as described in FIG. 31) by adding the snorkeling function and fiber optic remote control function. A fiber optic link 354 is shown extending from the tip of the advanced FWP 352 (e.g., at the top of the pole 344).

Figure 33:
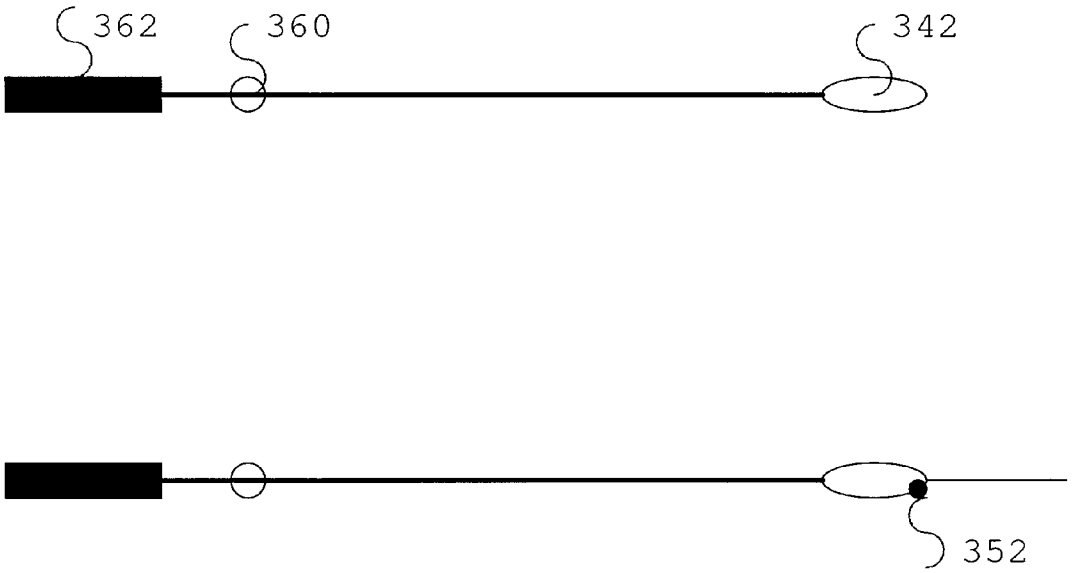
FIG. 33 is a block diagram illustrating a mechanical structure of a fixed wireless communications periscope with a snorkel system.

FIG. 33 is a block diagram illustrating a mechanical structure of a fixed wireless communications periscope with a snorkel system. Raising the FWP pole 344, which may typically be about 15 meters long, can be heavy work. A balanced weight 362 can be added on the JUV-end of the pole 344 to balance the weight of the FWP pole 344. A low torque worm gear 360, for example, can be used to control the raising and lowering of the FWP pole 344.

Within a first configuration, a standard FWP 342 is shown at the end of the pole 344. Within a second configuration, an advanced FWP 352 is shown. The advanced FWP 352 includes a fiber optic connector (e.g., 10 GbE, 1 GbE, etc.). The fiber optic connector can be plugged into a fiber cable to enable remote control functionality of the FWP system.

Figure 34:
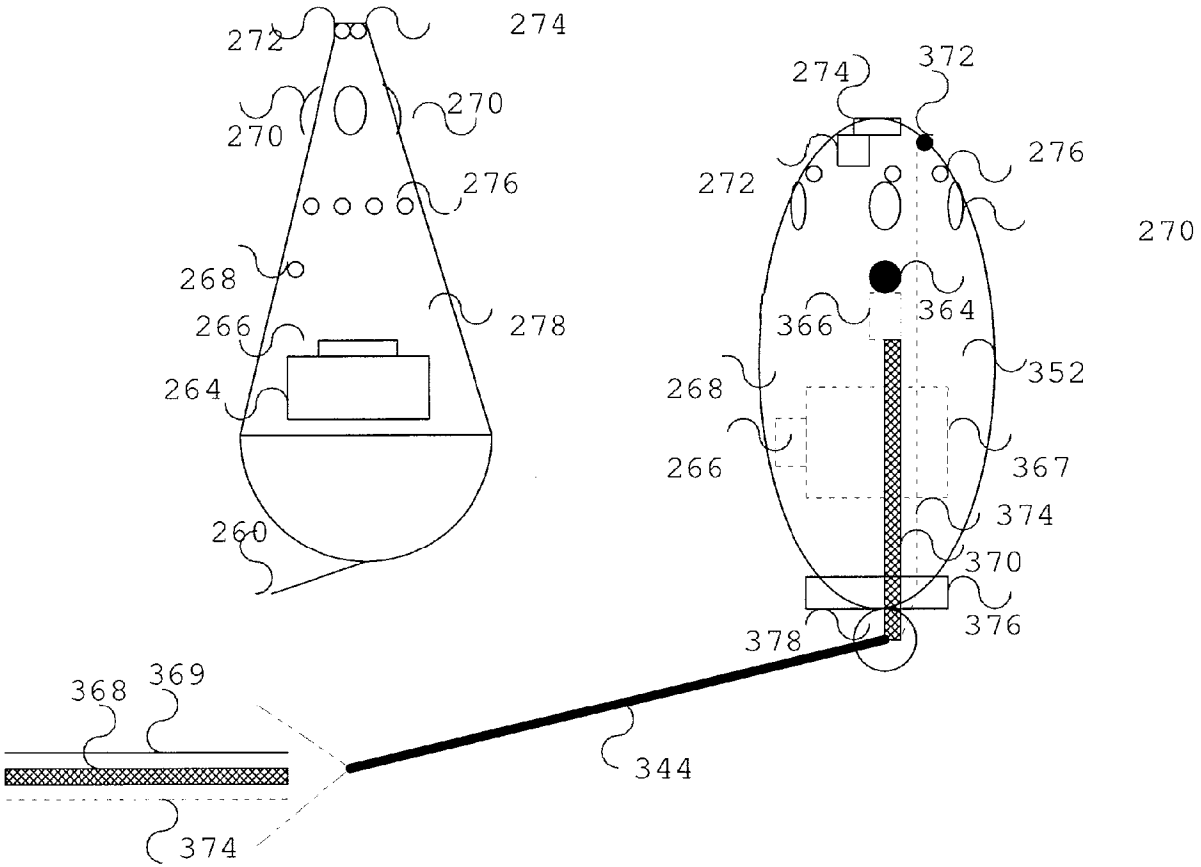
FIG. 34 is a block diagram illustrating a tip of a fixed wireless communications periscope.

FIG. 34 is a block diagram illustrating a tip of a fixed wireless communications periscope. The design of the FWP tip (e.g., tip 356 as illustrated in FIG. 33) can be similar to that of the RWP float (as illustrated in FIG. 25). An air hole 364 with a USPECM valve actuator 366 may be included in addition to the RWP float peripherals (e.g., wireless antenna 272, GPS antenna 274, camera lenses 270, beacon 276, hydrophone 268, and three-axis compass 266).

The air hole 364 and actuator 366 can enable snorkeling functionality. An air hose 370 provides a pathway for fresh air from the RWP tip to the JUV air module (e.g., air module 19 as shown in FIG. 2 and described in FIG. 20). A conduit for the air hose 368 can be included within the FWP pole 344.

An FWP electronics module 367 can control the peripherals included within the FWP tip. Additionally, the FWP electronics module 367 can relay control information to a horizontal rotator 376 and a vertical rotator 378. The horizontal rotator 376 and the vertical rotator 378, for example, can each rotate the FWP tip up to 90 degrees for better wireless communication and periscope surveillance. The FWP pole 344 can provide a conduit for the FPW USPECM interface 269, and a fiber optic communication line 374. The fiber optic communication line, for example, can communicate with a fiber optic communication connector 372 (e.g., for remote control purposes).

Figure 35:
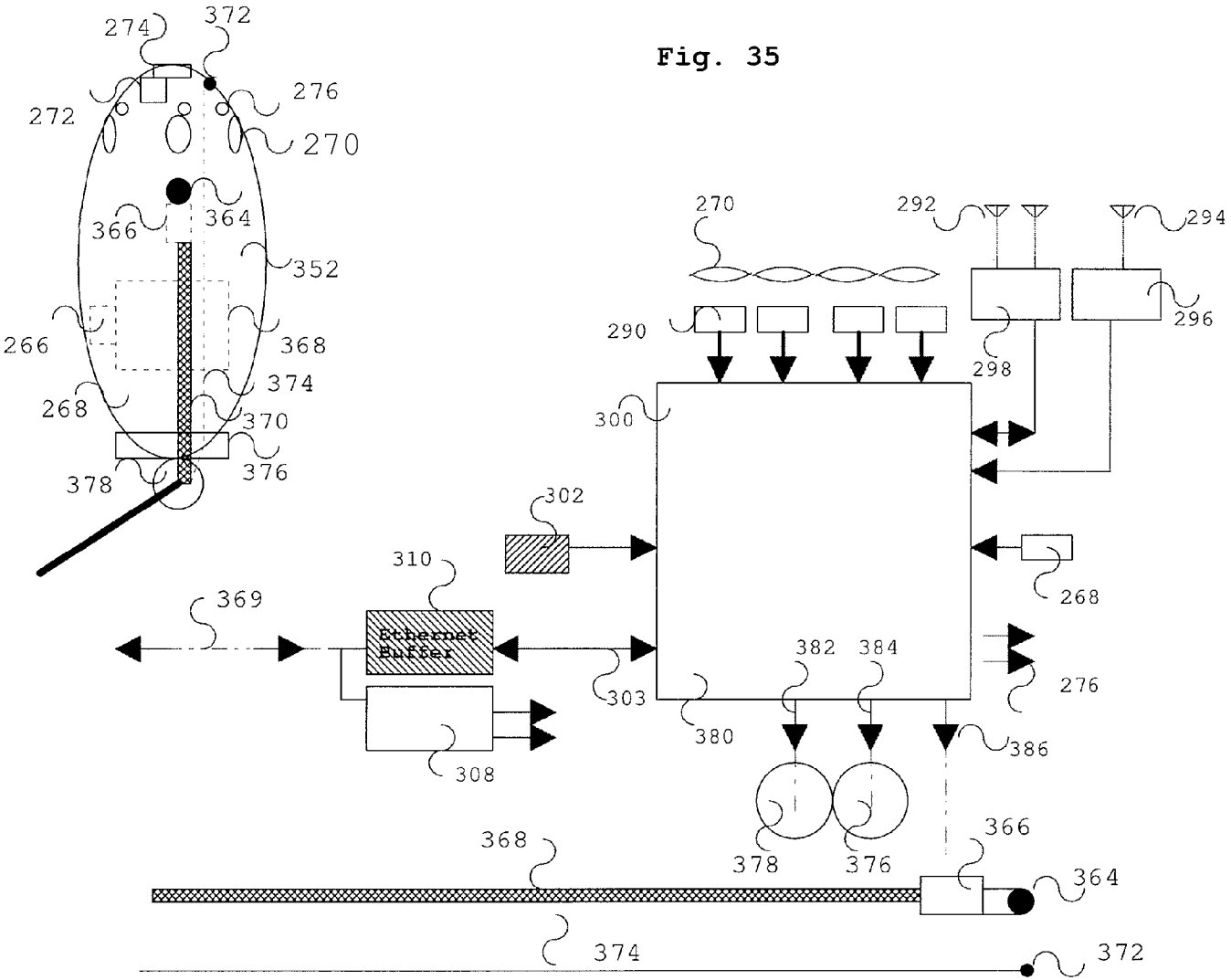
FIG. 35 is a block diagram illustrating an electronics layout within the tip of a fixed wireless communications periscope.

FIG. 35 is a block diagram illustrating an electronics layout within the tip of a fixed wireless communications periscope. The FWP tip electronics can be similar to that of the RWP float electronics (e.g., as illustrated in FIG. 28). In addition to the RWP float electronics layout, a vertical rotation motor controller 382 and a horizontal rotation motor controller 384 can be added to the FPGA/ASIC 300 to control the horizontal rotator 376 and the vertical rotator 378 (as described in FIG. 34). A valve controller 386 can also be added to the FPGA/ASIC 300 to control the actuator 366 for the air hole 364 (as described in FIG. 34).

Retractable Snorkeling System (RSS) Design

Figure 36:
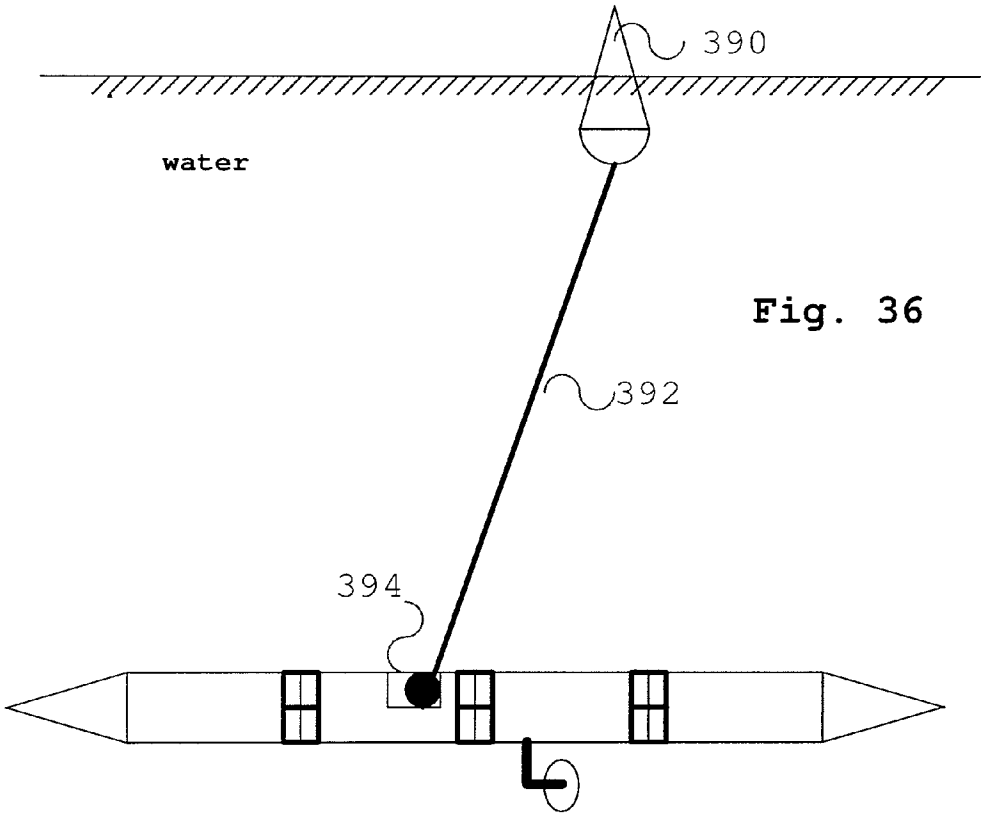
FIG. 36 is a diagram illustrating a retractable snorkeling system.

FIG. 36 is a diagram illustrating a retractable snorkeling system (RSS). The RSS can be designed similar to the RWPS (e.g., as described in FIGS. 25 through 30). The RSS includes an RSS float 390 which can be released to the surface of the water. The RSS float 390 is connected to an RSS base 394 stowed within the JUV. A light weight air hose 392 with a USPECM interface (e.g., conduit within or beside the air hose) tethers the RSS float 390 to the RSS base 394.

Figure 37:
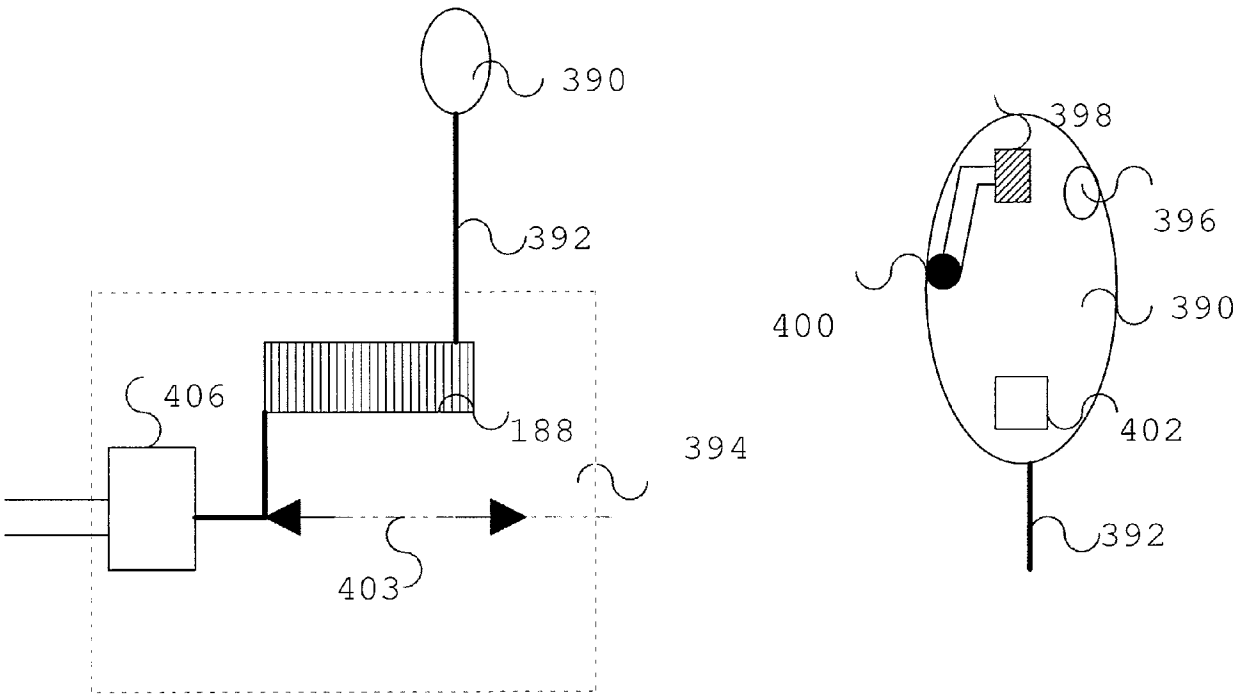
FIG. 37 is a block diagram illustrating a float and base design of a retractable snorkeling system.

FIG. 37 is a block diagram illustrating a float and base design of a retractable snorkeling system. The RSS float 390 is tethered to the RSS base enclosure 394 using the air hose 392. The RSS base enclosure 394 includes a winch 188. The air hose 392 can be extended and retracted by the JUV using the winch 404. The air hose 392 terminates at an air filter 406. The air filter, for example, can remove the humidity from the air provided by the RSS float 390. In some implementations, the air filter 406 can be replaced by the external air filter 185 (as shown in FIG. 20) within the air module 19 (as shown in FIG. 2).

Within the RSS float 390, an air inlet opening 400 provides fresh air to the air hose 392. A USPECM valve 398 controls access to the air inlet opening 400. The USPECM valve 398, one or more camera lenses 396, and any other desired peripherals (e.g., hydrophone, 3-axis digital compass, etc.) can be controlled by an RSS float electronics module 402. The RSS float electronics module 402 interfaces with a USPECM interface 403 (e.g., PoE, EoVDSL, GbE, etc.). The USPECM interface 403, for example, can be included within a conduit within the air hose 392 or alongside the air hose 392 to deliver USPECM communications to and from the RSS float 390.

Micro-Second Synchronized Power Ethernet Control & Monitoring (USPECM) System Design The USPECM system can be designed for autonomous, remote controlled, or manual operation of vehicles or vessels. The USPECM system includes intelligent sensors that can be controlled, monitored, and recorded. Simple commands can be used to navigate the vehicle, and all the communications can be Ethernet based. The power required by the USPECM devices, in some implementations, can utilize the Power over Ethernet standard 802.3af as much as possible. All of the USPECM electronic devices can be based on ASIC or FPGA design. The ASIC or FPGA design strategy can consume less than a tenth of the power compared to similar systems based on a personal computer or printed circuit board (PCB) hardware design.

The USPECM system can utilize the broadcasting feature of Ethernet/802.3, in some implementations, to synchronize all the USPECM devices at the micro-second level. Furthermore, by using only the third layer of the Open Systems Interconnection Reference Model (OSI) protocol stack throughout the system, the USPECM system can provide more direct and efficient device management while maintaining micro-second level synchronization. A unique USPECM router provides multiple command control stations. A central monitor router can provide multiple system monitor stations. The USPECM Ethernet MAC address assignment scheme can provide a simple method for implementing an FPGA-based organized monitoring system. Central control of the USPECM system, including the command control stations, central monitor router, and system monitor stations, can be included within the C3 module of the JUV (as illustrated in FIG. 21).

Figure 38:
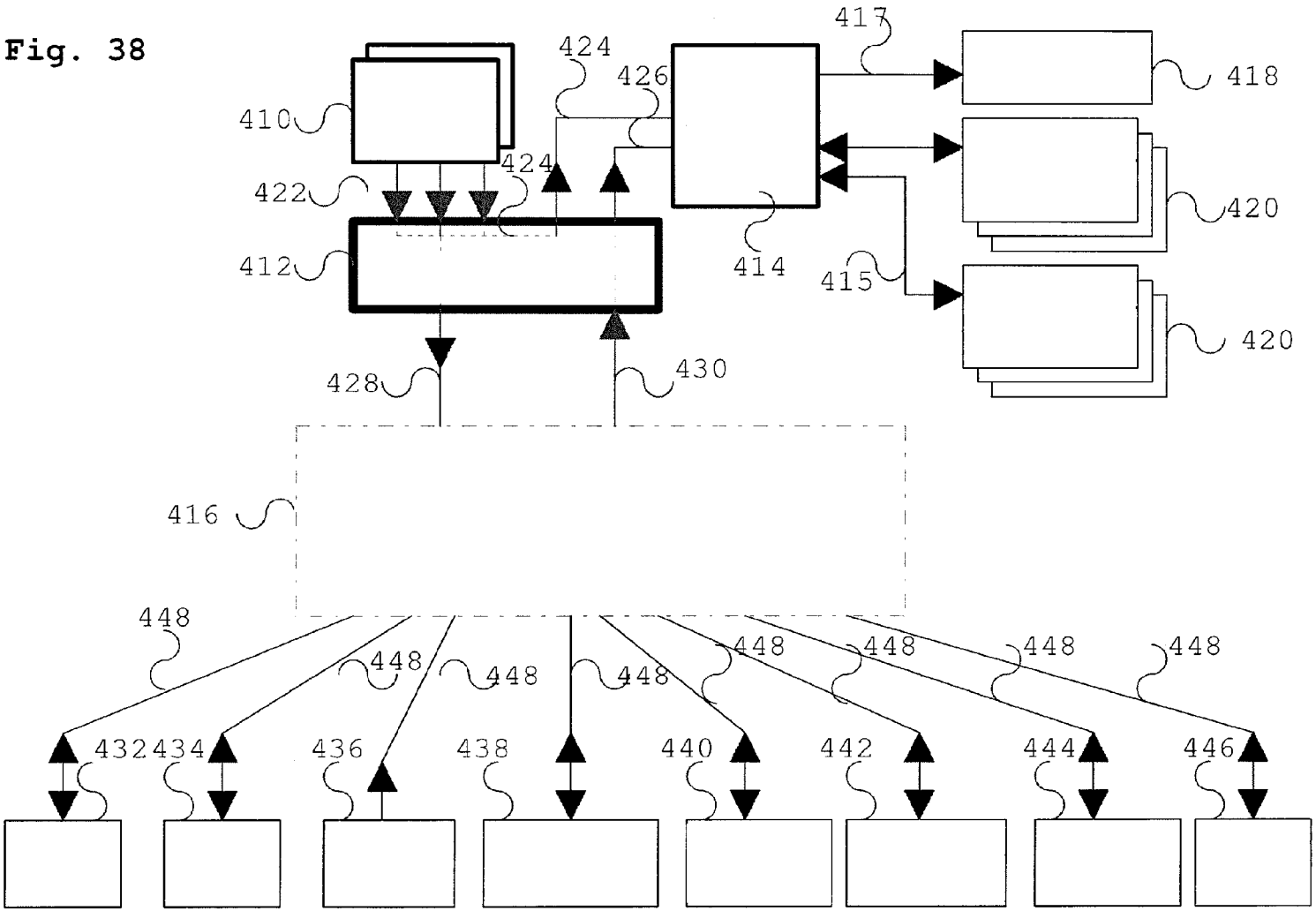
FIG. 38 is a logic diagram illustrating a micro-second synchronized power Ethernet control and monitoring system.

FIG. 38 is a logic diagram illustrating a micro-second synchronized power Ethernet control and monitoring system. The USPECM system is controlled by a distributed powered Ethernet switching system 416. The Ethernet switching system 416 includes a set of USPECM interfaces 448 to each device or subsystem. The devices which include USPECM interfaces 448, for example, can include a periscope device 432 (e.g., RWPS, FWP) and/or a snorkel device 434 (e.g., RSS). The subsystems which include USPECM interfaces 448 can include, for example, a sonar and external sensor subsystem 436, an actuators and sensors control subsystem 438, an engine sensor and control subsystem 440, a navigational control subsystem 442, a buoyancy control subsystem 444, and/or an other sensors subsystem 446 (e.g., weaponry status sensors, oxygen sensors, temperature sensors, etc.).

The collective data received from the devices and subsystems connected by the USPECM interfaces 448 can be routed to an Ethernet MAC router 412 along a collective data connection 430. The Ethernet MAC router 412 in turn routes the collective sensor and device data to a central monitor router 414 over a collective data connection 426. The central monitor router provides the collective data to a series of system monitoring stations 420 via one or more monitoring station connections 415. For example, the system monitoring stations 420 can provide a graphical user interface (GUI) alerting crew members to the conditions detected by the various sensors and devices. The central monitor router also provides the collective data to a black box 418 via a black box connection 417. The black box 418 maintains time-stamped records regarding the conditions detected by the USPECM system through the various sensors, actuators, and/or devices.

A series of central command/control stations 410 can be used to provide control inputs to the subsystems and devices connected to the Ethernet switching system 416. The central command/control stations 410 can include GUI stations within the JUV and/or wireless command control input stations located a remote distance from the JUV (e.g., within an aircraft carrier, on a nearby island, etc.). Commands issued at one or more of the central command/control stations 410 are routed through the Ethernet MAC router 412 over a command connection 422.

The Ethernet MAC router 412 can relay the commands to the Ethernet switching system 416 over a command connection 428. The Ethernet switching system can then relay each command to the appropriate device(s) and/or sensor(s). In addition, the Ethernet MAC router 412 can relay the commands to the central monitor router over a command connection 424. The central command router can provide the commands to the black box 418 for journal records and/or to the system monitoring stations 420.

Figure 39:
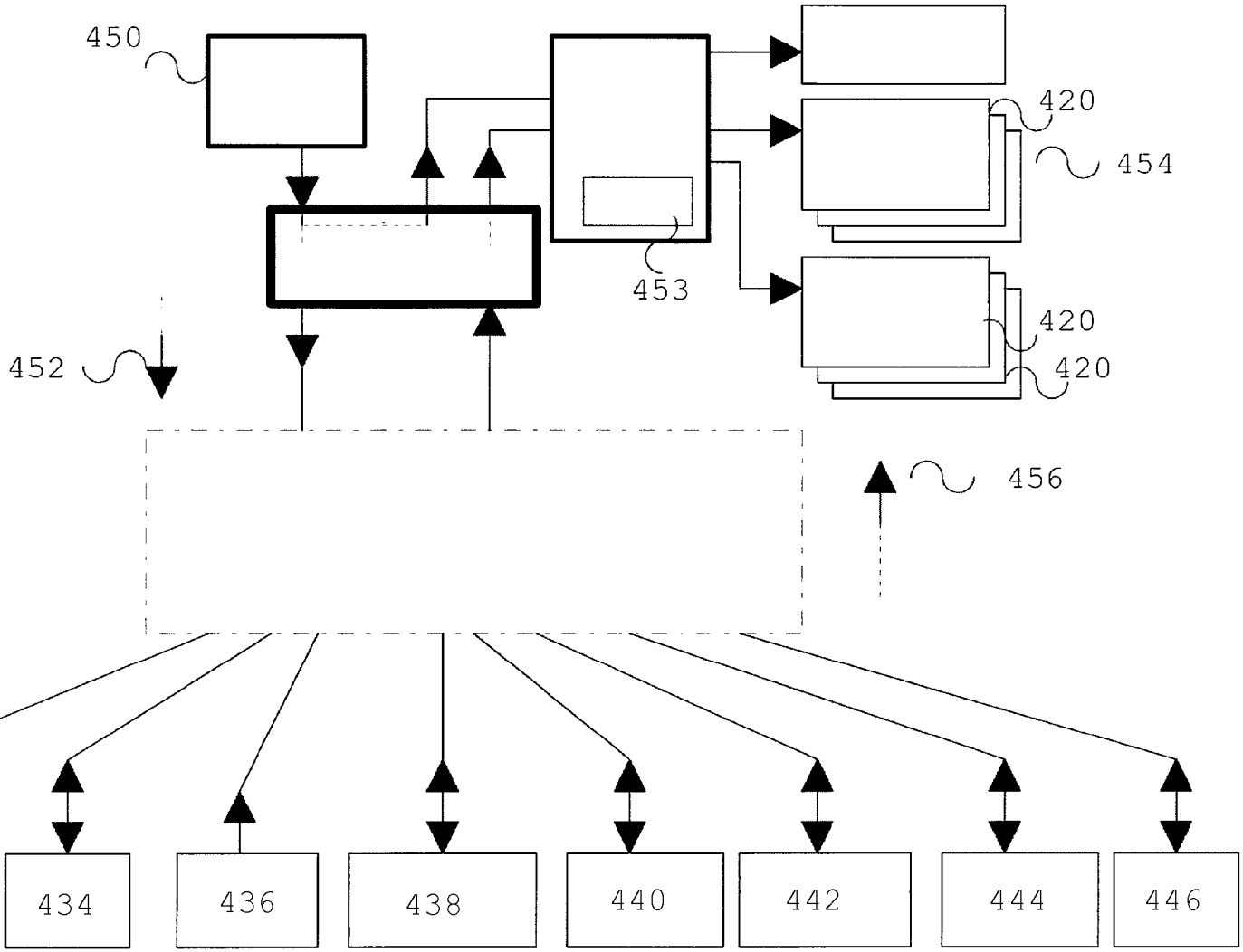
FIG. 39 is a block diagram illustrating an exemplary command and control data flow of micro-second synchronized power Ethernet control and monitoring system.

FIG. 39 is a block diagram illustrating an exemplary command and control data flow of micro-second synchronized power Ethernet control and monitoring system. The USPECM system receives a set of commands 450 from a human interface (e.g., within the JUV or via a remote connection) and/or through autonomous scripts. The resultant state achieved by the commands 450 can be viewed using a GUI 454 realized by the one or more system monitoring stations 420. The USPECM datagram, in some implementations, can be based on the Ethernet/802.3 communications protocol.

Most of the USPECM datagrams, for example, originate from the multiple intelligent sensor devices (e.g., oxygen sensors, temperature sensors, sonar and camera sensors, weaponry sensors, etc.). The quantity of intelligent sensor data 456 can be reduced when the sensor device is operating in a normal steady state. For example, during operation within a normal, expected operating range, each sensor can provide periodic compressed data updates with time-stamped sensor readings. When the status of a sensor changes or exceeds a threshold value, the sensor can provide immediate feedback to the USPECM system.

Central command and control data 452 can include unicast packets, broadcast packets, and router address learning packets. The unicast packets are targeted to a specific device or subsystem. In some examples, unicast packets can contain a command for opening or closing a specific valve or for navigating the steering of a rudder. Broadcast packets can be issued for maintaining microsecond synchronization of USPECM devices. In some implementations, broadcast packets can also be used to issue emergency codes to all or a subset of the USPECM devices and/or sensors. Router address learning packets learn the individual MAC addresses of the common off-the-shelf Ethernet switching system. In some implementations, the addresses learned by the command and control data 452 can be stored in a routing table 453 within the central monitor router 414.

Figure 40:
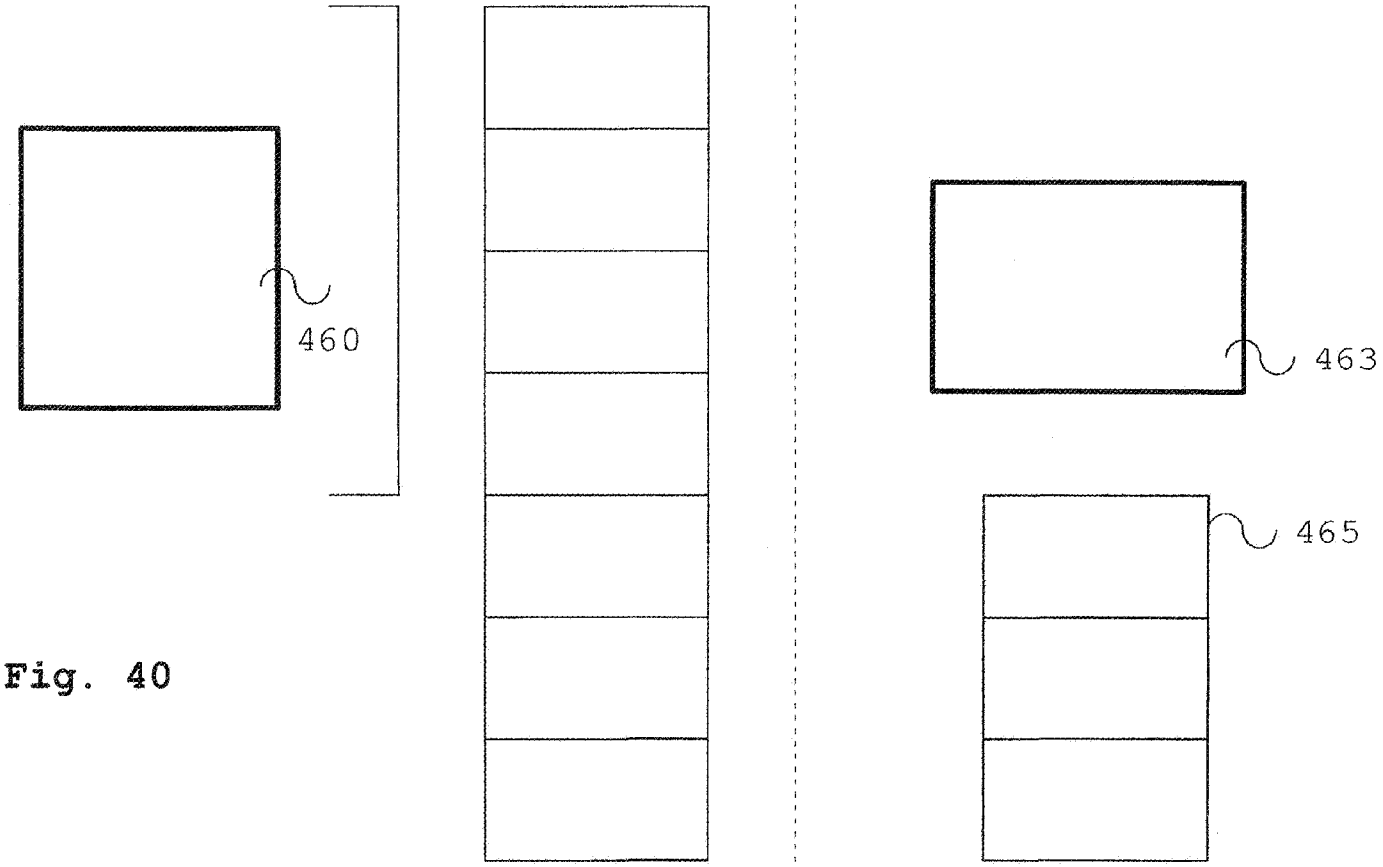
FIG. 40 is a block diagram illustrating a network protocol stack comparison between a TCP/IP network and a 3-layer media access control network.

FIG. 40 is a block diagram illustrating a network protocol stack comparison between a TCP/IP network and a 3-layer media access control network. The International Organization for Standardization (ISO) 7-layer networking topology is a widely used international standard. The best example of the ISO 7-layer network is the TCP/IP networking topology for running the Internet. The TCP/IP networking topology is used by common personal computer (PC) operating systems (OS) (e.g., Windows by Microsoft, Corp. of Redmond, Wash. or the open source Linux OS). One drawback of TCP/IP is that if there are many nodes in the network, it can be difficult to guarantee a real-time application. Involvement of multiple networking layers can require additional computation as well, making it more difficult to ensure that the packets arrived in time.

The network traffic pattern of the JUV differs from a typical TCP/IP network or Internet network. While a typical Internet traffic pattern has approximately a ten-to-one downloading to uploading ratio, most of the sensors within the JUV are operating at the client side and generate the majority of the system traffic as upload traffic to the servers or central control. Further, a limited number of commands are issued from central control to the clients (e.g., commands to open and close valves, release and withdraw a periscope or snorkel, etc.).

TCP/IP Address Resolution Protocol (ARP) can add more complication in managing the network. The ARP and RARP (Reversed Address Resolution Protocol) provide translation between an IP address 460 and an Ethernet MAC address. Within a typical TCP/IP network many broadcast and/or multicast packets are involved in address resolution and routing (e.g., ARP and RARP). The USPECM network, instead, can use an Ethernet MAC address 465 as the basis of the routing table, circumventing this level of complication. In some implementations, the USPECM network only allows the use of a broadcast address for servers, which can control the traffic and achieve the microsecond level synchronization.

A 7-layer implementation of the TCP/IP network is usually based on PC hardware and PC operating system software drivers, including PC OS peripheral drivers and PC hardware peripherals, which can consume a lot of power. In comparison, the USPECM network can be designed based on an ASIC/FPGA 463 as the hardware to implement a S-layer network and firmware in the ASIC/FPGA 463 to drive the user interface. In this manner, the power consumption of the USPECM network can be much lower than a typical PC-based TCP/IP network.

The graphical user interface in a TCP/IP network is usually displayed upon a PC screen (e.g., computer monitor) which is driven by a PC graphic card and standard PC OS software drivers. This can consume a lot of power. The USPECM network uses firmware in the ASIC/FPGA 463 to drive the GUI output to a monitoring screen. The use of the ASIC/FPGA 463 can save a lot power.

Figure 41:
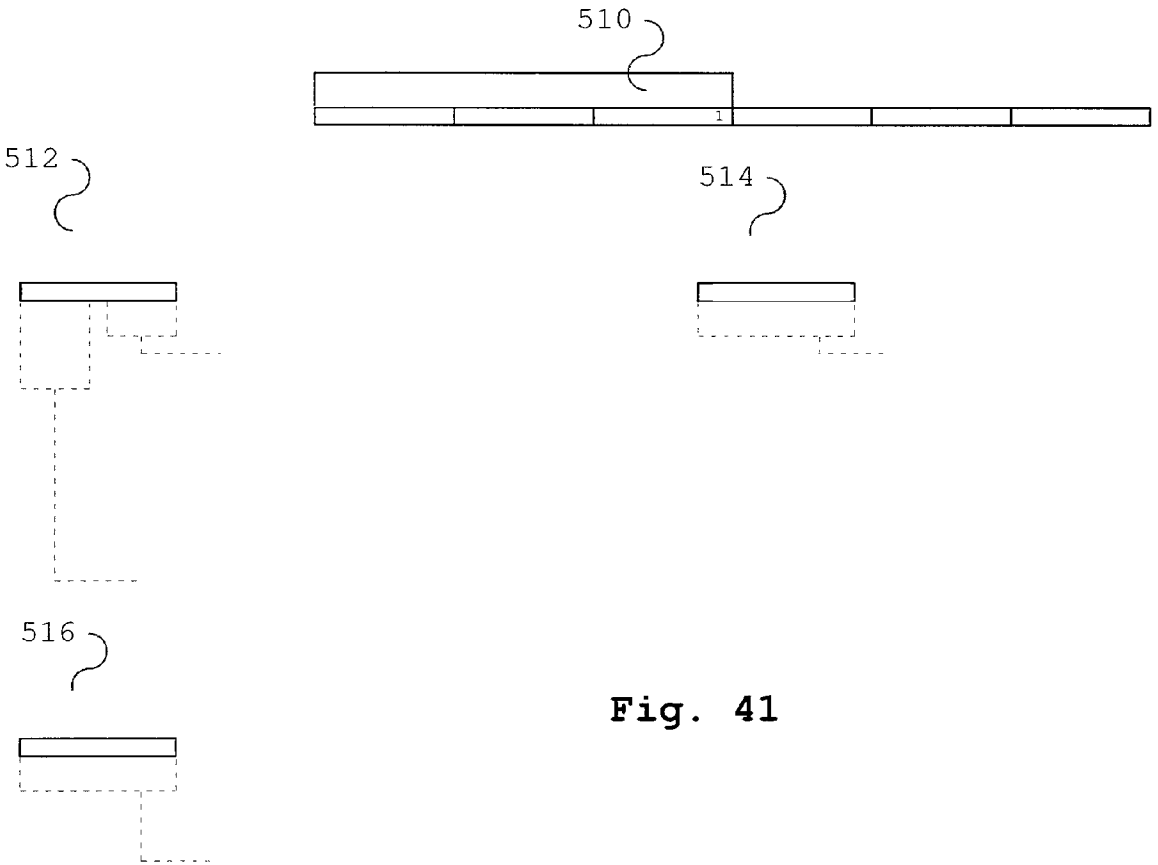
FIG. 41 is a block diagram illustrating an Ethernet MAC addressing scheme for a USPECM system.

FIG. 41 is a block diagram illustrating an Ethernet MAC addressing scheme for a USPECM system. The USPECM network utilizes the Ethernet MAC address to route the data packets to the proper destination. Additionally, the common off-the-shelf Ethernet switch (e.g., Ethernet switching system 416 as shown in FIG. 38) can learn and route the Ethernet packets according the source address and destination address. The network administrator allows no two addresses be the same, otherwise the whole network can become confused. To better organize the USPECM network for monitoring and recording, a MAC address scheme can be developed.

The basic topology of the USPECM network is based on a hierarchy with a central control at the top. Most of the traffic patterns can be based on the data provided by the multiple sensors. The sensor data is uploaded to the central control, especially when an abnormal situation is encountered. On the other hand, minimal traffic is typically encountered due to commands issued from the command and control center (e.g., central command/control stations 410 as shown in FIG. 38). For example, the data from video sensors can be large because there may be hundreds of video sensors. To better distribute the data from low layer sensors to the central control along the data collection and monitoring route (e.g., the black box 418 and the system monitoring stations 420 as shown in FIG. 38), a special MAC address scheme can be developed.

The traditional MAC address assignments are based upon serial number; the USPECM MAC address assignments can be based on device type. An Ethernet Mac address has 48-bits, or 6 bytes: the 3 most significant bytes (MSB) 510 are assigned to a company when registered, while the 3 least significant bytes (LSB) or 24 bits are used for serial number storage. Using this standard assignment, a company may utilize a maximum of $2^{24}$=16,777,216 different Mac addresses.

An exemplary USPECM MAC address assignment method is described as follows:

The third byte 512 of the three LSB of the USPECM MAC address can be used to represent a unique JUV fleet module number by assigning the upper 4 bits (e.g., bits 5 through 8) of the third byte 512 as the JUV fleet unit number and assigning the lower 4 bits of the third byte 512 (e.g., bits 1 through 4) with the JUV module type. In this manner, a total of fifteen JUV units can be deployed within an intercommunicating fleet, each JUV unit assembled using up to fifteen types of JUV modules (e.g., bow module=1, buoyancy module=2, weaponry module=3, air module=4, crew module=5, engine/fuel module=6, stern module=7, central control module=8, etc).

The second byte 514 of the three LSB can be used to represent the assignments for USPECM device types. Thus, a total of 255 USPECM device types (based on 8 bits, $2^8$) can be assigned (e.g., actuator device=1, valve and sensor device=2, RWPS device=3, RSHS device=4, engine control device=5, sensor device=6, sonar device=7, central control device=8, etc.).

The first byte 516 of the three LSB can be used to represent the assignments for device numbers for the same USPECM device type and can also be used, in some implementations, for the identification of the physical location of the device on the JUV.

Figure 42:
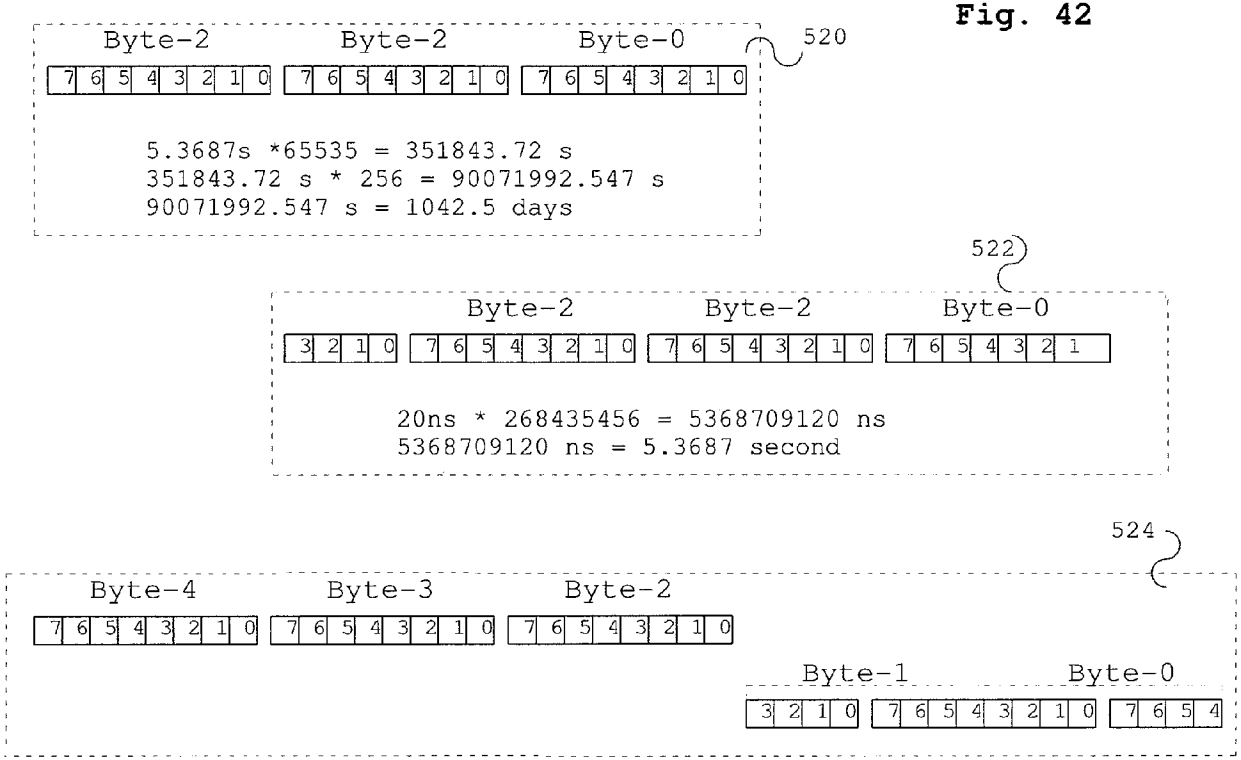
FIG. 42 is a block diagram illustrating a binary counter scheme for use in a USPECM system.

FIG. 42 is a block diagram illustrating a binary counter scheme for use in a USPECM system. One of the purposes of USPECM network is to synchronize all of the devices (e.g., sensors, subsystems, etc.) of the JUV at micro-second level. Most semiconductors and/or microprocessors have an internal clock based on a crystal oscillator. The frequency and phase of the crystal oscillator can drift due to temperature and age. The frequency stability deviation of crystal oscillators can be expressed in parts per million (PPM). For example, computers typically rely on crystal oscillators to provide the internal clock for the computing system. Even within the same part number (e.g., a 50 Mhz crystal oscillator provided by a certain company), there can be discrepancies among these parts.

For example, the USPECM system can use a 50 MHz crystal oscillator and a 52-bit binary counter for the real-time system clock. The 52-bit binary counter can include a 24-bit most significant binary counter (MSBC) 520 and a 28-bit least significant binary counter (LSBC) 522. At 50 Mhz (or 20 nanoseconds per clock cycle), the LSBC can count up to 20 ns$\times 2^{28}$=20 ns$\times$268435456=5.3687 seconds. Additionally, the MSBC can count the LSBC up to 1042.5 days, which can be enough for a mission for the JUV. In some implementations, more bits can be added to the MSBC to increase the maximum counter duration beyond 1042.5 days.

The USPECM system can use the LSBC within the central command system clock to synchronize the whole USPECM system every 5.3687 seconds. In some implementations, a synchronization command can be broadcast using the Ethernet Switching Layer. Due to the three-layer MAC network design (as described in FIG. 40), this time synchronization command should arrive at all devices at exactly the same time as long as no command is currently queued ahead of the synchronization command. Each USPECM device can, in turn, respond to the synchronization command by resetting the LSBC and updating the MSBC of the device to reflect the MSBC value contained within the synchronization command.

Further, the USPECM sensor/actuator devices can report their status with a USPECM time-stamping counter: a Time Stamp Binary Counter (TSBC) 524. The TSBC includes an upper 40-bit value based upon the USPECM 52-bit binary counter. The TSBC can be created by combining the 24-bit MSBC with the upper 16-bits of the LSBC. The TSBC can represent the real-time clock at a 100 μs level of precision because the greatest deviation of a crystal oscillator can be 20 ppm: 20 ns$\times$20 ppm$\times 2^8$=102400 ns=102.4 μs.

To reach a higher precision, in some implementations the USPECM system can be designed to use a higher frequency crystal oscillator (e.g., 100 MHz). In this manner, more frequent synchronization commands can be issued (e.g., every 1.2 second) which can in turn achieve a 12.8 μs level synchronization.

Figure 43:
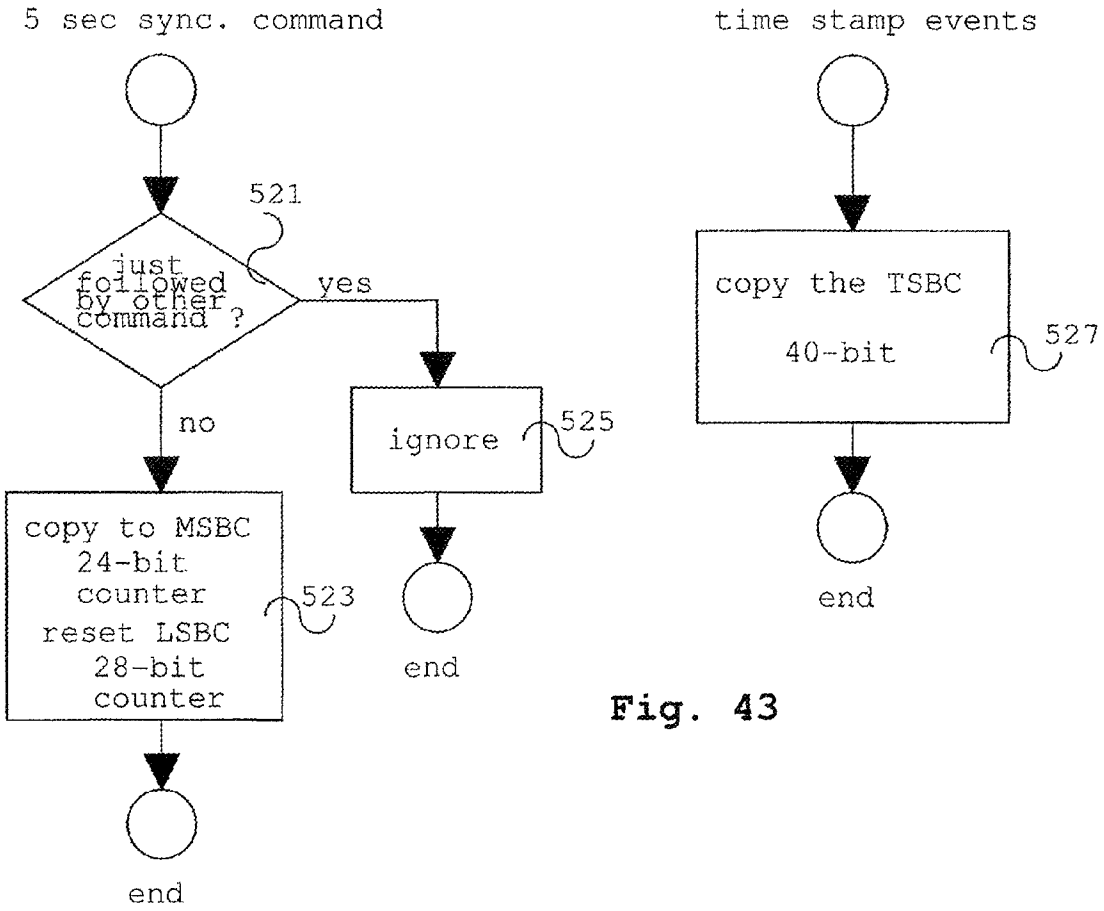
FIG. 43 is a set of flow diagrams illustrating a micro-second level synchronization algorithm for use in a USPECM system.

FIG. 43 is a set of flow diagrams illustrating a micro-second level synchronization algorithm for use in a USPECM system. A synchronization command is issued. In some implementations, the synchronization command can be issued each time the LSBC rolls over. For example, the USPECM command and control center can issue a synchronization command every 5.3687 seconds based upon a 50 MHz crystal oscillator clock signal.

If the receiving device receives a regular command just before the time synchronization command is issued, the USPECM network can discard this command (521). In some implementations, a determination of a command being issued immediately before a synchronization command may be differentiated by the minimum Ethernet packet gap of 96 bit time. For example, the USPECM network can discard the synchronization command rather than queuing the command to the device. If the synchronization command were instead placed within the queue for the device, the time synchronization command could cause the device to become inaccurate at a micro-second level.

Typically, no command other than the synchronization command is issued from the command and control center of the USPECM system. The synchronization command, in some implementations, can be broadcasted by the Ethernet switching system 416 (as shown in FIG. 38). The synchronization command, for example, should have the same latency in reaching each USPECM end device, assuming that the command underwent the same layers of Ethernet switching, because each layer of Ethernet switching requires the same latency. The synchronization command can typically be issued within a short Ethernet packet (e.g., 64 bytes long). In a 100Base-TX Ethernet transmission mode, for example, the synchronization command, embedded within a short Ethernet packet, would take about 5 μs to send.

However, if a device command arrives immediately before the broadcast synchronization command, the synchronization command can be pushed back in the queue by the Ethernet switching system 416 on the affected channel/path to the affected USPECM device. Thus, this can affect the precision of the synchronization command by about 5 μs. As a result, this pushed-back synchronization command should instead be discarded (525). The device can become re-synchronized with the next synchronization command cycle.

Once the device has received a synchronization command, the device copies the MSBC stored within the synchronization command to the MSBC 24-bit counter of the device (523). The device also resets the LSBC counter. When the device sends data to the command and control center, the device first copies the 40-bit TSBC of the device clock into the data packet as a time stamp (527). Using a 50 MHz crystal oscillator as the system clock, the time stamp stored within the data packet should be precise to within 100 μs of the command and control center clock.

Figure 44:
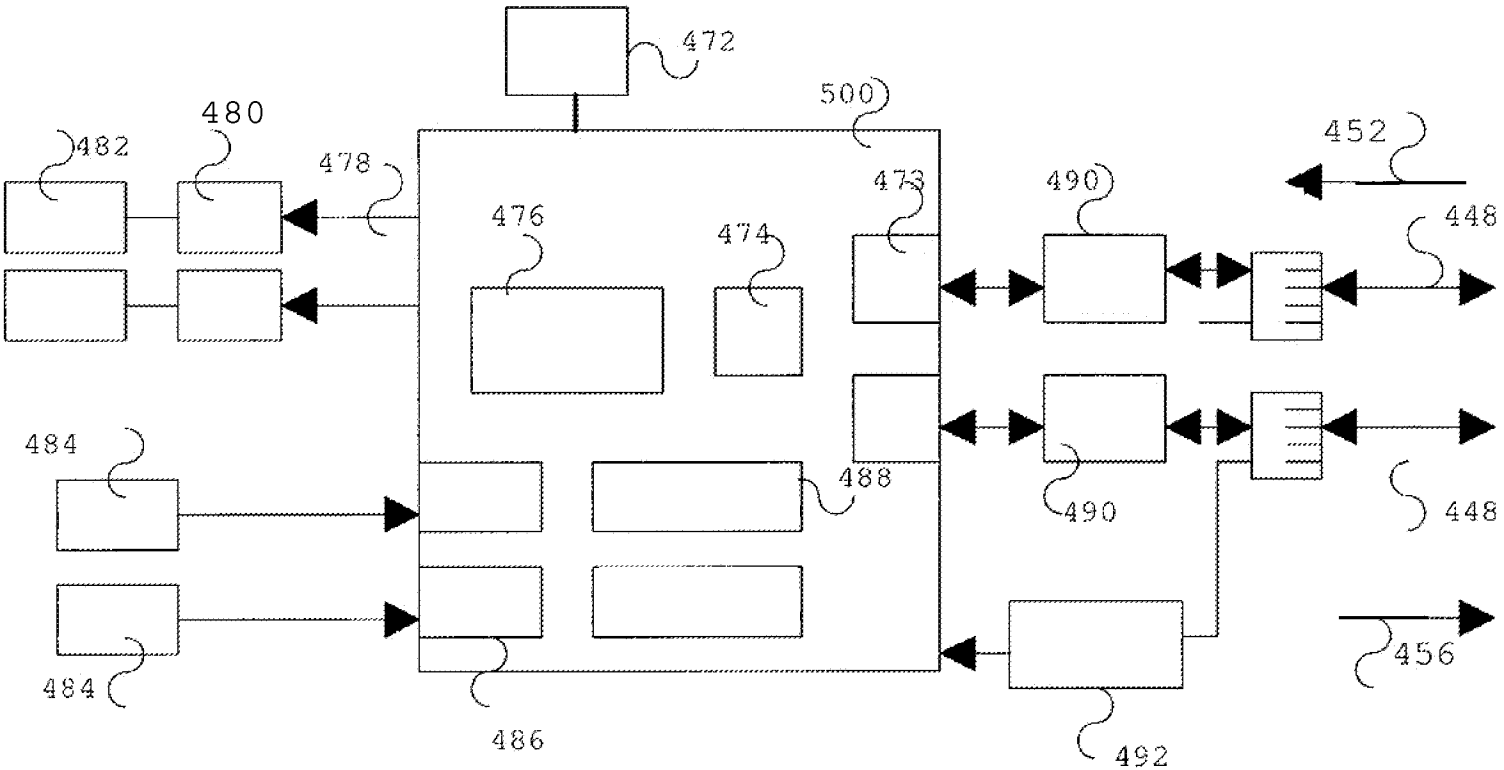
FIG. 44 is a hardware diagram illustrating an exemplary sensor controller design for use in a USPECM system.

FIG. 44 is a hardware diagram illustrating an exemplary sensor controller design for use in a USPECM system. A generic USPECM sensor controller includes an FPGA/ASIC 500 which controls with one or more device-specific sensors 484 (e.g., a CCD/CMOS image sensor for use with an imaging device) and/or driver circuits 480 which drive one or more controllers 482 (e.g., a MOSFET driver circuit 480 for driving a motor control 482).

The FPGA/ASIC 500 includes a CPU 474, a 52-bit binary real-time clock (RTC) 476, and an external storage medium 472 (e.g., dynamic random access memory (DRAM), video DRAM (VRAM), static random access memory (SRAM), etc.) for large temporary storage. One or more data compression algorithms 488 can be used to reduce the device status data (e.g., stored within the external storage medium 472) into a compressed transmission to send periodically to the USPECM command center when the device is in a static state or normal mode functional state. The data compression algorithm(s) 488 can also be used to send larger quantities of data to the USPECM command center when the device is in a dynamic state or an abnormal state.

The FPGA/ASIC 500, in some implementations, can use a double Ethernet MAC interface 473 for redundant interfacing with the USPECM central control. Each Ethernet MAC interface 473 communicates over an Ethernet physical layer (PHY) 490 translator through a USPECM interface connector 448 (e.g., RJ-45 connector). The FPGA/ASIC 500 is powered by a power supply 492. The power supply 492, for example, can derive power from the USPECM interface (e.g., PoE, etc.).

A command data packet stream 452 is received by the device controller from the USPECM central control. The command data packet stream 452 can include commands for the controller(s) 482 and broadcast synchronization commands. If a controller command is received within the command data packet stream 452, the FPGA/ASIC 500 can send the command across a digital driver control line 478 (e.g., pulse width modulation (PWM) control line for controlling a stepper motor) to the appropriate driver circuit 480.

Each sensor 484 can collect sensor information and transmit the information to an associated digital signal processor 486 (e.g., digital filter, fast Fourier transform (FFT), JPEG, MPEG, etc.). The sensor information can be aggregated within the DRAM 472 and compressed by the appropriate data compression algorithms 488. The sensor information can then be packetized and transmitted to the USPECM control center within a sensor data packet stream 456. When the sensors 484 are transmitting data while in a standby or normal mode of operation, the sensors can aggregate information to be periodically transmitted to the USPECM control center. For example, the sensors 484 can store collected data within the DRAM 472, compress the information using one or more of the data compression algorithms 488, then bulk transmit the data within the sensor data packet stream 456. When the sensors 484 are transmitting data regarding a change in status or a status outside of a normal operating state, the sensors 484 can immediately transmit compressed or uncompressed data to the USPECM control center through the sensor data packet stream 456. The packets within the sensor data packet stream 456 can be time-stamped using the TSCB time stamping method as described in FIG. 42.

Figure 45:
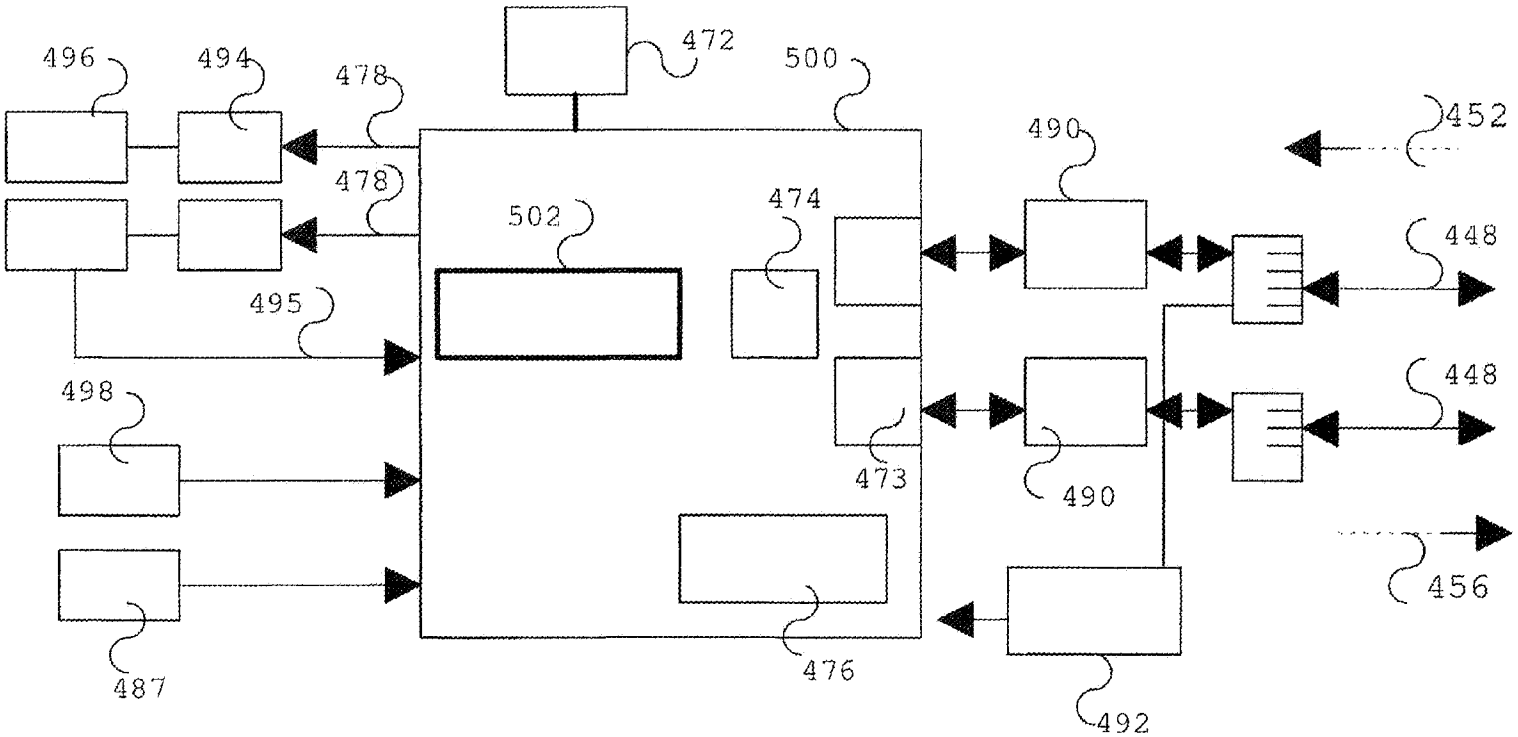
FIG. 45 is a hardware diagram illustrating an exemplary actuator and valve controller design for use in a USPECM system.

FIG. 45 is a hardware diagram illustrating an exemplary actuator and valve controller design for use in a USPECM system. As with the sensor controller described in FIG. 44, the actuator and valve controller includes the generic controller design of the FPGA/ASIC 500, the CPU 474, the redundant Ethernet MAC interfaces 473, the 52-bit binary RTC 476, the DRAM 472, one or more digital driver control lines 478, and the data reduction algorithm 502.

The driver circuits 480 of FIG. 44 are replaced with a set of MOSFET driver circuits 494 for controlling one or more stepper motors 496. The stepper motors 496 take the place of the generic controllers 482 (as shown in FIG. 44). One or more of the stepper motors 496, in some implementations, can include a stepper motor response path 495 for relaying status information back to the FPGA/ASIC 500 regarding the functionality of the stepper motor(s) 496.

The sensors 484 of FIG. 44 are replaced with a position sensor 498 and a pressure sensor 487. In some implementations, additional sensor types can include, but are not limited to, temperature sensors, oxygen and/or carbon monoxide sensors, water pressure sensors, water level sensors, battery management sensors, and/or engine status sensors. The USPECM interface of the actuator and valve controller includes the generic elements as described in FIG. 44, such as the Ethernet PHY layer 490, the power supply 492, the USPECM interface connector 448, the command data packet stream 452, and the sensor data packet stream 456.

Figure 46:
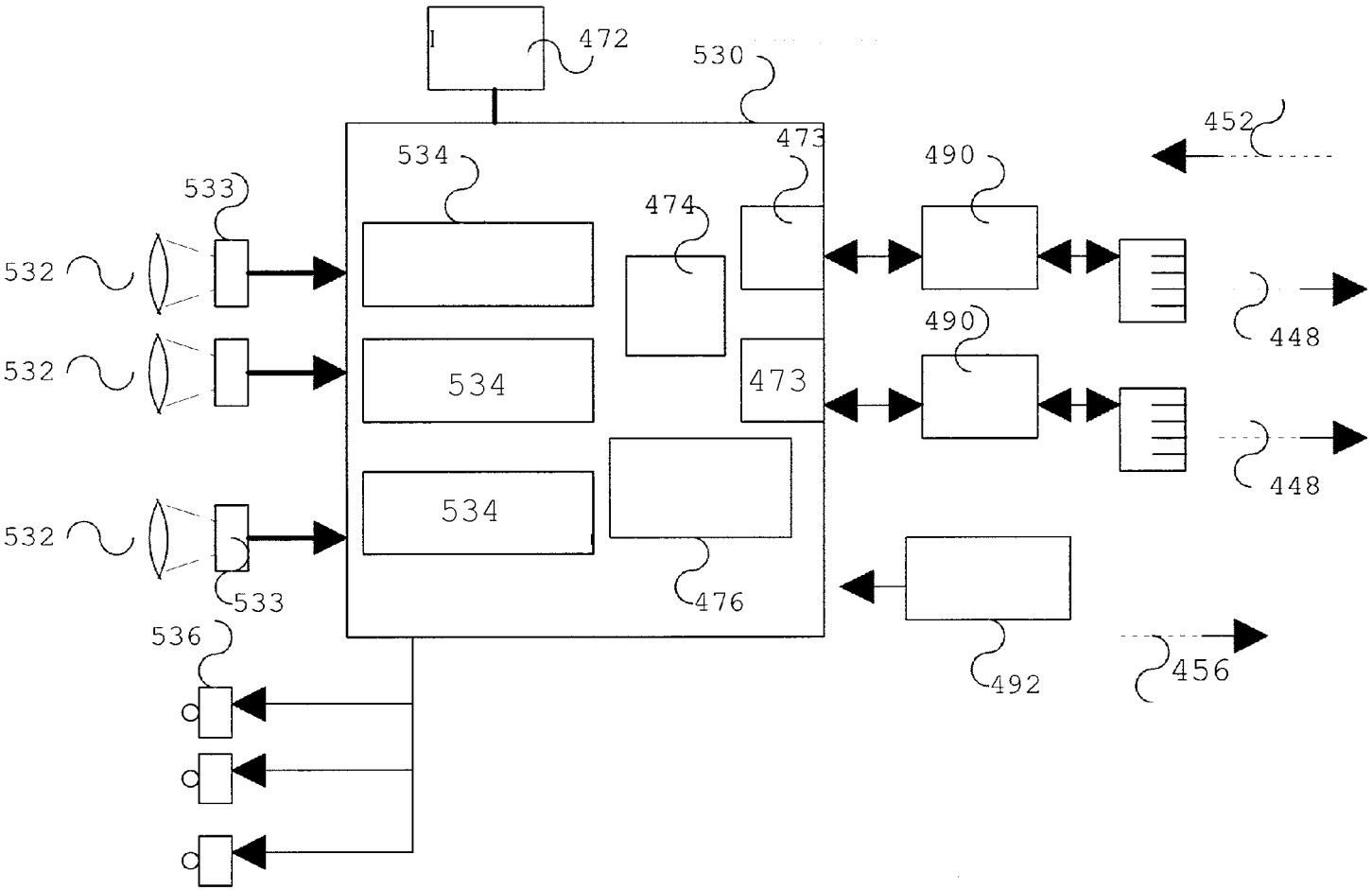
FIG. 46 is a hardware diagram illustrating a multiple-lens surveillance camera controller design for use in a USPECM system.

FIG. 46 is a hardware diagram illustrating a multiple-lens surveillance camera controller design for use in a USPECM system. As with the sensor controller described in FIG. 44, the USPECM multiple-lens surveillance camera controller includes the generic controller design of an FPGA/ASIC 530, the CPU 474, the redundant Ethernet MAC interfaces 473, the 52-bit binary RTC 476, and the DRAM 472.

A set of multiple lens cameras 532 with CCD and/or CMOS image sensors 533 feed information to a set of MPEG/JPEG compression algorithms 534. In some implementations, one or more flash light emitting diodes (LEDs) 536 can be used to increase the sensitivity of the CCD/CMOS image sensors 533. The USPECM interface of the actuator and valve controller includes the generic elements as described in FIG. 44, such as the Ethernet PHY layer 490, the power supply 492, the USPECM interface connector 448, the command data packet stream 452 and the sensor data packet stream 456.

Figure 47:
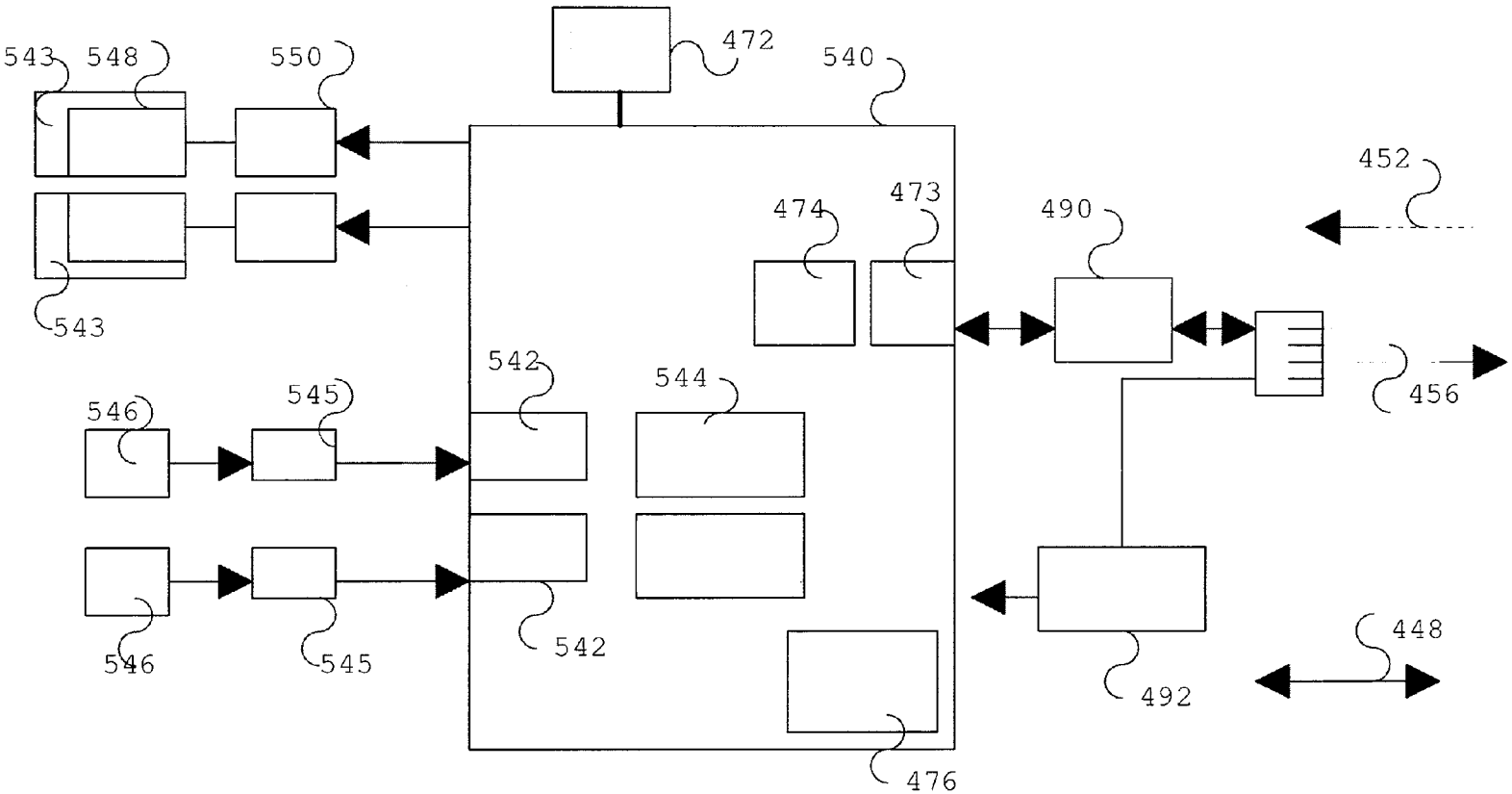
FIG. 47 is a hardware diagram illustrating an active or passive sonar controller design for use in a USPECM system.

FIG. 47 is a hardware diagram illustrating an active or passive sonar controller design for use in a USPECM system. As with the sensor controller described in FIG. 44, the USPECM active or passive sonar controller includes the generic controller design of an FPGA/ASIC 540, the CPU 474, one Ethernet MAC interface 473, the 52-bit binary RTC 476, and the DRAM 472.

Within the active or passive sonar controller design, the FPGA/ASIC 540 additionally includes a sonar pulse generator 543. One or more Field Effect Transistors (FETs) 550 are used to drive the sonar pulse to one or more projectors 548. The projectors 548, for example, can be manufactured using piezoelectric composite materials (e.g., lead zirconate titanate, barium titanate, etc.).

The passive sonar functionality of the controller can be realized by one or more hydrophones 546. The hydrophone readings can be input to the FPGA/ASIC 540 through one or more analog to digital converters (ADC) 545. The signal(s) are then received by one or more digital signal processors 542. The DSP 542 can include a digital filter to analyze the received signal. The DSP 542 can raise significant events by time-stamping and forwarding acoustic and/or sonar responses. The time-stamped events can be forwarded to the USPECM control center.

One or more data reduction algorithms 544 (e.g., specific to sonar array processing) can optionally be used to compress event data. The compressed data can be forwarded to the USPECM control center. The USPECM interface of the active or passive sonar controller includes the generic elements as described in FIG. 44, such as the Ethernet PHY layer 490, the power supply 492, the USPECM interface connector 448, the command data packet stream 452, and the sensor data packet stream 456.

Figure 48:
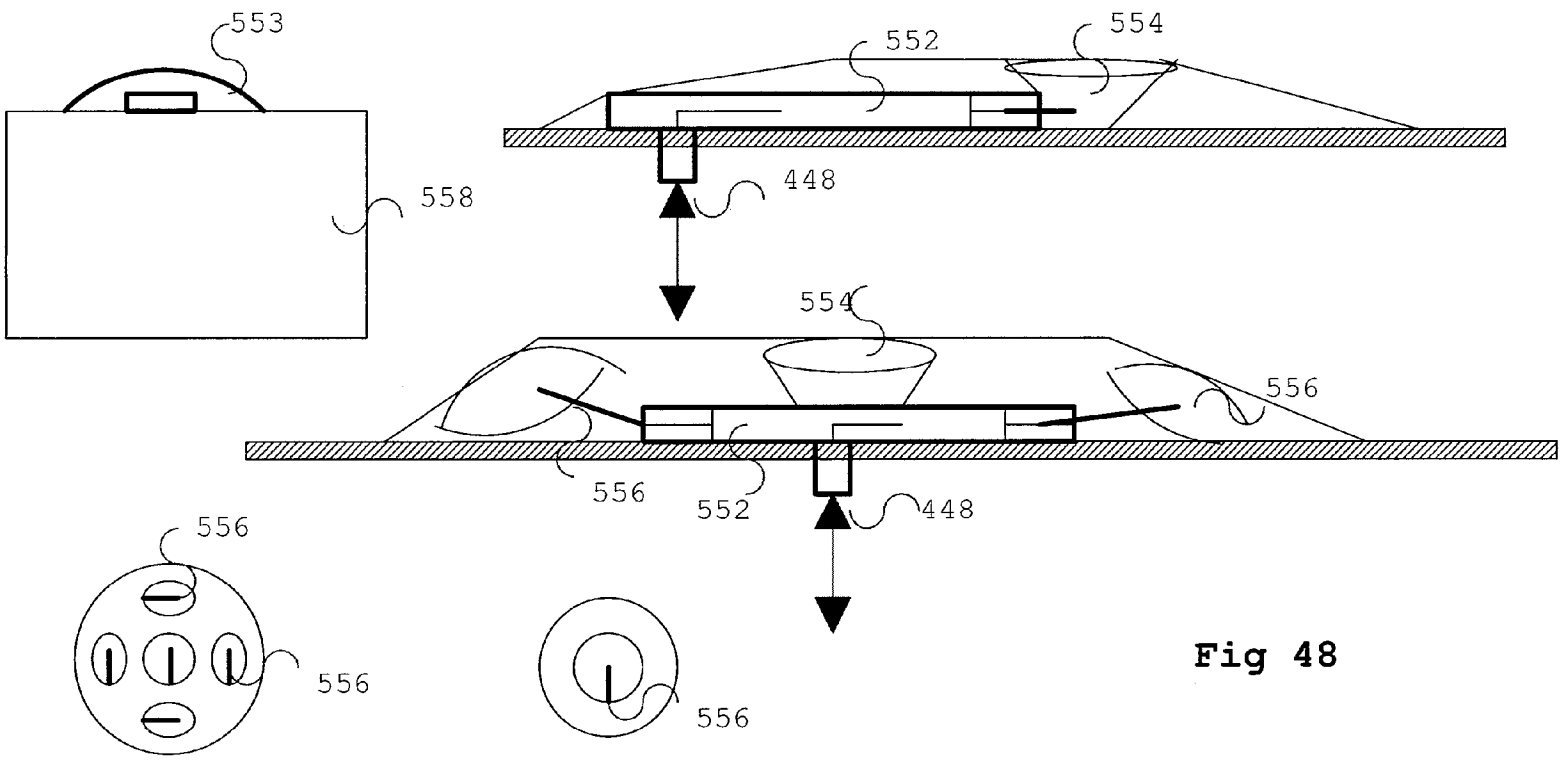
FIG. 48 is a block diagram illustrating a multiple sonar design for use in a USPECM system.

FIG. 48 is a block diagram illustrating a multiple sonar design for use in a USPECM system. Traditional sonar implementations can require high power to drive the sonic/ultrasonic waves through long distances in the water. The USPECM system, on the other hand, transmits a low power ultrasonic signal similar to the strength and range of the ultrasound of a dolphin. For example, less than 1 Watt of power is required to drive the USPECM sonar device compared to a traditional military sonar device which typically requires greater than 100 Watts. The sonar devices within the JUV hull can use a few watts to 100 watts depending upon the range of the target object (e.g., up to a few hundred yards). In some implementations, the JUV can be configured with a standard high power active sonar system (e.g., incorporating a USPECM interface and a stronger power supply).

The JUV can include a USPECM passive sonar array 553 attached to a JUV module 558 (e.g., the JUV bow 23 as illustrated in FIG. 2). A cone shaped collector 554 can be designed to collect the sonic/ultrasonic wave into a piezoelectric pressure sensor 556. The USPECM passive sonar array 553 can include any number of cone-shaped collectors 554 containing piezoelectric pressure sensors 556. In some implementations, redundant piezoelectric pressure sensors 556 can be used with each cone-shaped collector 554. An electronics module 552 contains the USPECM sonar electronic components (e.g., active or passive sonar controller as described in FIG. 47). The electronics module 552 communicates with the USPECM control center through the USPECM interface 448. All of the electronics components of the multiple sonar design can withstand underwater operation.

Figure 49:
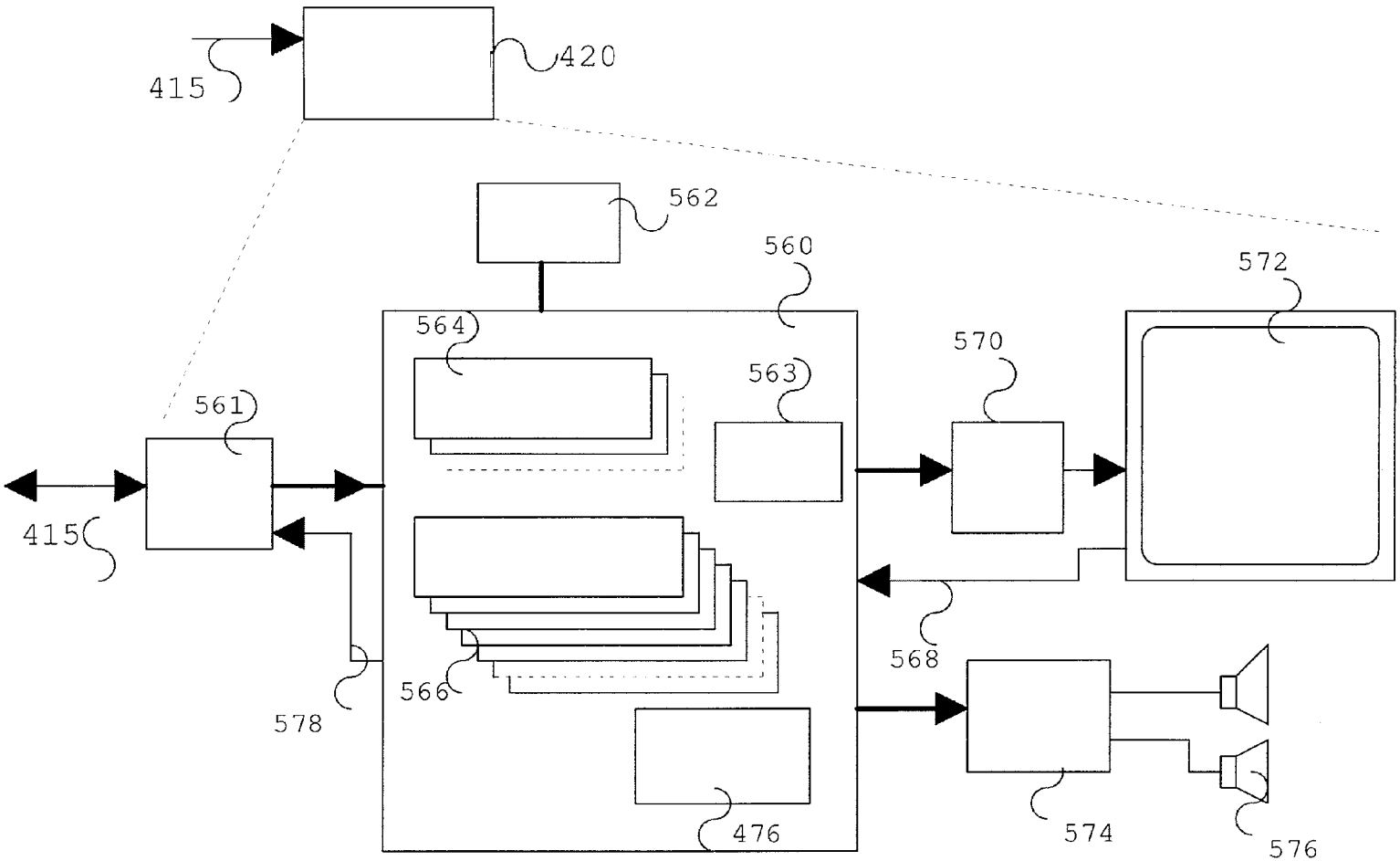
FIG. 49 is an architectural diagram illustrating a programmable system monitoring station design for use in a USPECM system.

FIG. 49 is an architectural diagram illustrating a programmable system monitoring station design for use in a USPECM system. The USPECM monitoring station 420 can use a common off-the-shelf display device 572 (e.g., a high resolution LCD screen such as a 1600×1200 pixel Ultra eXtended Graphics Array (UXGA) monitor) to display as much information as possible related to one or more USPECM subsystems and/or devices. For example, a 1600×1200 pixel display screen can display about twelve Common Intermediate Format (CIF) (e.g., 352×288 pixels) picture frames or video channels. This display method, for example, would be similar to a multiple channel surveillance camera display within a single screen.

The monitoring station connection 415 (as described in FIG. 38) provides information from the USPECM command center to the monitoring station 420. Information from the USPECM command center is introduced to an FPGA/ASIC 560 through an Ethernet GMII PHY layer 561. The FPGA/ASIC 560 includes a CPU 563 and the micro-second RTC 476. The FPGA/ASIC 560 can use one or more sensor data decoding and restoration modules 564 to determine the type information forwarded by a particular sensor and to extract data from the sensor transmission. In some implementations, the decoding and restoration modules 564 can make use of one or more decompression algorithms 566 (e.g., JPEG, MPEG, etc.) to decompress any compressed data transmissions from the sensor(s). During processing, the decoding and restoration modules 564 and/or the decompression algorithms 566 can temporarily store sensor data within a high speed digital storage medium 562 (e.g., graphic DRAM).

The decoding and restoration modules 564 can then format the sensor data for viewing within the display device 572. Formatted data can be supplied to the display device 572, for example, through a digital video interface (DVI) transmitter 570. In some implementations, the crew can interact with the monitoring station 420. For example, using a touch panel 568 or other peripheral device (e.g., mouse, joystick, keyboard, keypad, etc.), a crew member can request additional and/or different data display from the monitoring station 420.

In addition to visual information, in some implementations, the monitoring station 420 can supply audio signals to the crew. A voice synthesizer 574 attached to the FPGA/ASIC 560 receives audio signals related to the sensor data. The voice synthesizer 574 outputs the audio signals using one or more speakers 576. For example, sonar "pings" can be audibly output by the monitoring station 420 using the voice synthesizer 574 and the speaker(s) 576.

Figure 50:
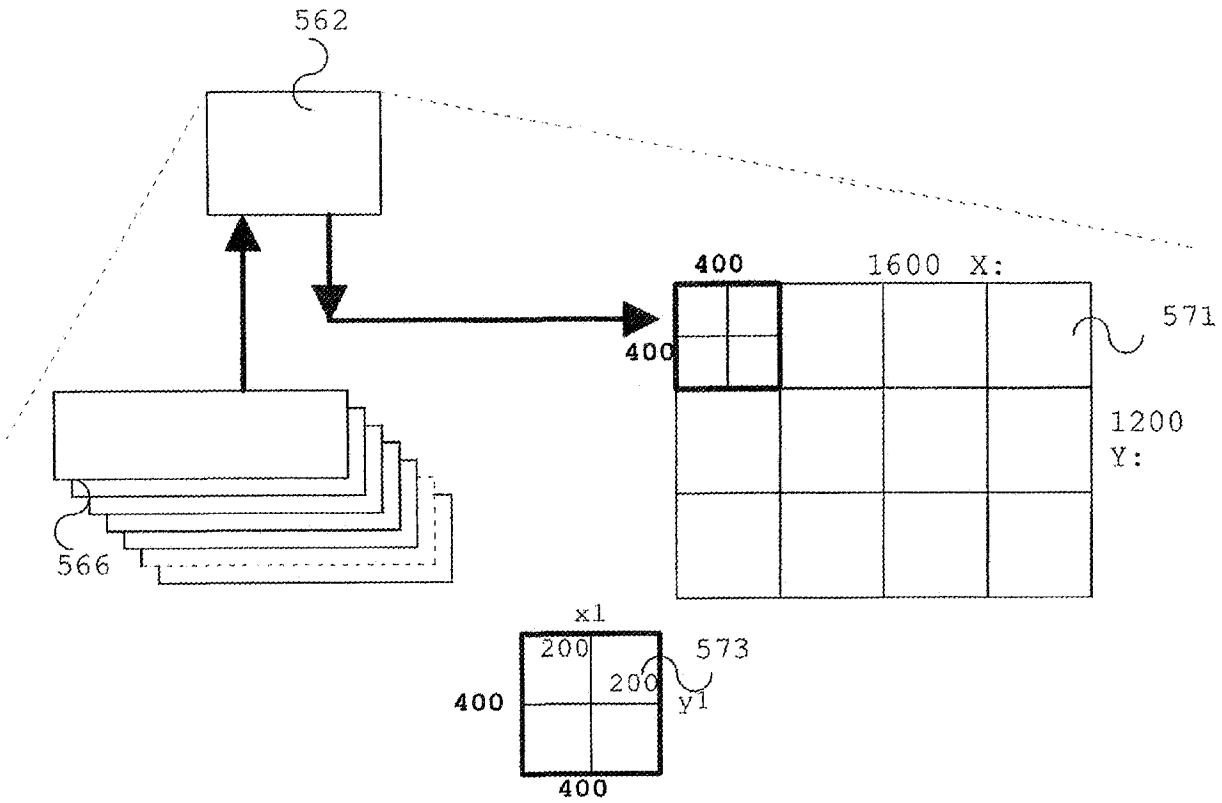
FIG. 50 is a block diagram illustrating an exemplary display strategy for the programmable system monitoring station of FIG. 49.

FIG. 50 is a block diagram illustrating an exemplary display strategy for the programmable system monitoring station 420 of FIG. 49. One design goal for the USPECM system monitoring station can be to display as much information as possible regarding the real-time status of multiple USPECM devices (e.g., sensors or controllers) at a flexible location within a common off-the-shelf display device. The display device, for example, can be driven by a single FPGA/ASIC (e.g., FPGA/ASIC 560 as shown in FIG. 49) and the corresponding high speed storage medium 562.

As shown in FIG. 50, A UXGA DVI monitor has a 1600×1200 pixel display area. The display area can be divided into twelve large display block sections 571 (e.g., 400×400 pixels), with four horizontal sections 571 by three vertical sections 571. Each large display block section 571 can be further divide into four small display block sections 573 (e.g., 200×200 pixels), with two vertical sections 573 and two horizontal sections 573. In this manner, the UXGA monitor can be divided into a maximum of 48 individual small display block sections 573.

In other words, the USPECM system monitoring station can use a single UXGA DVI monitor as a 48 channel surveillance display, each channel selected from potentially thousands of USPECM devices via a single USPECM interface (e.g., 1 GbE, 10 GbE communications channel). In some implementations, the 48 channels of USPECM monitored devices can be arranged from any location at any time. For example, a block of channels can be devoted to sonar monitoring, weaponry monitoring, engine monitoring, or any other subsystem installed within the JUV.

The display criteria for the up to 48 channels of system monitoring can be sent to the USPECM display system designating the display channel position (e.g., position of the large block section 571 and/or the small block section 573), the source Ethernet MAC address of the monitored USPECM device to be displayed within the designated channel position, and the USPECM device type being displayed (e.g., water pressure sensor, sonar sensor, temperature sensor, etc.). In some implementations, the FPGA/ASIC 560 contains 48 separate decompression algorithms 566 physically programmed into the FPGA/ASIC 560 firmware, each decompression algorithm 566 dedicated to a separate small block section 573. In a conventional PC configuration, one PC or motherboard would be used to decode a single channel of video input. Replacing up to 48 PC units with a single FPGA/ASIC saves a significant amount of power.

Figure 51:
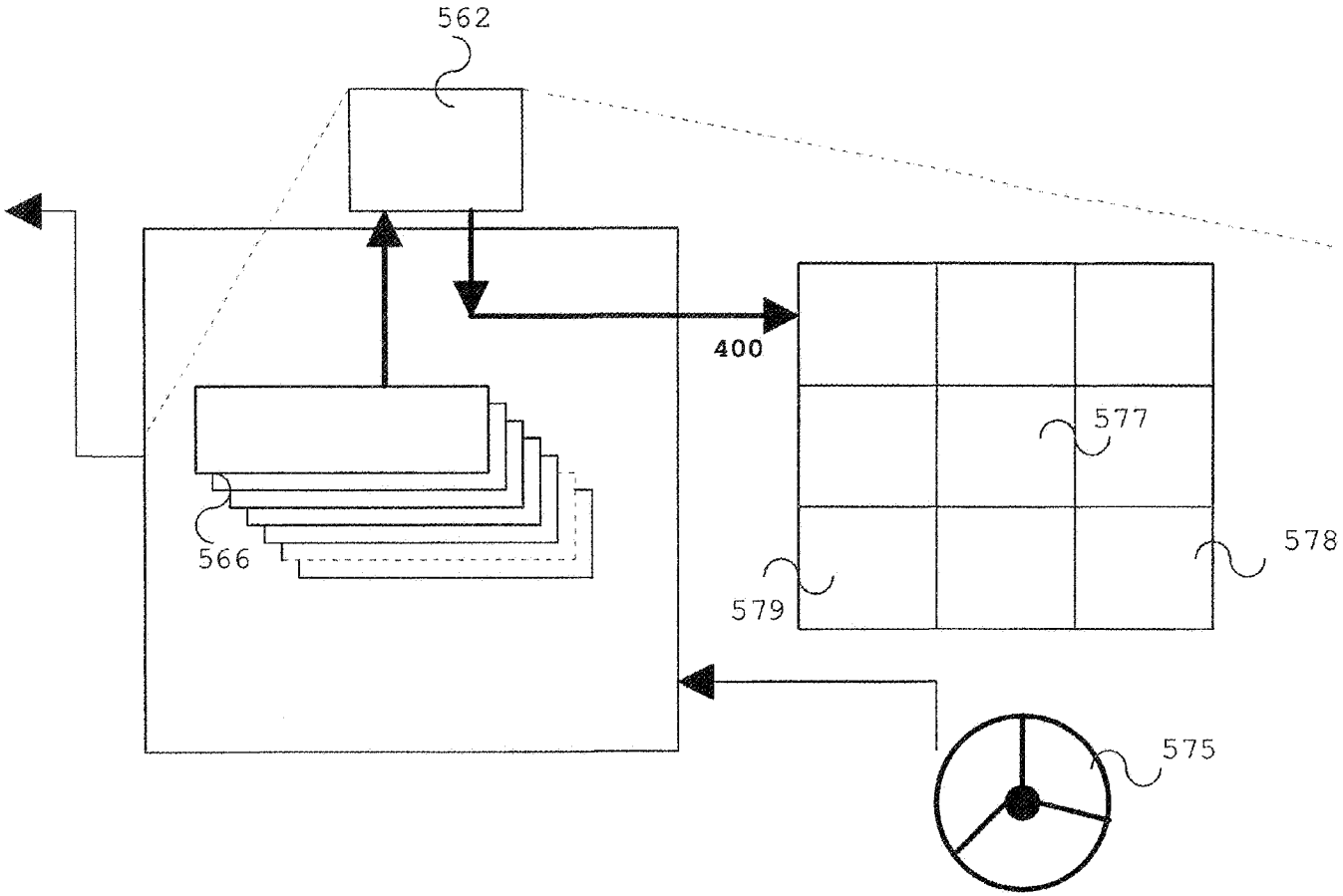
FIG. 51 is a block diagram illustrating an exemplary display strategy for the navigation station of a USPECM system.

FIG. 51 is a block diagram illustrating an exemplary display strategy for the navigation station of a USPECM system. A USPECM monitoring station (e.g., monitoring station 420 as described in FIG. 49) can be configured to be a navigation console containing information pertaining to navigation-related USPECM sensors. For example, the display area of the navigation console can include, but is not limited to, a digital compass display section 577, an engine status display section 579, and/or a depth reading display section 578, etc.

The crew members can use an input device 575 (e.g., a universal serial bus (USB) steering wheel or USB flying machine joy stick) at the navigation station to control the navigation of the JUV. In some implementations, the input device 575 can be connected directly to the FPGA/ASIC monitor (e.g., display device 572 as illustrated in FIG. 49) to issue steering commands to the navigation control subsystem.

Figure 52:
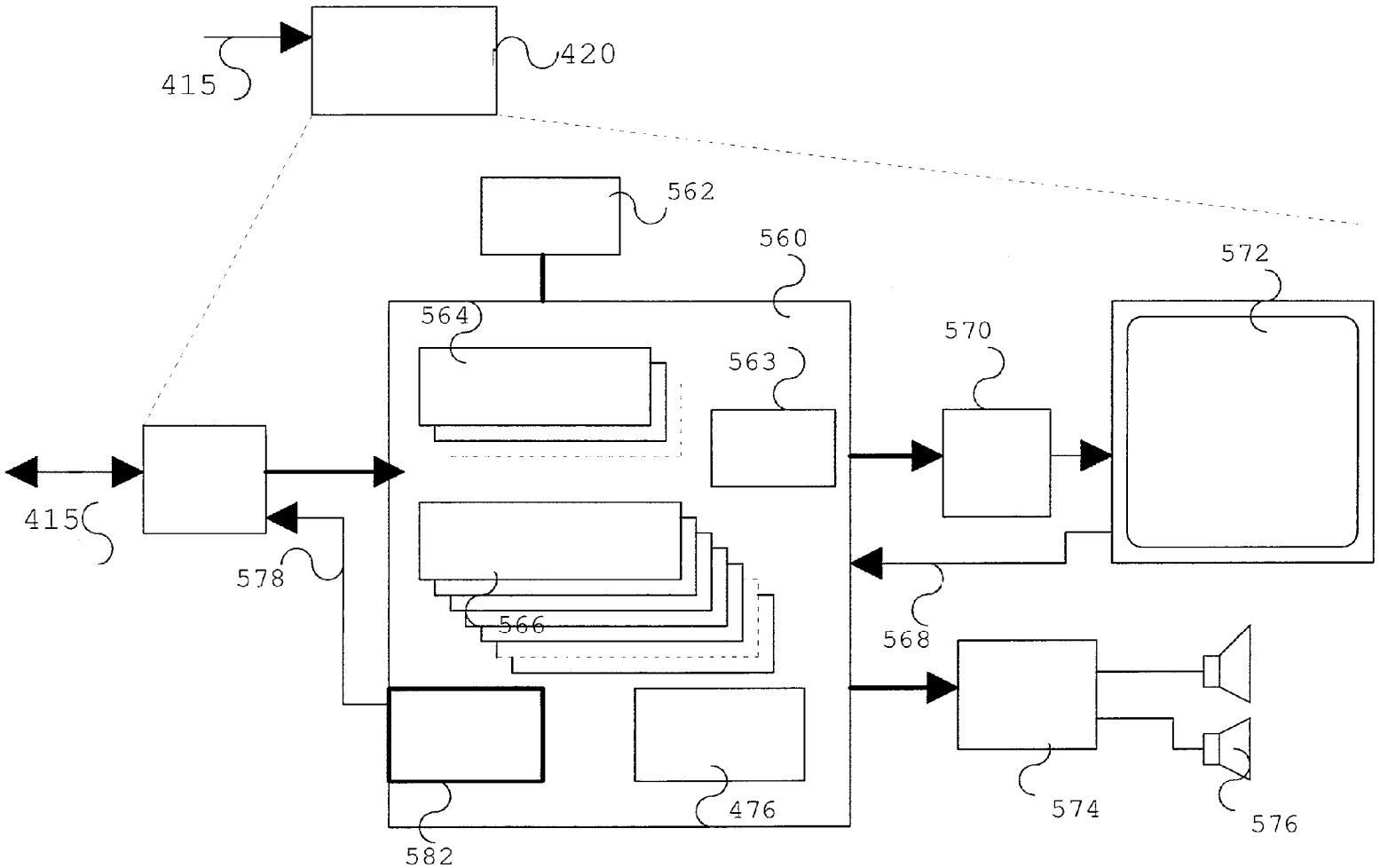
FIG. 52 is an architectural diagram illustrating a command control station for use in a USPECM system.

FIG. 52 is an architectural diagram illustrating a command control station for use in a USPECM system. The configuration of the USPECM command and control station is similar to the monitoring station described in FIG. 49, including the FPGA/ASIC 560 in communication with the display device 572 and the voice synthesizer 574. Unlike the monitoring station in FIG. 49, however, the command and control station of FIG. 52 includes a central command interpreter 582 which interprets commands input by crew members using one or more peripheral input devices (e.g., keyboard, mouse, joystick, etc.). The command interpreter sends the input command to the target device. In some implementations, a portion of the display device 572 can be dedicated to selecting which USPECM device is being targeted with a command. For example, a touch panel input can be used to select a valve control or autonomous cap control for opening.

Figure 53:
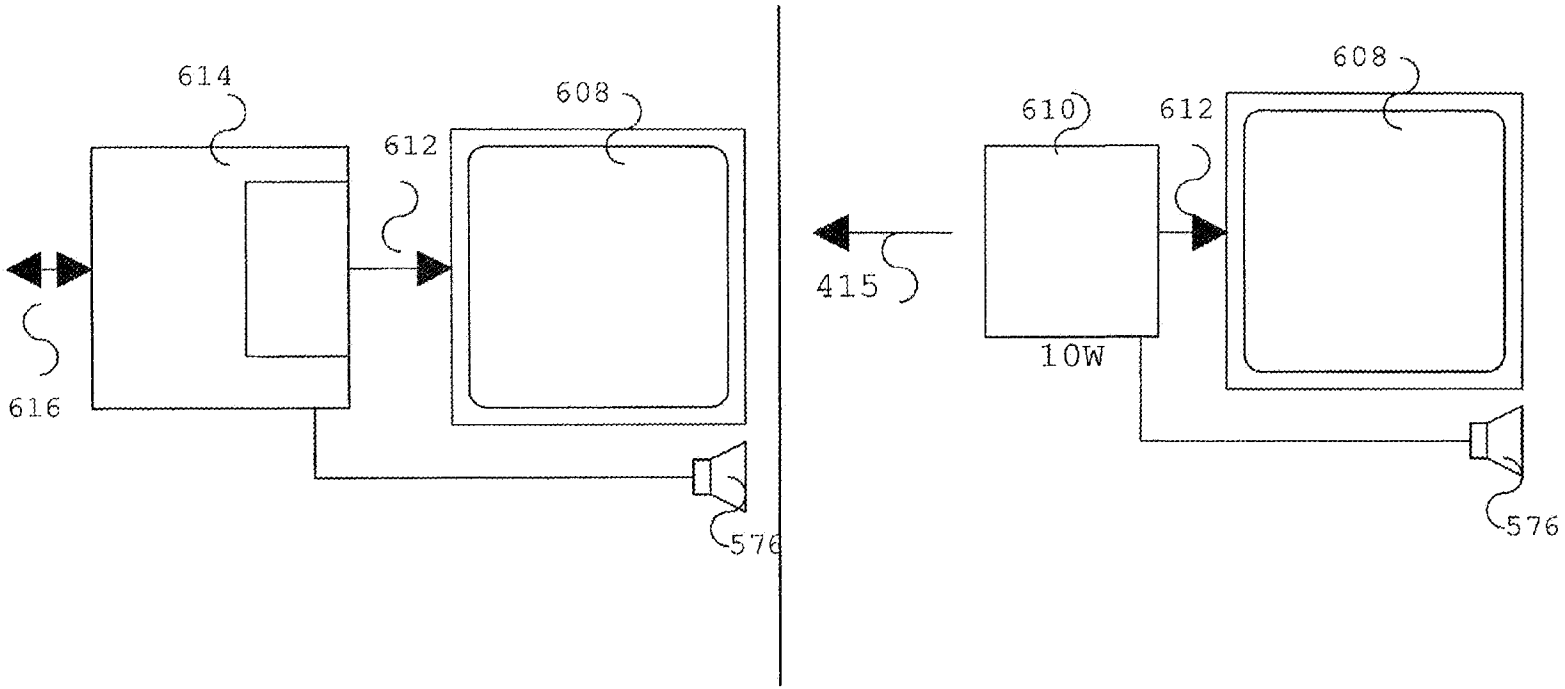
FIG. 53 is a block diagram illustrating a comparison between a traditional human machine interface and a USPECM human machine interface.

FIG. 53 is a block diagram illustrating a comparison between a traditional human machine interface and a USPECM human machine interface. The traditional human machine interface includes a PC 614 connected to a monitor 608 (e.g., a DVI monitor with touch panel display) and a speaker 576. The monitor is attached from the PC 614 to the monitor 608 using a DVI transmitter connection 612. An Ethernet connection 616 connects the PC 614 to the video source. The PC 614 would typically use a single channel of TCP/IP video/sensor display with a high power graphics card to power the display 608. The PC configuration may generally require approximately 300 Watts of power. Replacing the PC 614 with a traditional PC-based 12-channel TCP/IP human machine interface, in another example, can require up to 3600 watts of power (e.g., 300 W per channel of video output).

The USPECM human machine interface introduces an FPGA/ASIC 610 in place of the PC 614. Rather than the Ethernet connection 616, the USPECM interface 415 connects the FPGA/ASIC 610 to the video source. The FPGA/ASIC 610 configuration, for example, may require only 10 watts of power to control up to 48 channels of video output to the display device 608.

Figure 54:
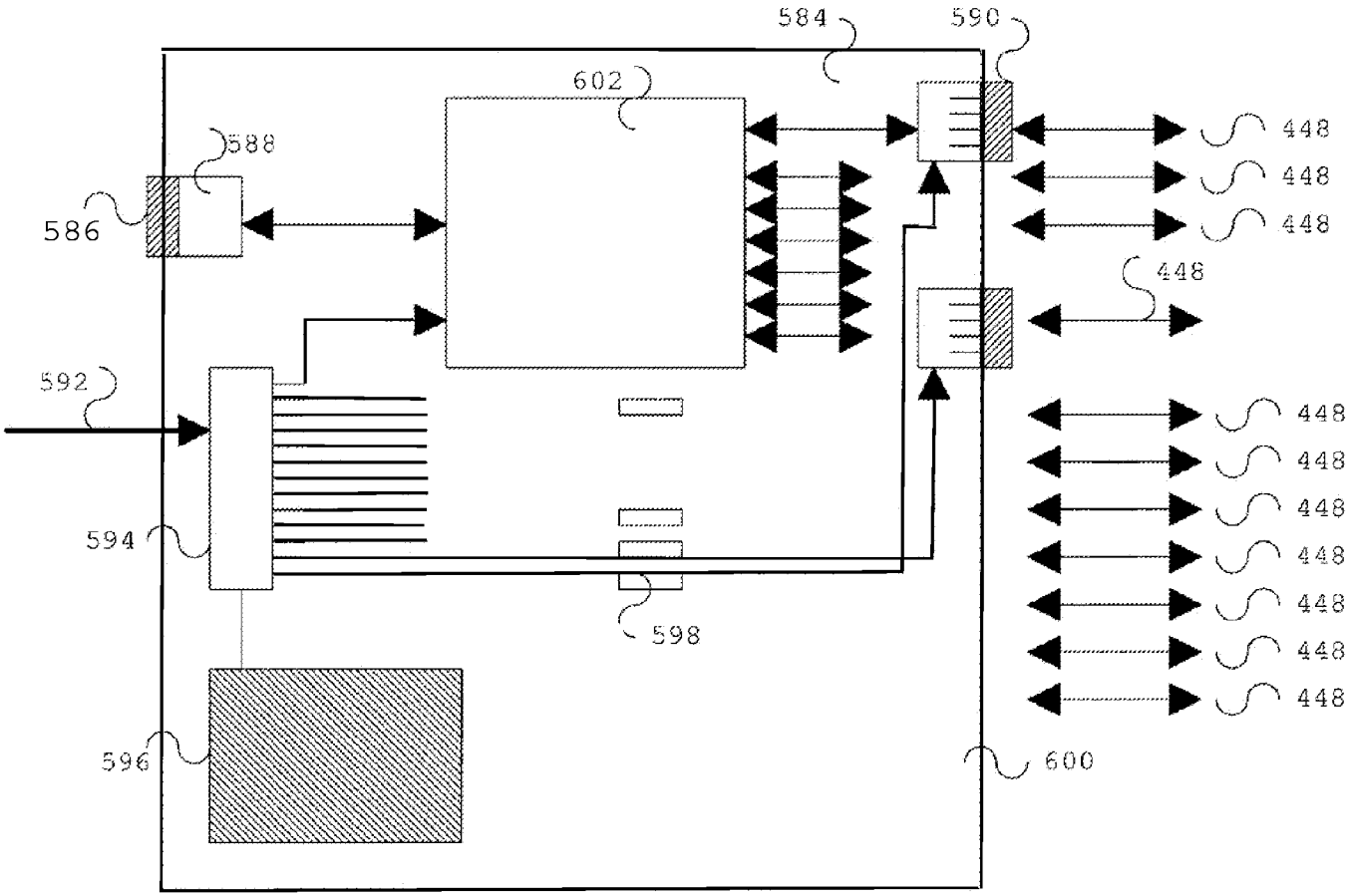
FIG. 54 is a hardware diagram illustrating a powered Ethernet switching system for use in a USPECM system.

FIG. 54 is a hardware diagram illustrating a powered Ethernet switching system for use in a USPECM system. Unlike a common off-the-shelf powered Ethernet Switch, the USPECM powered Ethernet Switch can be designed for water proofing, heat dissipation within the chassis, DC power backup battery, and Ethernet switch management (e.g., based upon USPECM sensor type). The USPECM Ethernet switching system can, however, make use of a common off-the-shelf Ethernet switch ASIC 602.

The Ethernet switch ASIC 602 is included within a printed circuit board (PCB) 584 along with a GbE uplink 588 (e.g., 10/100/1000Base-TX, 1000Base-X, fiber optic, etc.) to feed the Ethernet switch ASIC 602 with GbE communications from a waterproof connector 586 (e.g., RJ-45 or fiber optic connector, etc.). In some implementations, the GbE uplink 588 can be used to enable communications to and from a periscope system such as the RWP (as described in FIG. 28) or the FWP (as described in FIG. 35). The PCB 584 also includes a DC backup battery 596, a power distribution block 594, and one or more PoE fuses 598. The PCB 584 is held within a water proof and heat conductive chassis 600.

The chassis 600 is powered by a main DC power supply feed 592. The DC power supply feed 592 powers the Ethernet switch ASIC 602 and charges the DC power backup battery 596. The DC power backup battery 596 can be sized to maintain the downstream USPECM devices for a reasonable period of time during power loss from the main DC power supply feed 592. One or more USPECM interfaces 448 provide USPECM power and control to various USPECM devices and/or subsystems within the system. In one example, the chassis 600 can include up to 48 ports for USPECM device and/or subsystem connection. The USPECM devices and/or subsystems can connect to the chassis 600 through a set of waterproof USPECM connectors 590.

USPECM Wheel-Based Actuator

The JUV can use wheel-based actuators to perform the function of a valve (e.g., water valve, pneumatic valve, etc.). Although the wheel-based actuators can include a stepper motor with a current pulse feedback to sense the turning of the motor, in some implementations it may be desirable to verify the exact position of a wheel-based actuator either visually or mechanically.

Figure 55:
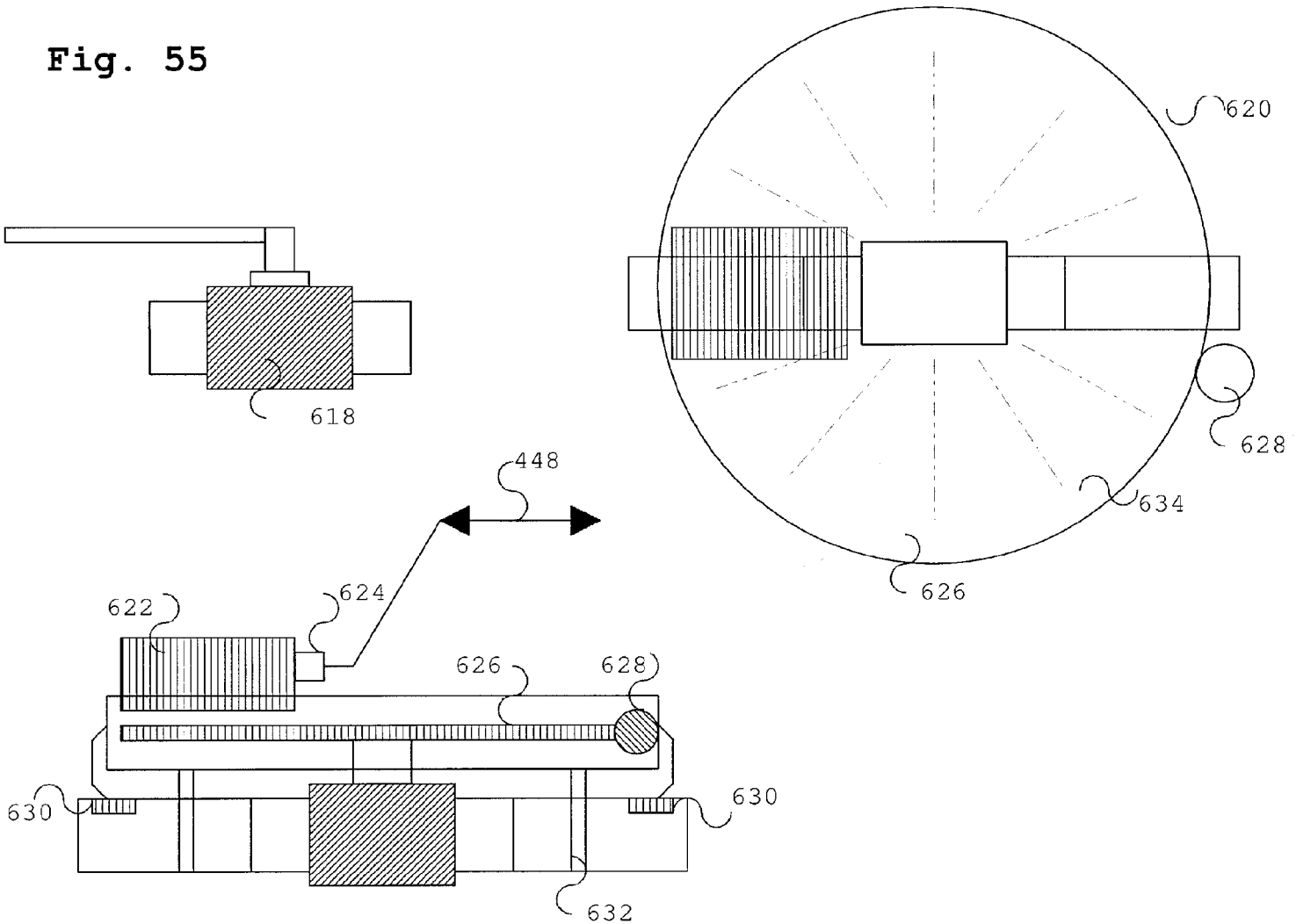
FIG. 55 is a block diagram illustrating a wheel-based actuator with a bar code dial.

FIG. 55 is a block diagram illustrating a wheel-based actuator with a bar code dial. The bar code dial can have a set of bar code labels 634 displayed on a wheel 626, similar to a clock dial. In this manner, the bar code label 634 on the wheel 626 can be read by a bar code reader 622 to visually check (e.g., by a USPECM actuator included within the bar code reader electronics) on the exact position of the wheel 626. In some implementations, a worm gear with stepper motor 628 can be used to drive the wheel 626 because the worm gear 628 will lock when the stepper motor stops.

As shown in a top view 620, the bar code labels 634 are evenly spaced around the wheel 626. The barcode reader 622, in some implementations, can constantly scan the wheel 626. When the bar code label 634 aligns beneath the barcode reader 622, the bar code reader 622 can process, compress, and forward the information to the USPECM central monitor system. In some implementations, the bar code reader 622 can include the generic USPECM sensor controller electronics as described in FIG. 44. Using the USPECM controller features, the bar code reader 622 can be connected to the USPECM interface 448 by a waterproof PoE connector 624 (e.g., RJ-45 connector, etc.) to forward actuator status to the USPECM central monitor.

The USPECM controller features within the bar code reader 622 can also drive one or more pressure sensors 630 (e.g., piezoelectric sensors). The pressure sensors 630, in some implementations, can be positioned within a pipe (e.g., the pipe connecting the air compressor 180 to the high pressure air container 182, as shown in FIG. 20), at each end of a valve (e.g., valve 183 as shown in FIG. 20) to sense the pressure related to the functioning of the valve, verifying that the valve is opening and closing properly. A fastener 632 fixes the position of the sensor (e.g., within the pipe) to secure the pressure sensors 630 from moving during valve operations.

An exemplary common off-the-shelf valve 618 is illustrated attached to a handle. The handle can be turned 90 degrees, for example, to open or close the valve. The wheel-based actuator replaces the functionality of the handle. Using the wheel-based actuator to open and close the valve, the USPECM sensors can monitor the exact angle at which the valve opener (e.g., handle) has been turned).

Figure 56:
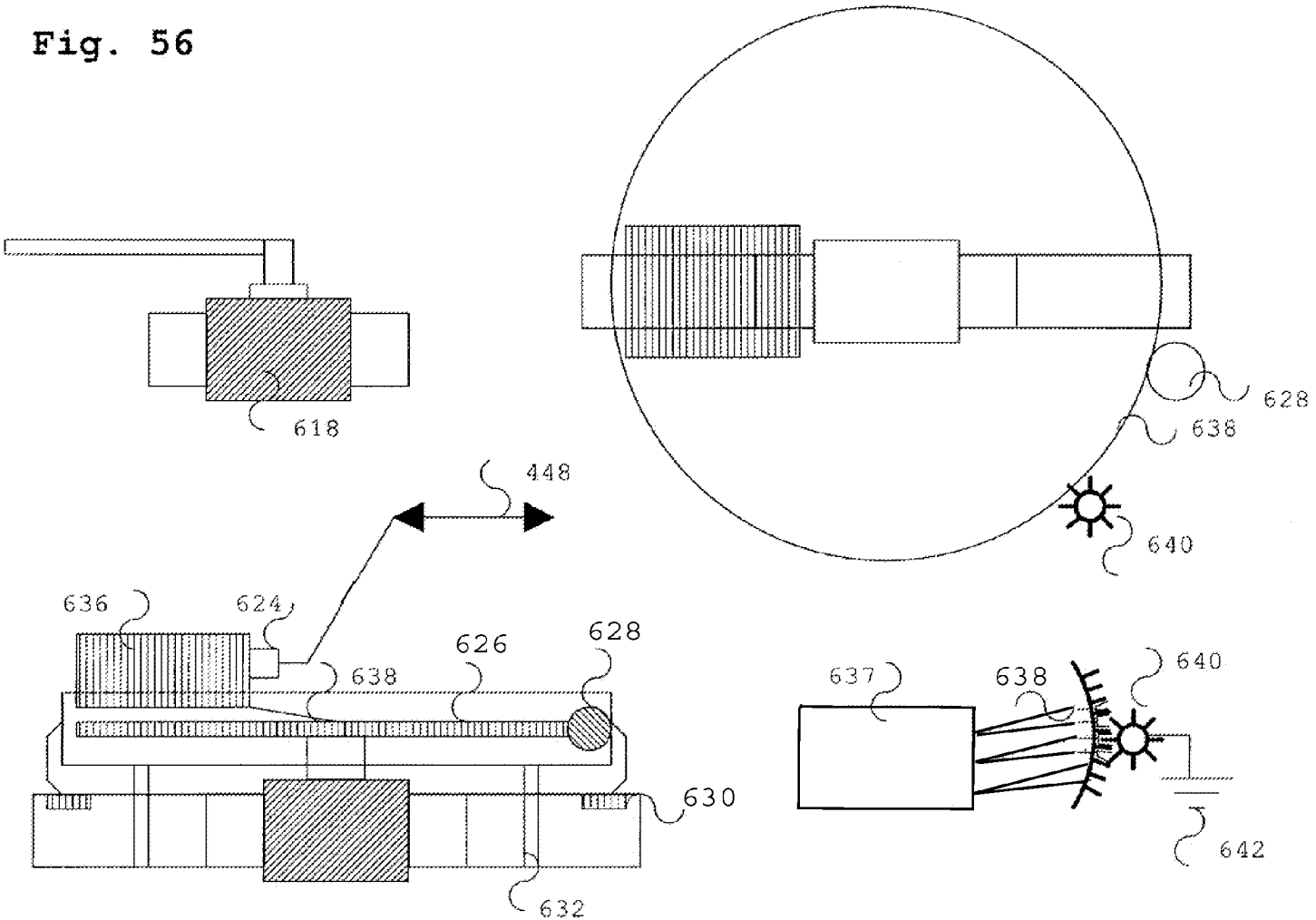
FIG. 56 is a block diagram illustrating a wheel-based actuator with a gear coded resistor dial.

FIG. 56 is a block diagram illustrating a wheel-based actuator with a gear coded resistor dial 638. The gear dial 638 utilizes mechanical contact of teeth at the edge of a wheel with a reference gear 640. Each tooth of the gear dial 638 is encoded using a unique digital code. The greater the numbers of teeth on the gear dial 638, the higher the precision of the positional reading. A worm gear 628 driven by a stepper motor can control the movement of the gear dial 638.

The reference gear 640 is a metal gear connected to electronic ground 642. The reference gear 640 contact, in some implementations, can be implemented using a brush metal contact. For example, the reference gear 640 can be a metal brush type of a wheel or ball form that contacts the teeth of the gear dial 638 even while it turns. Continuous contact can be maintained because a brush as a larger area of contact, accommodating greater error tolerance.

A gear coded dial and USPECM electronics controller 636 contains the generic electronics as described in FIG. 44 as well as the gear coded dial reader. The controller 636 controls the motor, pressure sensors, and the USPECM interface. An electrically conductive line 637 is attached to each tooth of the gear coded dial. The electrically conductive line 637, for example, includes the unique digital coding for that tooth. As the gear coded dial 638 turns, the reference gear 640 makes contact with individual teeth of the gear coded dial 638. This electrical contact allows the reference gear to read the value coded into the conductive line 637 attached to the tooth. The value is relayed to the USPECM electronics controller 636, where information can be sent to the USPECM control station regarding the exact positioning of the wheel-based actuator.

USPECM Autonomous Cap

Figure 57:
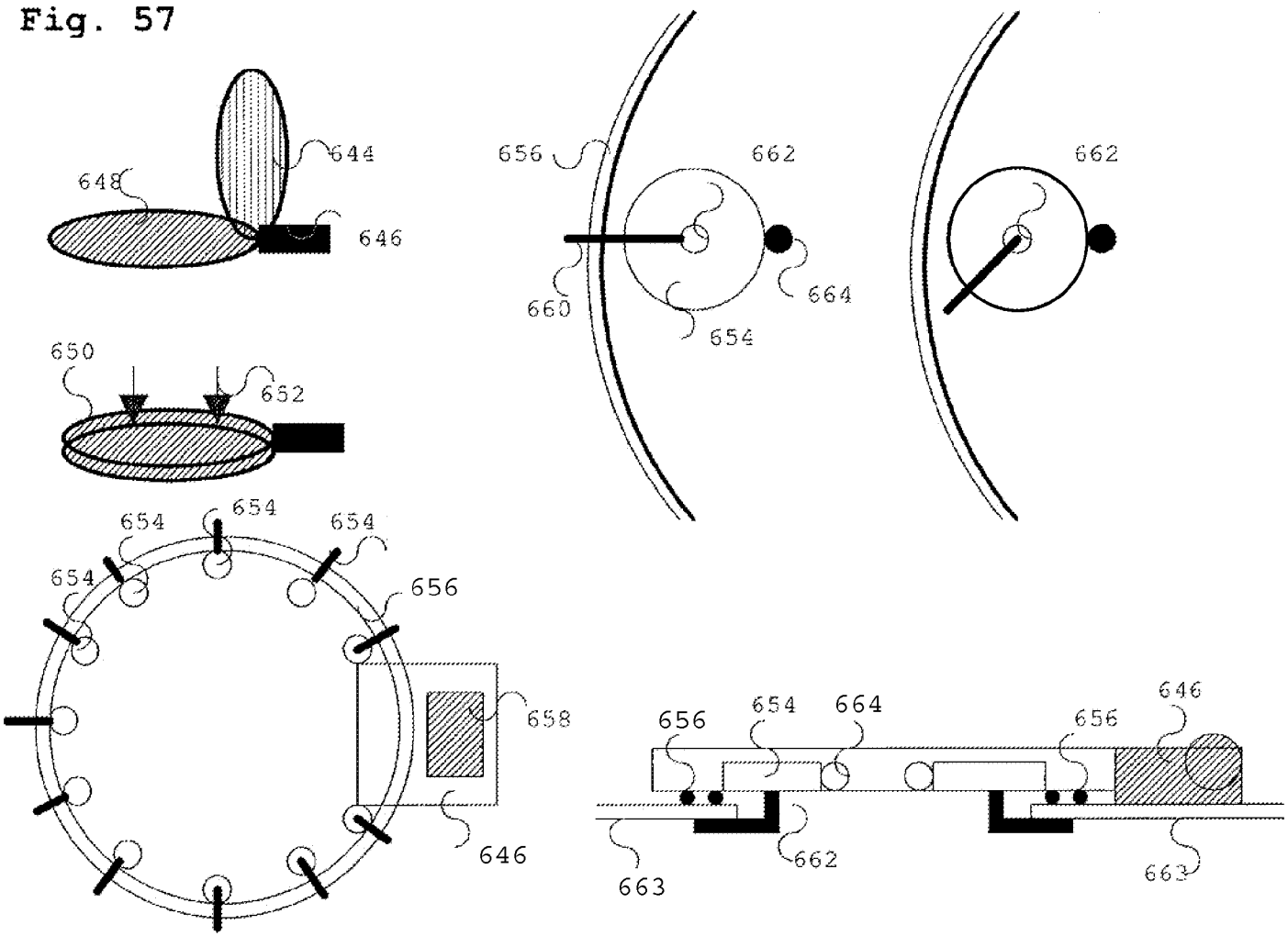
FIG. 57 is a block diagram illustrating an autonomous hull cap with a 360 degree lock actuator.

FIG. 57 is a block diagram illustrating an autonomous hull cap with a 360 degree lock actuator. In some implementations, although the cap is designed with a 360 degree lock actuator, it may be limited to 90 degrees as long as it can switch between lock angle and fully open angle. There can be many applications for the USPECM autonomous cap in the JUV. For example, one or more autonomous hull caps can be included within the crew module (e.g., the crew cabin module as described in FIG. 23) to allow the crew to enter the JUV from the outside and/or to seal each EEC exit. One or more autonomous hull caps can be included within the weaponry module (e.g., weaponry module as described in FIG. 19) to seal each torpedo and/or missile launch port and the like. A USPECM autonomous cap includes a cap 644 and a hinge 646.

As shown in FIG. 57, an open position diagram 648 depicts the USPECM autonomous cap within the open position. In some implementations, hinge electronics 658 control the vertical positioning of the cap 644 when moving the cap 644 into the open position. A closed position diagram 650 depicts the USPECM autonomous cap within a closed position. The cap 644 can be pulled into the closed position 650, for example, using the hinge electronics 658. In other implementations, a crew member can manually pull the cap 644 shut. When in the closed position 650, the USPECM autonomous cap design needs to withstand a high downward water pressure 652 without leak into the JUV.

In some implementations, one or more lock bars 660 can be used to lock the autonomous cap closed. Each lock bar 660 is attached to a USPECM wheel-based actuator 654. As described with reference to FIGS. 55 and 56, a worm gear and stepper motor 664 can be used to drive the wheel-based actuator 654. The hinge electronics 658, in some implementations, can trigger the locking mechanism of the autonomous cap 644.

One or more o-rings 656 isolate the water from leaking into the JUV when pressured evenly. The o-rings 656 can be arranged around the periphery of the autonomous cap at the top of the JUV hull 663. When the cap 644 is engaged with the JUV hull 663, one or more seals 662 tighten down the o-rings 656 against the hull top 663. The seals 662 protect the electronics within the lock bar actuator.

Figure 58:
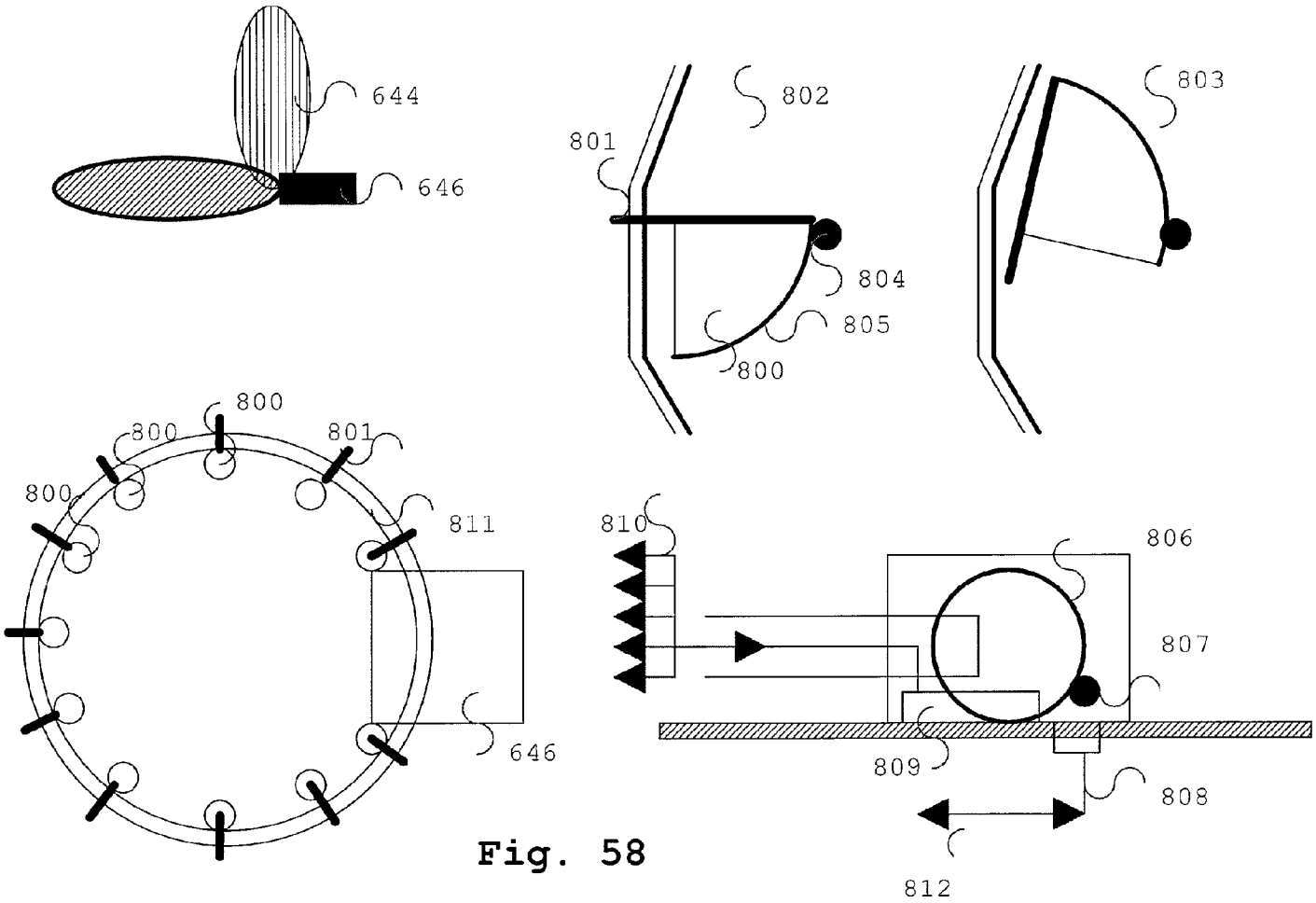
FIG. 58 is a block diagram illustrating an autonomous hull cap with a 90 degree lock actuator.

FIG. 58 is a block diagram illustrating the autonomous hull cap 644 with a 90 degree lock actuator. The 90 degree lock actuator, for example, is a stronger wheel-based actuator using a larger wheel (e.g., larger diameter) to apply a level effect. Within a closed and locked position 802, the wheel-based actuator 800 and worm gear 804 has moved a lock bar 801 across the outer edge of the autonomous cap 644. In the unlocked position 803, the lock bar 801 is fully aligned along the interior surface of the autonomous cap 644.

FIG. 58 also illustrates the details of auto-cap hinge physical and electronic connections from a single USPECM interface 812. The single USPECM electronics interface 812 located under the hull is introduced to an autonomous cap electronics module 809 within an autonomous cap controller unit mounted upon the hull surface. The autonomous cap electronics module 809 switches the control commands within the data stream of the USPECM electronics interface 812 to several USPECM interfaces 810 (e.g., associated with individual lock bar actuators, wheel-based actuators, etc) arranged upon the autonomous cap and on the hinge. The autonomous cap electronics module 809 also includes a wheel-based actuator 806 and a worm gear 807 which work to open or close the hinge 646.

Figure 59:
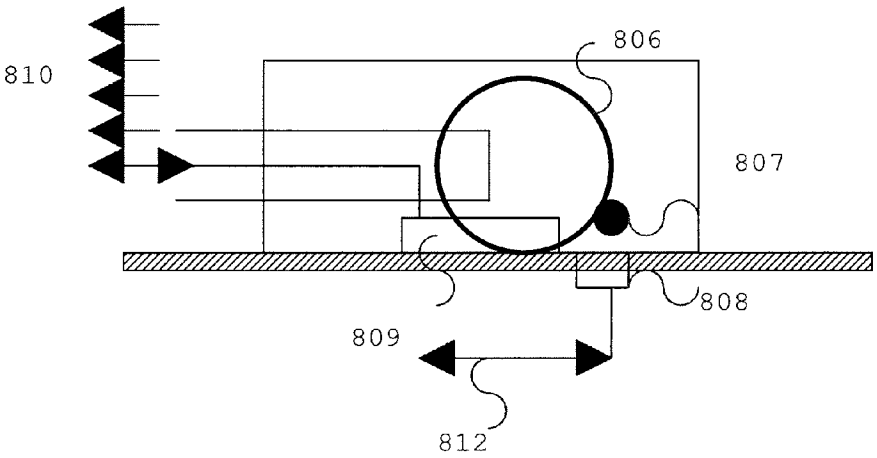
FIG. 59 is a block diagram illustrating a hinge design for an autonomous hull cap with a wheel-based actuator.

FIG. 59 is a block diagram illustrating a hinge design for an autonomous hull cap with a wheel-based actuator. The autonomous cap hinge includes physical and electrical connections spanning from the single USPECM interface 812 under the hull of the JUV to many USPECM actuators, sensors, and/or other devices (e.g., wheel-based actuator 806) positioned on the cap and on the hinge. The worm gear 807 is used to open or close the hinge. The hinge electronics module 809 can control the worm gear 807 and associated wheel-based actuator 806 as well as a number of actuators positioned around the cap portion using the USPECM interfaces 810. The USPECM control signals for the hinge unit and additional cap lock actuators can be provided to the hinge unit through a USPECM outer hull opening 808.

USPECM Router

Figure 60:
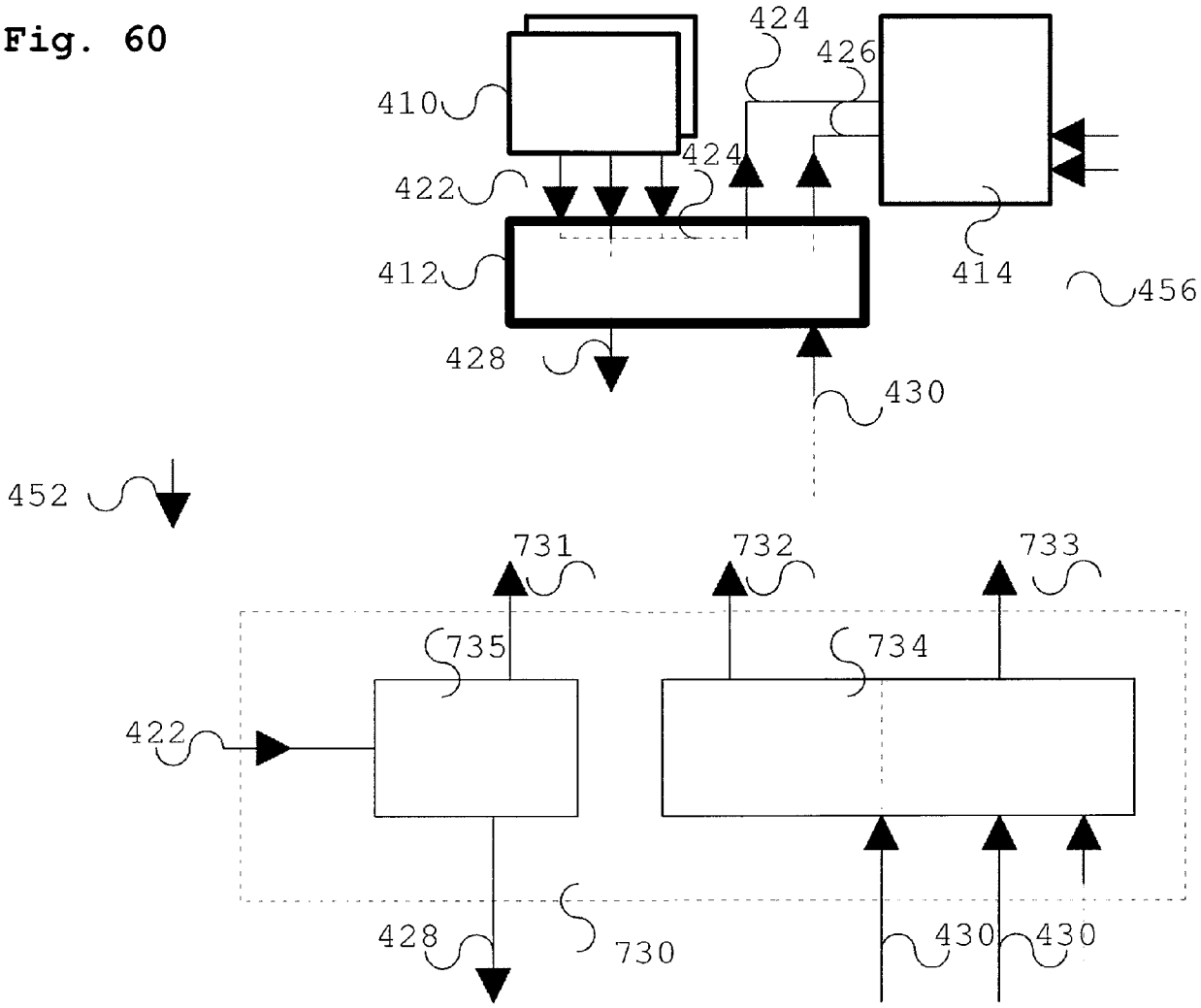
FIG. 60 is a hardware diagram illustrating a router design for a USPECM system.

FIG. 60 is a hardware diagram illustrating a router design for a USPECM system. The Ethernet MAC router 412 is the centerpiece of the USPECM network, distributing the central command and control data 452 (e.g., broadcast microsecond synchronization packets, emergency alerts, router MAC address learning packets, USPECM device commands, etc.) from the USPECM central monitor to each USPECM device via the command connection 428. The Ethernet MAC router 412 aggregates sensor data 456 from the data connection 430 to the central monitor router 414 over a collective data connection 426. The command connection 424 can also be copied to central monitor router 414 for recording (e.g., to a black box). The USPECM MAC router 414 can fabricated, in some implementations, in an FPGA.

An FPGA implementation 730 of the USPECM MAC router 412 includes a command and control FPGA 735 and a USPECM device controller FPGA 734. The command and control FPGA 735 relays and copies command and control packets to both the central monitor router 414 and one or more USPECM devices. The command and control data received from the central command control 410 along the command connection 422 (e.g., a GbE physical interface), for example, can be issued to the USPECM devices from the command and control FPGA 735 using the command connection 428 (e.g., a GbE physical interface). The same command and control data 452 received along the command connection 422 can be copied to a command and control data path 731 (e.g., 1 GbE interface) where the command and control data 452 will be received by the central monitor router 414.

The incoming sensor data 456 can be received by the USPECM device controller FPGA 734 over the data connection 430 (e.g., one or more GbE physical interface). The USPECM device controller FPGA 734 generates dummy MAC addresses for the powered Ethernet switching system 416 (as described in FIG. 38) to route all of the sensor data 456 to the central monitor router 414. The USPECM device controller FPGA 734 can collect separate types of sensor data 456 (e.g., sensor gauge values, surveillance camera images, periscope images, etc.). The USPECM device controller FPGA 734 can then route the numerical data along a numerical data connection 732 (e.g., 10 GbE physical interface) and the image data along an image data connection 733 (e.g., 10 GbE physical interface). Both the image data portion and the numerical data portion of the sensor data 456 are destined for the central monitor router 414, where the data can be made available at one or more system monitoring stations 420 and logged to the black box 418 (as shown in FIG. 38).

Figure 61:
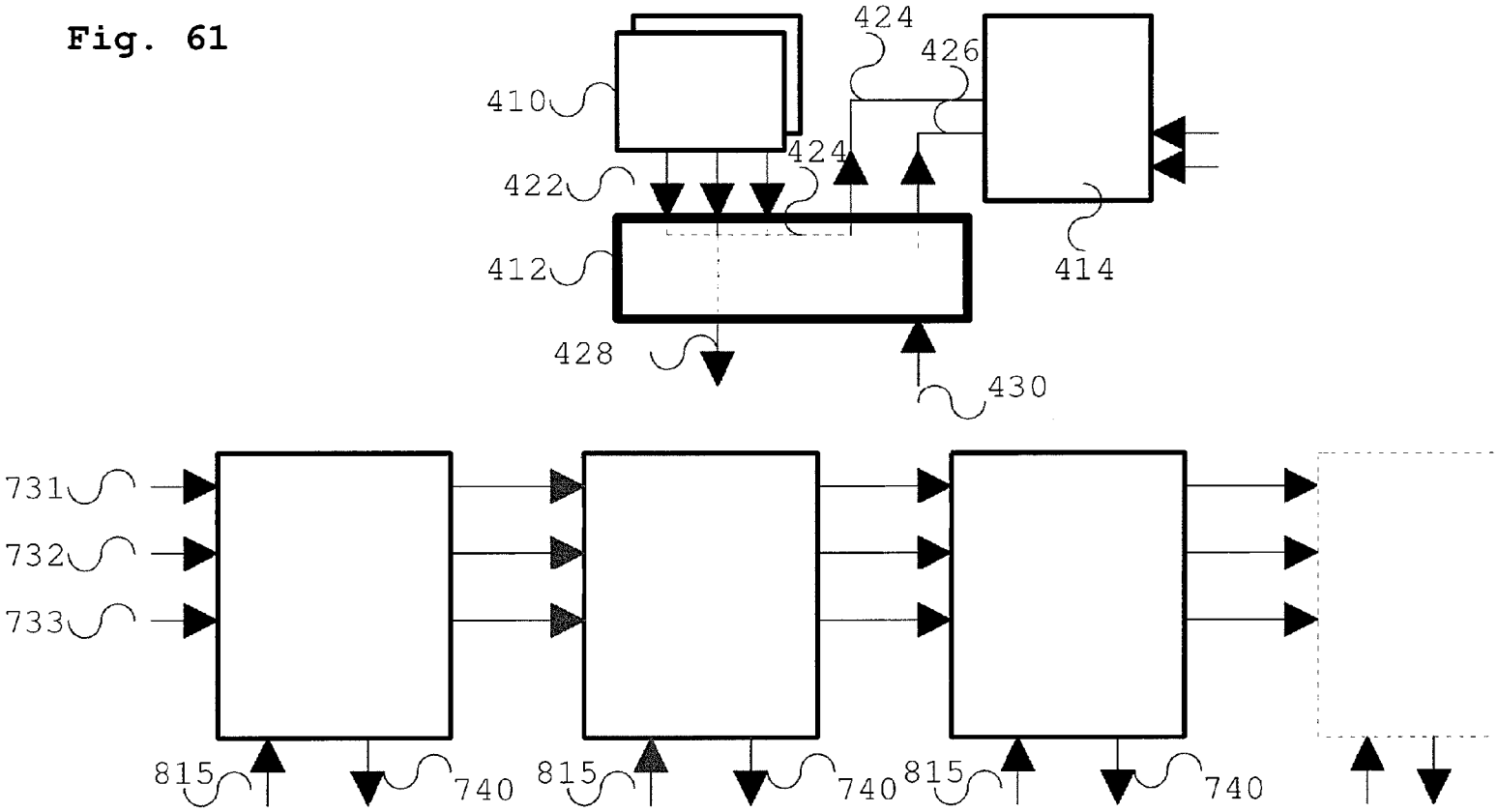
FIG. 61 is a hardware diagram illustrating a central monitor router design for a USPECM system.

FIG. 61 is a hardware diagram illustrating a central monitor router design for a USPECM system. All of the data that needs to be monitored or recorded can be routed to the central monitor router 414. The control data path 731, the numerical data connection 732, and the image data connection 733 can be combined into a monitor data stream. Each monitor station can send monitor criteria 815 to the central monitor router 414. The monitor criteria 815, for example, can include a listing of USPECM devices and/or subsystems which are to be displayed by the monitor station. The central monitor router 414 can redirect a set of monitored data 740 originating from the selected USPECM subsystems and/or devices plus command data pertaining to the selected USPECM subsystems and/or devices to the requesting monitoring station. The monitoring station will display the information within the monitored data 740 as shown, for example, in FIG. 51. In a similar manner, one or more black boxes can received monitored data 740 based upon monitor criteria 815.

Figure 62:
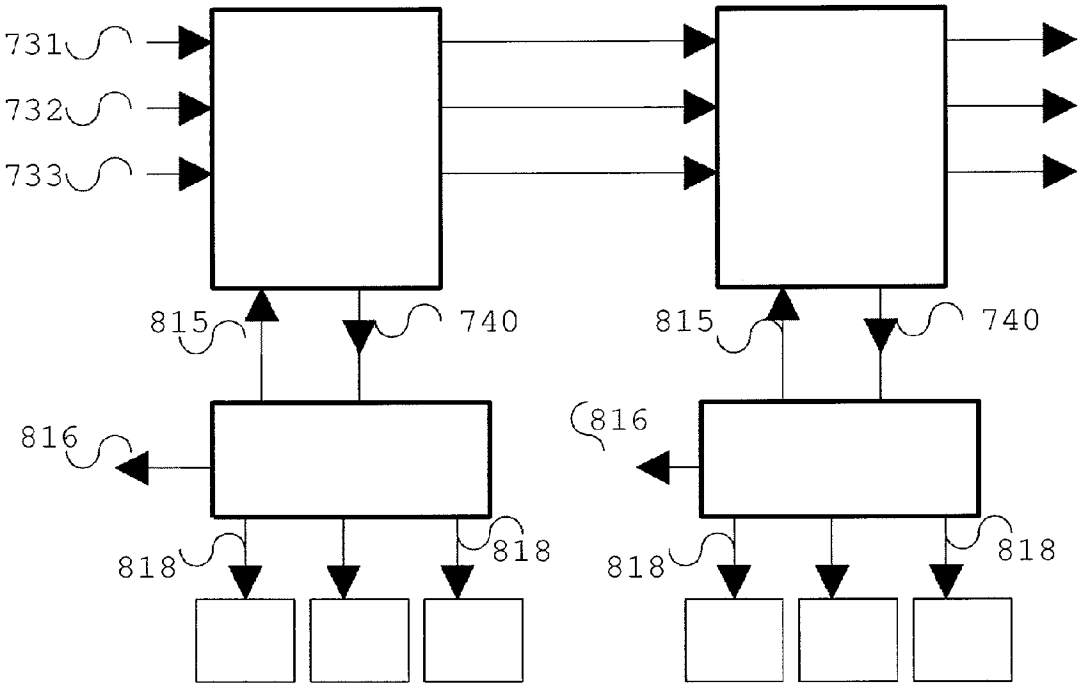
FIG. 62 is a hardware diagram illustrating a black box design for a USPECM system.

FIG. 62 is a hardware diagram illustrating a black box design for a USPECM system. The USPECM black box includes an FPGA/ASIC with a communications link 818 (e.g., 1 GbE Ethernet USB) to one or more external storage media. The external storage media, for example, can include a Flash hard drive, static random access memory (SRAM), read only memory (ROM), etc. In some implementations, the external storage media is a 600 GB hard drive used to store the USPECM data into different sectors of the drive.

The transfer speed of the communications link 818 can limit the routed data accepted by an individual black box. For example, if the communications link 818 uses the USB 2.0 standard, running at approximately 480 megabytes per second (mbps), the black box should include monitor routing criteria listing a number and/or type of USPECM subsystems and/or devices which anticipate a level of traffic which the black box can handle receiving.

In some implementations, the black box can also include an instant replay communications link 816. The instant replay communications link 816, for example, can be used by the crew members in reviewing images received by the surveillance system. The instant replay communications link 816, in some implementations, may be a 10/100 GbE physical connection to one or more monitoring stations.

JUV Configured for Missile/Torpedo Defense

Figure 63:
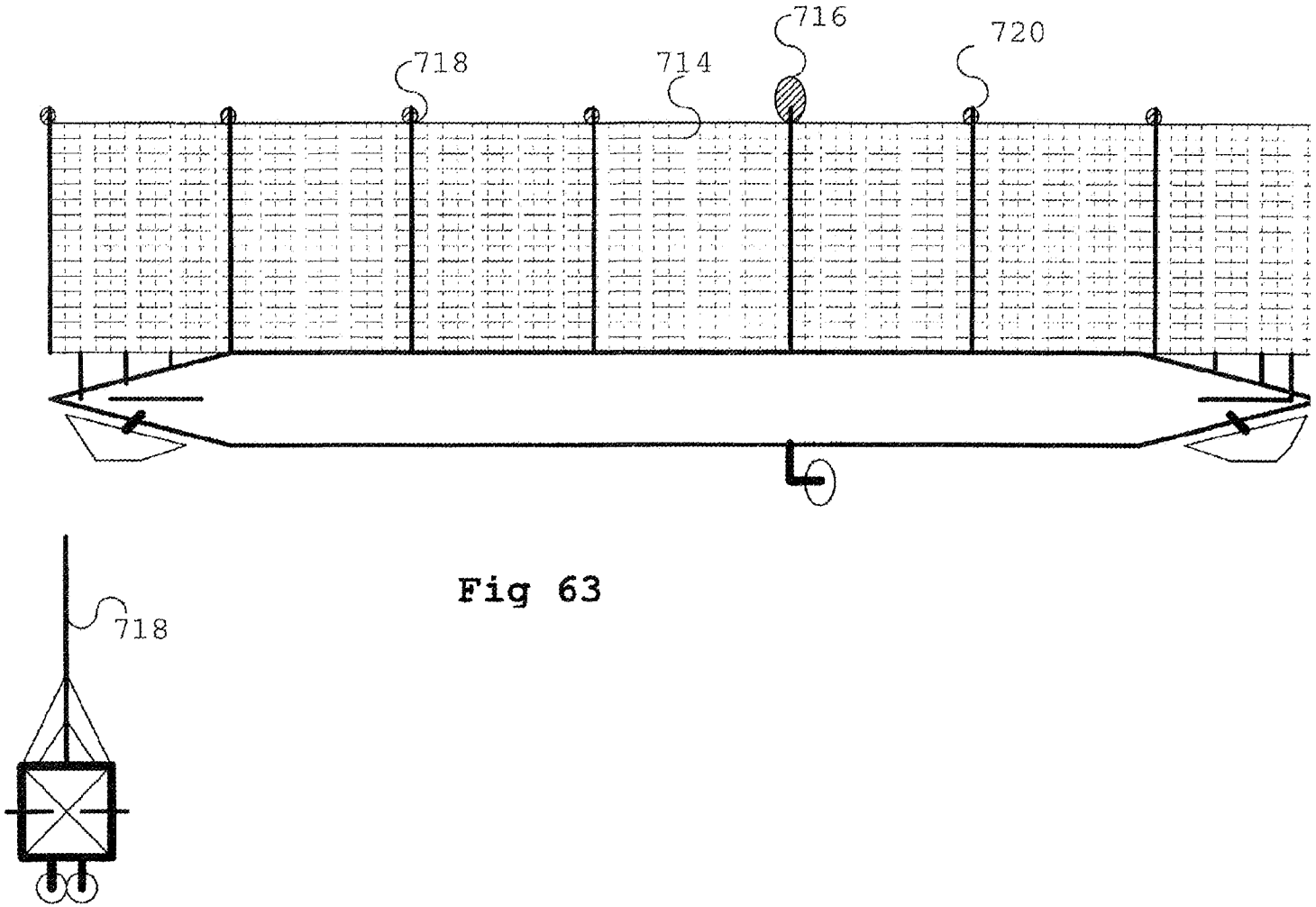
FIG. 63 is a diagram illustrating a J-Type Underwater Vehicle configured for missile and/or torpedo defense.

FIG. 63 is a diagram illustrating a J-Type Underwater Vehicle configured for missle and/or torpedo defense. The JUV can be configured into a low cost, un-manned military defense JUV (MD_JUV). The MD_JUV has no weaponry system. In some implementations, the MD_JUV can be controlled by the crew of a nearby aircraft carrier to submerge, surface, and navigate at a safe distance from the aircraft carrier. The MD_JUV can raise a missile defense screen 714 (e.g., made of an intermeshed net) supported by a set of frame poles 718. For example, the missile defense screen 714 can be used to disrupt the flight path of a missile. In some implementations, the missile defense screen 714 can also be used to disable the missile or prohibit the missile from exploding. In the case that the missile impacts near or on the MD_JUV, there will be minimal fatality because the MD_JUV can be un-manned and remote controlled. Additionally, the cost of the MD_JUV can be substantially less than the aircraft carrier or the ship that it protects.

The MD_JUV is controlled using an FWP 716 (as described in FIGS. 31 through 35). The tip of the FWP 716 includes a beacon 720 (e.g., LED flash) which the crew can follow to visually identify the position of the MD_JUV within the water. The FWP pole aligns with the other frame poles of the missile defense screen 714. In some implementations, the FWP pole acts as a support frame pole of the missile defense screen 714. The support frame poles 718 can additionally include beacons 720 for easier visual identification by the remote operator.

Figure 64:
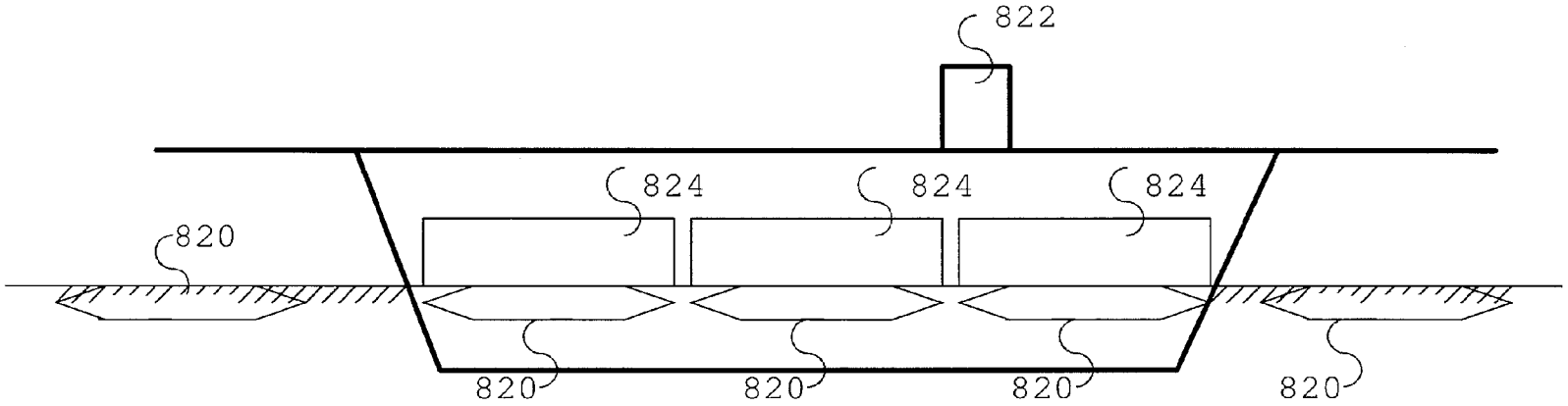
FIG. 64 is a diagram illustrating a horizontal side view of a deployment strategy for a J-Type Underwater Vehicle configured for missile and/or torpedo defense.

FIG. 64 is a diagram illustrating a horizontal side view of a deployment strategy for a J-Type Underwater Vehicle configured for missle and/or torpedo defense. The horizontal view includes an MD_JUV fleet including five MD_JUV units 820 protecting an aircraft carrier 822. The three MD_JUV units 820 positioned in front of the aircraft carrier 822 have missile defense screens 824 deployed.

This strategy can be used to catch any missile (e.g., Harpoon missile, supersonic missile, etc.) targeting the aircraft carrier 822 or other large military ship. The height of the missile defense screens 824 can be above 10 meters. As shown in FIG. 64, the missile defense screens 824 are deployed above water level. In other implementations, the missile defense screens 824 can be partially or fully submerged beneath the surface of the water.

Figure 65:
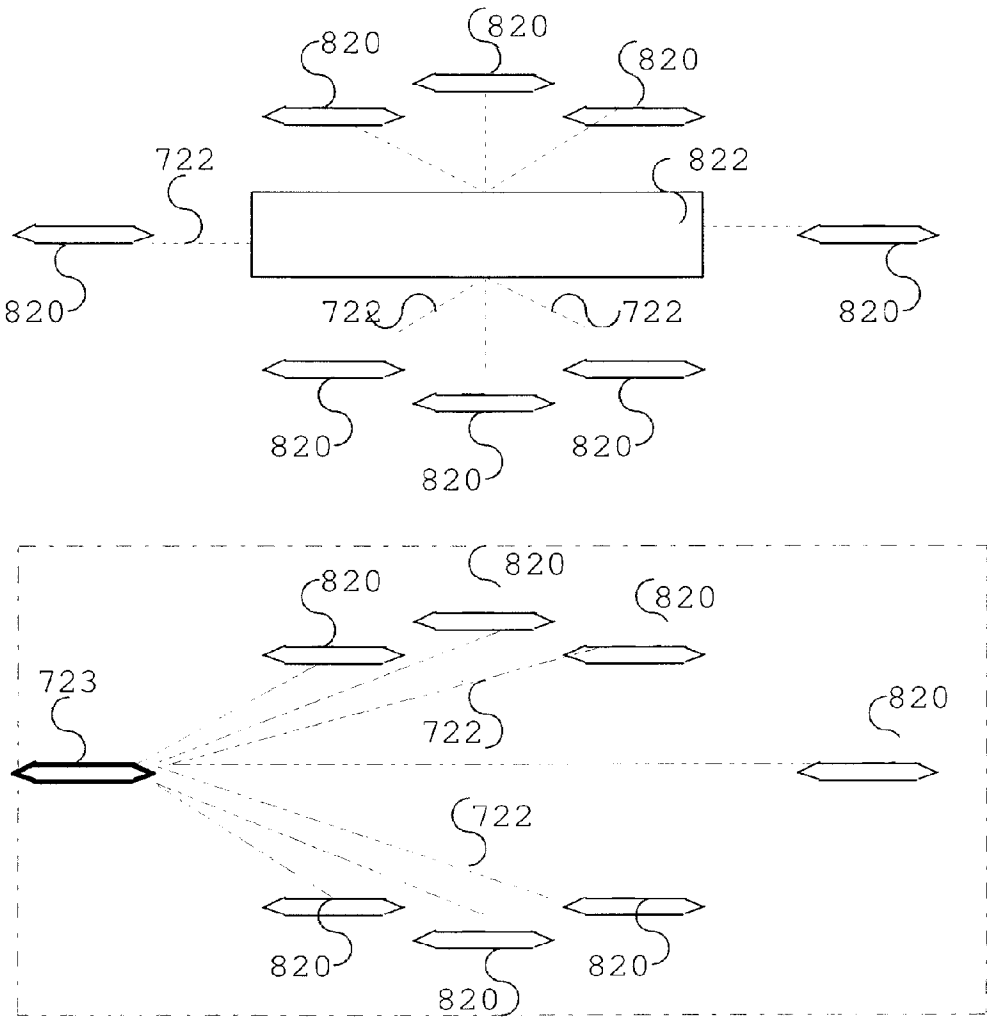
FIG. 65 is a diagram illustrating a top view of a deployment strategy for a J-Type Underwater Vehicle configured for missile and/or torpedo defense.

FIG. 65 is a diagram illustrating a top view of a deployment strategy for a J-Type Underwater Vehicle configured for missile and/or torpedo defense. As is shown in the upper portion of FIG. 65, the fleet of MD_JUV units 820 is surrounding the aircraft carrier 822. For example, the missile defense screen of each MD_JUV unit 820 can be used to disrupt the flight path of a missile, to disable the missile, or to prohibit the missile from exploding. The MD_JUV fleet can be controlled remotely by crew members upon the aircraft carrier 822, for example, using a set of wireless communication paths 722.

The lower portion of FIG. 65 depicts a manned MD_JUV flag ship 723 leading the fleet of unmanned MD_JUV units 820 to be deployed in a mission. The MD_JUV units 820 also can be deployed as a decoy for the aircraft carrier 822, defending against incoming missiles from the air. For example, the aircraft carrier 822 can emit a large smoke screen to block the visual guidance system of the incoming missile, allowing the missile to aim at the MD_JUV decoy units 820.

Using either the upper deployment formation or the lower deployment formation as illustrated in FIG. 65, in some implementations the individual units 820 within the fleet can communicate with each other. For example, each MD_JUV unit 820 could communicate using a short distance wireless communication 722 (e.g., WiMAX, WiFi, etc.) over the wireless antenna 272 within the FWP float (as shown in FIG. 26). Additionally, the crew aboard the aircraft carrier 822 can control each MD_JUV unit 820 using the wireless communication 722.

Figure 66:
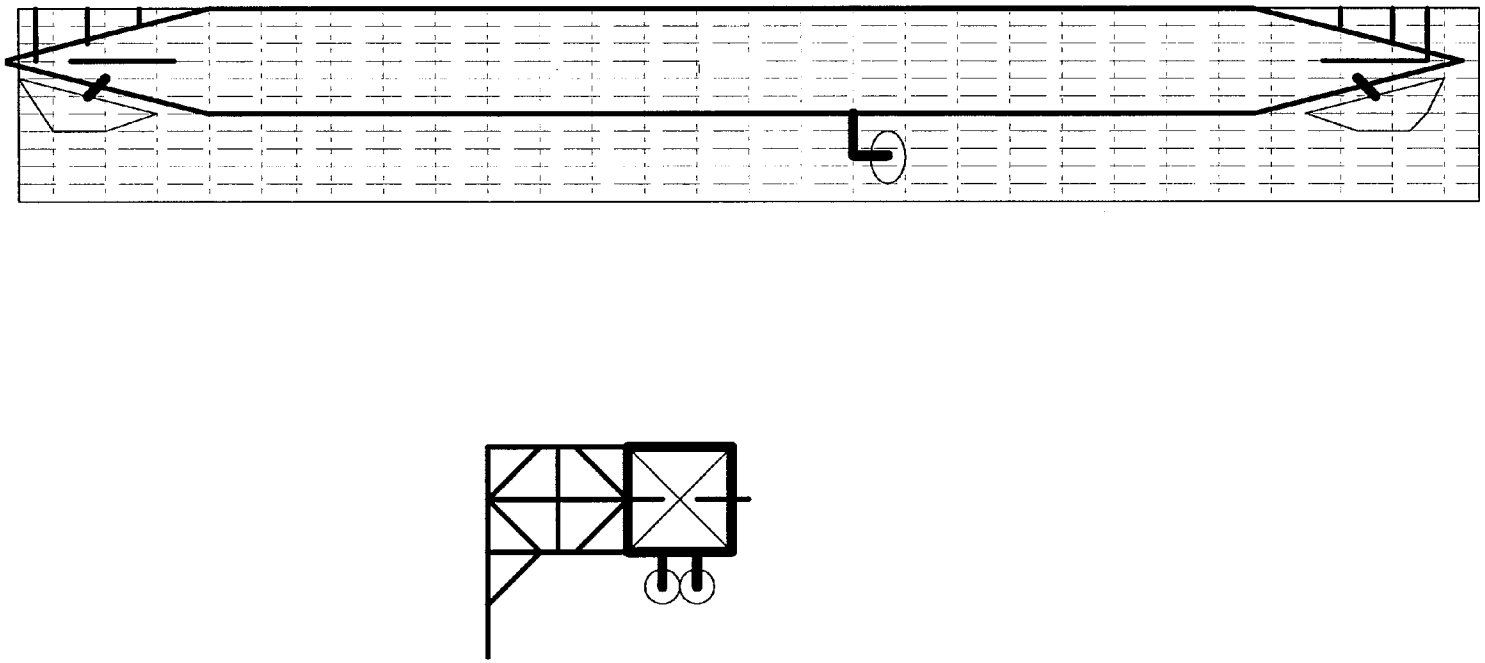
FIG. 66 is a diagram illustrating a J-Type Underwater Vehicle configured for torpedo defense.

FIG. 66 is a diagram illustrating a J-Type Underwater Vehicle configured for torpedo defense (TD_JUV). Similar to the MD_JUV as described in relation to FIGS. 63-65, the TD_JUV can have an underwater defensive screen (e.g., made of an intermeshed net) for diverting and trapping incoming torpedoes. In some implementations, the MD_JUV releases the underwater defense screen from the top of the hull. The underwater defense screen, for example, can span approximately twelve feet from the top of the TD_JUV downwards.

In some implementations, the underwater defense screen is released using a pole structure which extends about 8 feet horizontally off of each side of the TD_JUV. The underwater defense screen then extends downwards (e.g., along a 12 foot vertical pole structure). If, for example, the width of the TD_JUV is eight feet, the entire width of a TD_JUV with underwater defense screens deployed to either side would be 24 feet.

Figure 67:
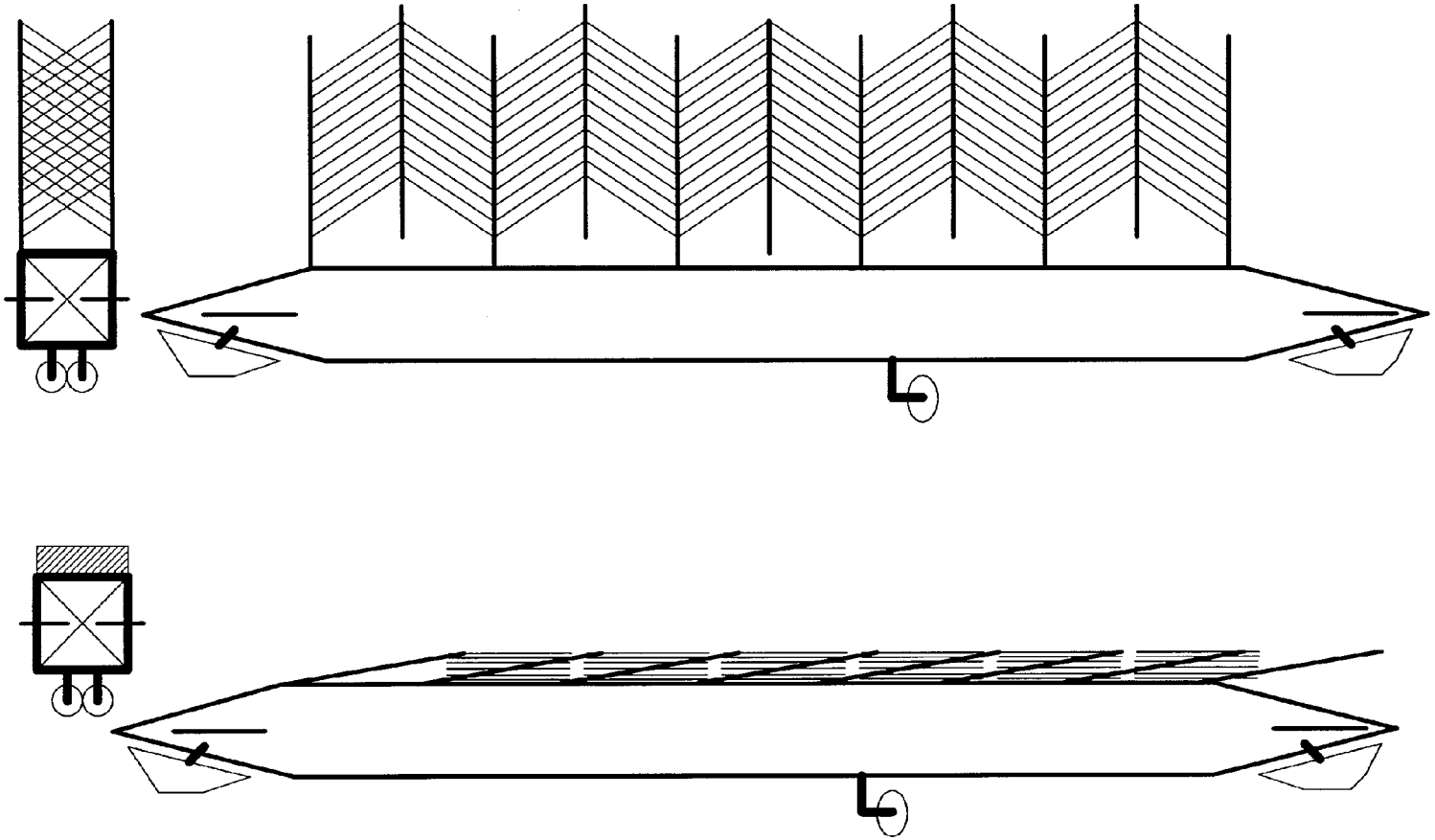
FIG. 67 is a diagram illustrating a J-Type Underwater Vehicle configured for missile defense including a moveable missile defense screen.

FIG. 67 is a diagram illustrating a J-Type Underwater Vehicle configured for missile defense including a moveable missile defense screen. As shown in FIG. 67, an MD_JUV has raised an underwater defense screen (e.g., as described in FIG. 63) for defending against an incoming low-flying missile. In some implementations, the supporting poles for the defensive screen can be arranged along the hull of the MD_JUV in a zigzagging manner (e.g., a pole fastened to the starboard side of the MD_JUV, followed by a pole fastened to the port side of the MD_JUV, and so forth). The net portion of the underwater defense screen, for example, can be made out of a light-weight, durable, fishing net material (e.g., nylon, polypropylene, polyethylene, co-polymer fibers, etc.).

When the MD_JUV is submerged, the pole structure can be retracted into a flat position, as illustrated in the bottom portion of FIG. 67, to reduce the drag force. When responding to an incoming low-flying missile (e.g., a Harpoon missile), the MD_JUV can surface and raise the poles to the vertical position to catch the incoming missile.

Figure 68:
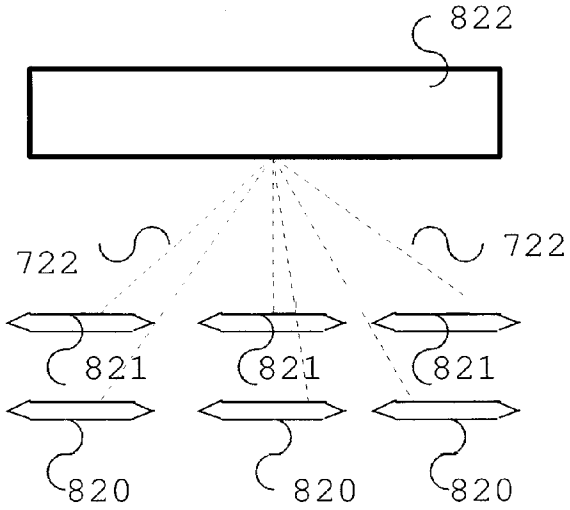
FIG. 68 is a diagram illustrating a J-Type Underwater Vehicle fleet configured as an aircraft carrier decoy.

FIG. 68 is a diagram illustrating a J-Type Underwater Vehicle fleet configured as an aircraft carrier decoy (ACD_JUV) 821. The ACD_JUV units 821, in some implementations, can be configured using the same module layout as the MD_JUV described in reference to FIG. 63. If, for example, an enemy missile is launched into orbit thousands of miles away from a targeted U.S. aircraft carrier 822 and is detected by satellite, the aircraft carrier 822 can be alerted and evasive and defensive measures can be deployed. For example, the aircraft carrier 822 can emit a large smoke screen to block the visual guidance system of the incoming missile. The missile may mistake the ACD_JUV fleet as the aircraft carrier 822 and aim at the center of the fleet.

During an incoming missile alarm, for example, three ACD_JUV units 821 and three MD_JUV units 820 can be used to form the shape of an aircraft carrier. The ACD_JUV units 821 and MD_JUV units 820, for example, can be maneuvered into position by the wireless communication 722 between the aircraft carrier 822 and the FWP of each ACD_JUV, MD_JUV. By positioning the ACD_JUV units 821 and the MD_JUV units 820 along the periphery of the shape of an aircraft carrier 822, the center area (e.g., open sea) is exposed as a decoy target. For example, the missile may have an optical recognition and visual guidance system, and the decoy fleet of ACD_JUV units 821 and MD_JUV units 820 can be used to draw the attention of the incoming missile. In other implementations, ACD_JUV units 821 alone can be used to create an aircraft carrier decoy.

Figure 69:
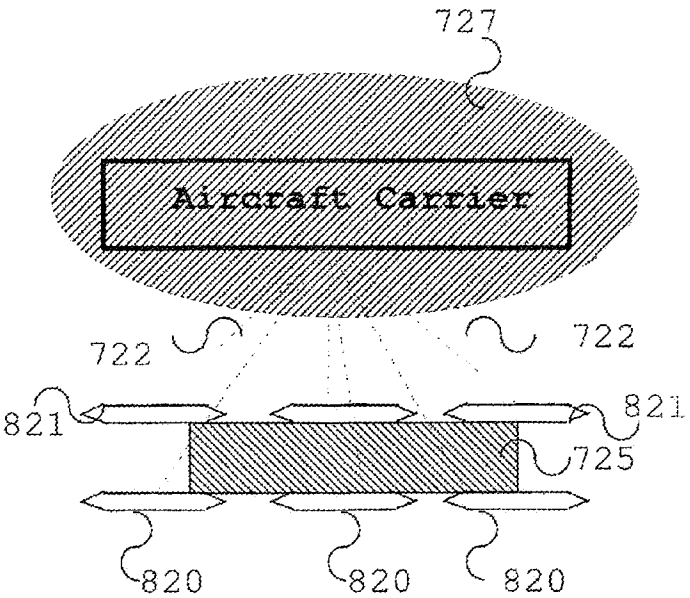
FIG. 69 is a diagram illustrating a top view of a deployment strategy for a J-Type Underwater Vehicle configured as an aircraft carrier decoy.

FIG. 69 is a diagram illustrating a top view of the deployment strategy for a J-Type Underwater Vehicle configured as an aircraft carrier decoy as described in FIG. 68. Just prior to the arrival of the incoming hostile missile, the aircraft carrier 822 can release a thick smoke cloud 727 to cover the aircraft carrier 822. The missile, targeting the decoy fleet of ACD_JUV units 821 and MD_JUV units 820, can aim for an open water target region 725.

JUV Emergency Escape Capsule (EEC)

Figure 70:
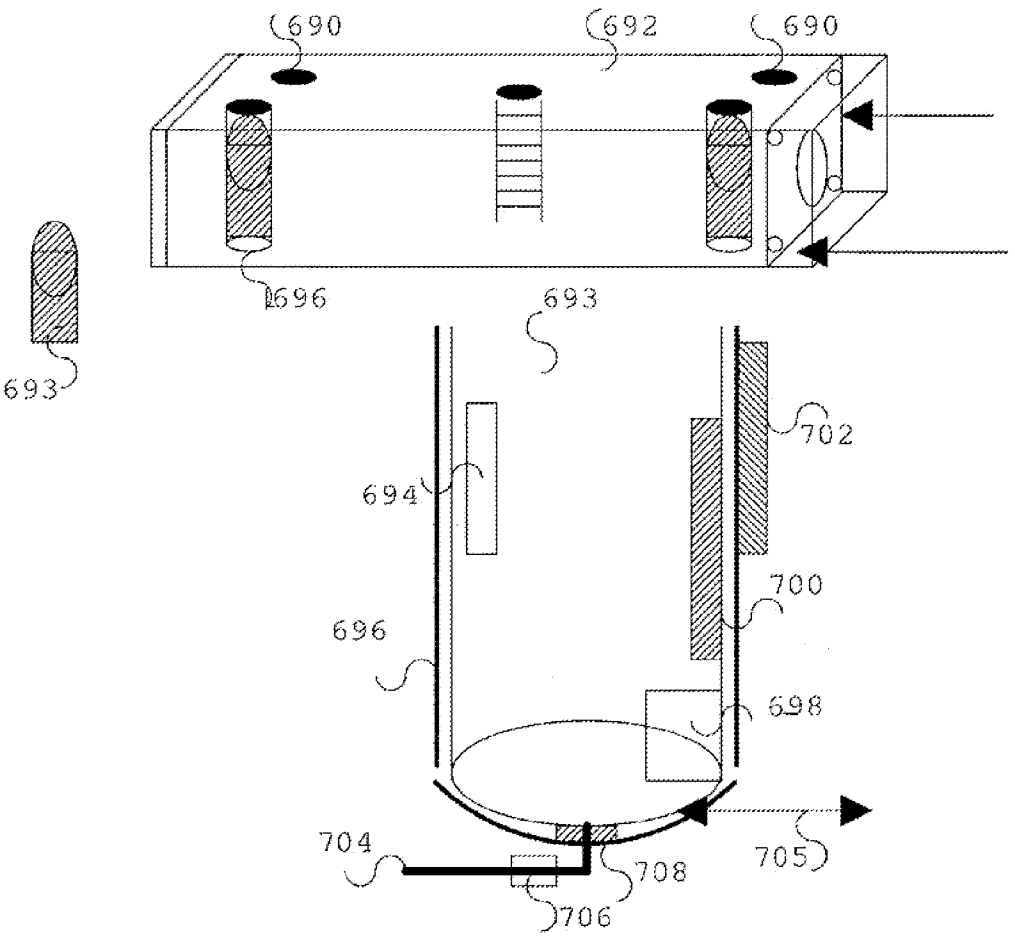
FIG. 70 is a block diagram illustrating an emergency escape capsule design for a J-Type Underwater Vehicle.

FIG. 70 is a block diagram illustrating an emergency escape capsule (EEC) design for a J-Type Underwater Vehicle. The JUV can be designed to reduce casualty rate to a minimum. For example, every crew member in the JUV can have an individual EEC 693 for use during emergency evacuation. This is similar in concept to a pilot ejecting seat with parachute for fighter jets. The EEC 693, for example, can be included within a crew cabin module 692 (e.g., as described in FIG. 23).

The crew cabin module 692 includes a vertical launch tube 696 for each EEC 693. The EEC 693 is accessible to a crew member via an outer security door 702 (e.g., within the vertical launch tube 696) and an inner security door 700 (e.g., within the EEC module 693). During an emergency (e.g., when the JUV is under attack or has been targeted or impacted by a torpedo or missile), a crew member can enter the EEC 693, closing both the outer security door 702 and the inner security door 700. The inner security door 700 can include one or more o-rings or other mechanism to seal the opening from water leakage upon evacuation.

Once inside the EEC 693, in some implementations, the crew member can continue to operate the JUV from a USPECM temporary operating console 694. The temporary operating console 694, for example, provides the crew member with a limited interface for monitoring the JUV systems and issuing commands. In some implementations, the temporary operating console 694 can be implemented within a small portable computing device (e.g., laptop computer, notebook computer, dumb terminal, personal digital assistant (PDA), etc.).

The EEC 693 can also include an emergency kit 698 containing items needed for the crew member to survive for a period of time prior to rescue. The emergency kit 698, for example, can include water, food, an oxygen canister, and/or a satellite radio. In some implementations, the EEC 693 can include a GPS beacon to facilitate rescue of the crew member.

In the event of evacuation, an autonomous cap 690 at the top of the vertical launch tube 696 opens, providing an escape route for the EEC 693. The autonomous cap 690, in some implementations, can be designed in the manner described in FIGS. 57 through 59. The vertical launch tube 696 includes an air bag explosive 708. When the EEC 693 is ejected, a valve 706 opens to introduce high pressure air 704 to the base of the EEC 693. The air bag explosive 708 is detonated, ejecting the EEC 693 from the vertical launch tube 696. In some implementations, the air bag explosive 708 is detonated in response to a signal from a USPECM interface 705. The USPECM detonation command, in some implementations, can originate from a trigger (e.g., switch, button, etc.) within the EEC 693 or a command sequence issued at the temporary operating console 694 within the EEC 693. In other implementations, upon the crew member preparing for evacuation within the EEC 693 (e.g., closing of both the outer security door 702 and the inner security door 700, fastening a safety harness, etc.), the ESPECM central monitor can automatically eject the EEC 693.

Once the EEC 693 has been ejected from the vertical launch tube 696, the EEC 693 will break the surface of the water and float. The EEC 693 can be manufactured using light pressure-resistant material which will float upon the surface of the water.

Figure 71:
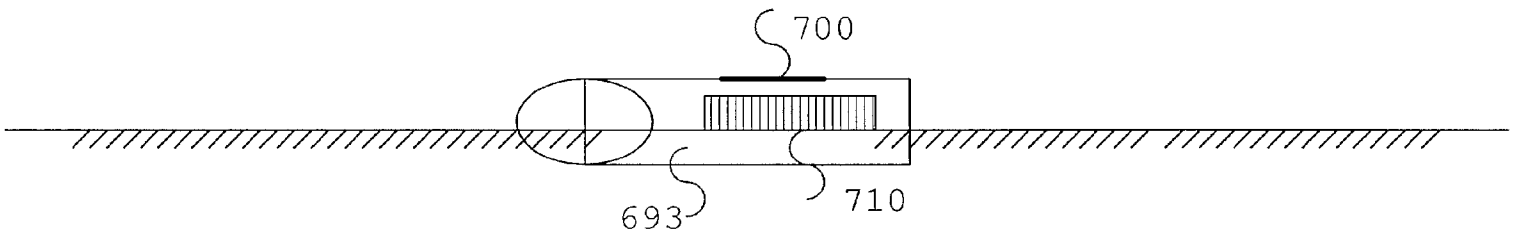
FIG. 71 is a block diagram illustrating an air float design for the emergency escape capsule of FIG. 70.

FIG. 71 is a block diagram illustrating an air float design for the emergency escape capsule of FIG. 70. In some implementations, after the EEC 693 has been ejected from the JUV, the EEC 693 can become afloat by inflating a side airbag 710. The side airbag 710 is positioned at approximately a 90 degree rotation from the door 700. The side airbag, in some implementations, can be automatically inflated upon ejection of the EEC 693 (e.g., based upon a timer, etc.).

JUV Modular Power Management

Figure 72:
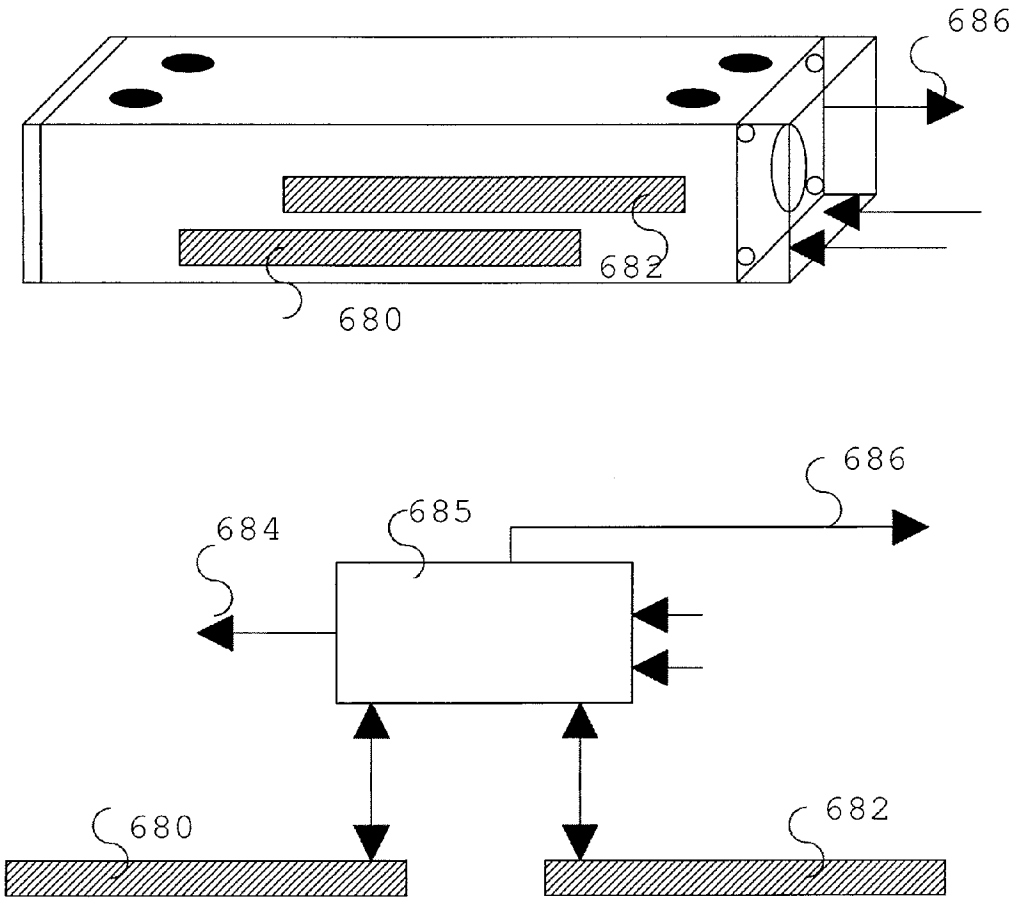
FIG. 72 is a block diagram illustrating a battery and ballast system design for a module of a J-Type Underwater Vehicle.

FIG. 72 is a block diagram illustrating a battery and ballast system design for a module of a J-Type Underwater Vehicle. One or more of the modules included within a JUV unit (e.g., the bow module 23, the buoyancy module 11, the weaponry module 12, the central command, control, and communication module 15, the engine and propulsion module 17, the air module 19, and/or the stern fuel module 21) can have a set of battery bays 680, 682 placed at the bottom of the module to supply electricity to the individual module. The bottom position of the battery bays 680, 682 can aid in the ballast weighting of the JUV unit, helping to keep the JUV in a level position.

A USPECM battery management circuit 685 can monitor the charge level of each battery bay 680, 682. For example, the battery management circuit 686 can include a USPECM power input 684, electrical connections to each battery bay 680, 682, and a USPECM communications connection 686 to the USPECM central monitor.

Submarine Surveillance & Tracking Network (SSTN)

One of the design goals of the JUV is to detect and track adversary submarines, especially a nuclear-powered submarine. A nuclear submarine can remain submerged for as long as six months without being detected. A nuclear submarine can carry nuclear weaponry, posing a serious threat to national security. A traditional submarine during operation can generate a large amount of heat, wave ripples, engine sound, and active sonar signals. The range of detecting an adversary submarine by sonar can vary from a few miles to about 50 miles.

A Submarine. Surveillance and Tracking Network (SSTN) can include a Long Underwater Cable (LUC) and a fleet of Submarine Tracking JUV (ST_JUV) units configured for locating adversary submarines. The LUC can be used to detect any submarine or surface vessels crossing the LUC line laid between two islands or end nodes (e.g., anchored buoys, submerged landmarks, etc.) through the use of passive sonar and temperature sensors. The LUC can use a USPECM sonar array network to implement the passive sonar and temperature sensors.

When an adversary submarine is detected while crossing the SSTN LUC line, an end-station of the LUC (e.g., island, buoy anchor unit, underwater landmark-based unit, etc.) can report to a USPECM command center for deployment of the nearest ST_JUV units to track and escort the detected submarine until it no longer poses a threat. Many ST_JUV units can be deployed, each taking turns in tracking the adversary submarine.

Upon deployment, an ST_JUV unit can use sonar to verify the position of the adversary submarine. The ST_JUV unit may then send out warning and/or deterrence signals. Although this will expose the ST_JUV to the adversary submarine, the adversary submarine will only learn the direction of the ST_JUV unit and not the range. For example, the ST_JUV can adjust the power of the emitted sonar wave to obscure the exact distance (e.g., reflected sonar wave) of its position from the adversary submarine.

The ST_JUV can be configured with a heat seeking device and a sonar system on the bow module and the stern module, as well as sonar and/or heat seeking elements mounted on the hull surface of any additional module(s) of the JUV.

When compared with the adversary submarine built with a traditional design, the JUV units can be faster, quieter, and more maneuverable. The JUV units can also better avert detection due to the sonar reflection characteristics of the flat hull (e.g., as described in FIGS. 9 and 10). Additionally, the JUV units can be configured with a deep sea communications system (e.g., through the use of the RWP as described in FIGS. 25 through 30) used to communicate with a base station (e.g., aircraft carrier, island-based deployment station, etc.) and/or between JUV units without the need for surfacing. Due to lower power requirements and smaller crew needs, the JUV units can remain deployed for a longer period of time than a traditional submarine without exceeding resources. All these advantages can be used to successfully out-maneuver a potential adversary submarine.

Figure 73:
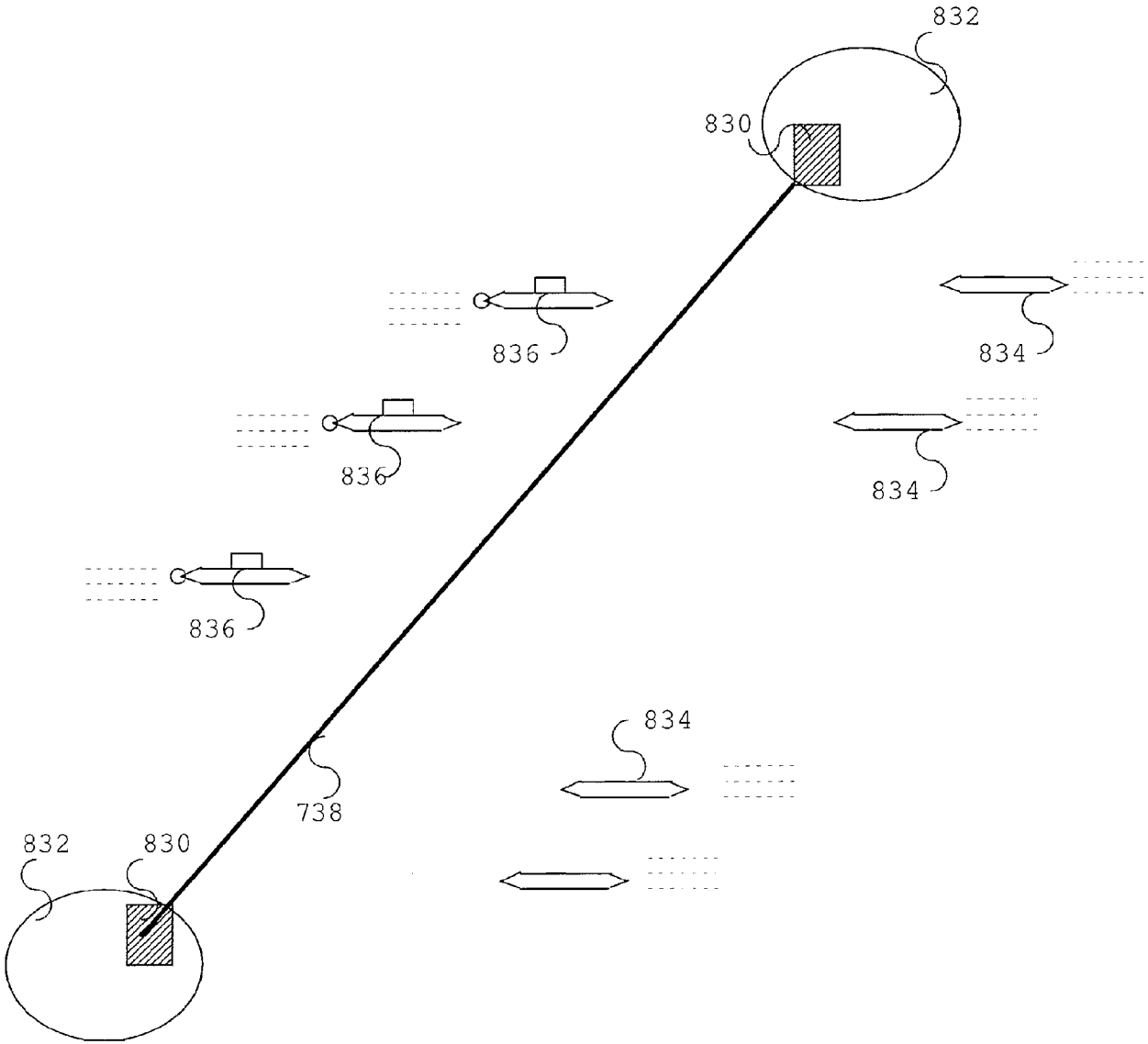
FIG. 73 is a block diagram illustrating a submarine surveillance and tracking network.

FIG. 73 is a block diagram illustrating a submarine surveillance and tracking network. A long underwater cable (LUC) 738 extends along the ocean floor between two end stations 7830. The end stations 830, as illustrated, are positioned upon two islands 832, separated by the distance of the LUC 738. The LUC 738, in some implementations, can be up to 1000 miles long. Three adversary submarines 836 are illustrated approaching the LUC 738 from the left. Four ST_JUV units 834 are illustrated approaching the LUC 738 from the right.

Figure 74:
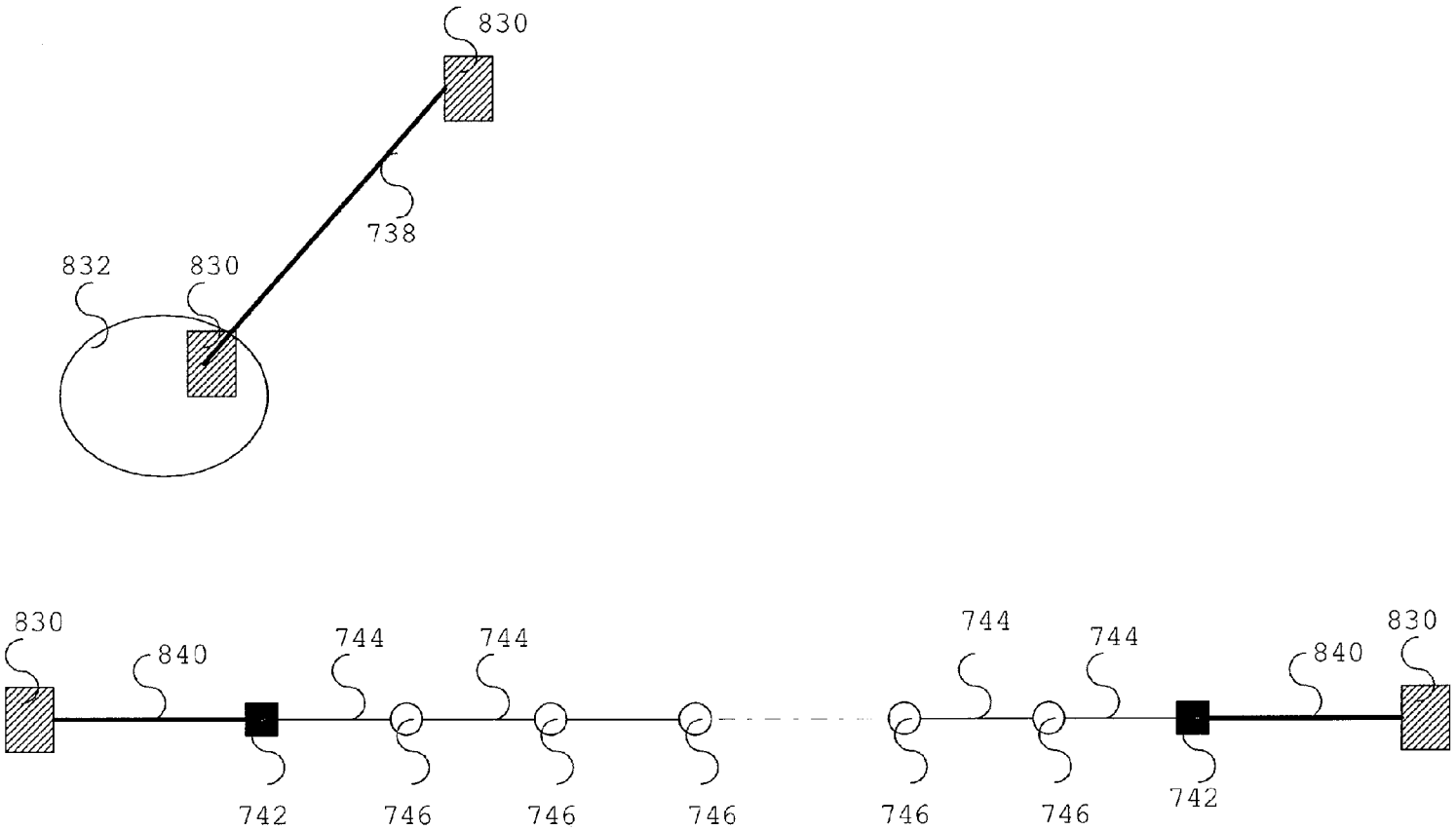
FIG. 74 is a network diagram illustrating a long underwater cable architecture for use in a submarine surveillance and tracking network.

FIG. 74 is a network diagram illustrating a long underwater cable architecture for use in a submarine surveillance and tracking network. The LUC includes the two end stations 830. A portion of fiber optic cable 840 connects each end station 830 to a first sonar node 742. The fiber optic cable 840, for example, includes DC power and a USPECM interface for powering and providing a communications path for the sonar node 742. In some implementations, the fiber optic cable 840 can be up to a few miles long. The fiber optic cable 840, for example, can be protected by a non-corrosive waterproof sheath for underwater installation.

Additional sonar nodes 746 are arranged across the length of the LUC 738. A communications cable 744 runs between the sonar nodes 746 and connects the sonar nodes 746 to the first sonar nodes 742. The communications cable 744, in some examples, can be a Cat-5 Ethernet cable or fiber optic cable with DC power. The communications cable 744 carries USPECM signals between the sonar nodes 744, 742.

Figure 75:
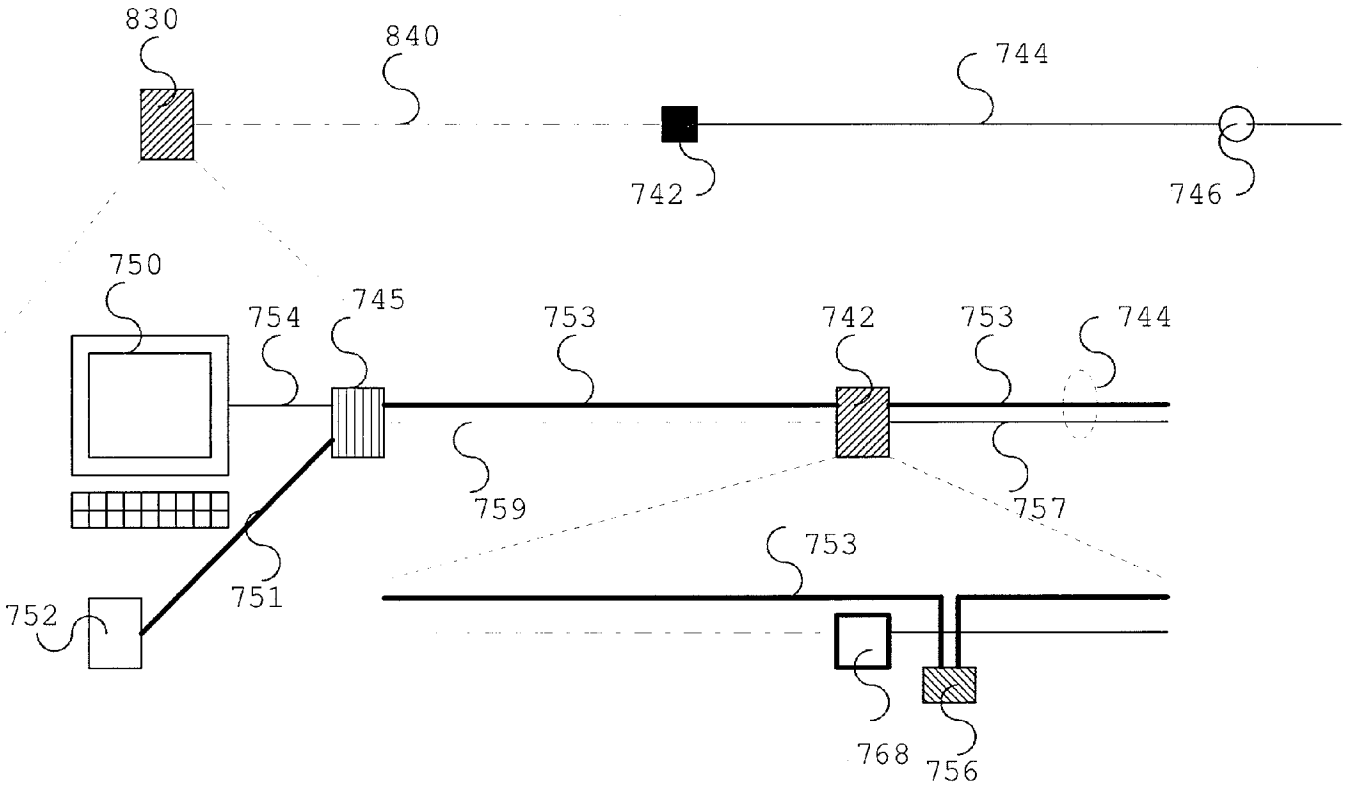
FIG. 75 is a network diagram illustrating an end-station and long underwater cable architecture with sonar node for use in a submarine surveillance and tracking network.

FIG. 75 is a network diagram illustrating the end-station 830 and long underwater cable architecture with sonar node for use in a submarine surveillance and tracking network. The end station 830 includes a monitoring station 750. The monitoring station 750, for example, can be designed in a similar manner to the USPECM monitoring station 420 as described in FIGS. 49 and 50. The end station 830 also includes a DC power generator 752 to provide the DC power input required for the LUC. A USPECM interface 754 (e.g., 1 GbE 10/100/1000Base-TX, 1000Base-TX, etc.) connects the monitoring station 750 to a multiplexer 745. The DC power generator 752 is also connected to the multiplexer 745 via a DC power cable 751. The multiplexer 745 multiplexes the DC power provided by the DC power generator 752 and the USPECM traffic from the monitoring station 750. The multiplexer then supplies the multiplexed power and USPECM communications transmission to the LUC 738 through the fiber optic cable 840.

The LUC 738 can include any number of sonar nodes 742, 746. The first sonar node 742 receives power from a DC power cable portion 753 of the fiber optic cable 840 and USPECM communications from a fiber optic interface portion 759 (e.g., 10/100/1000Base-X, 1000Base-TX, etc.) of the fiber optic cable 840. The sonar node 742, in some implementations, is a USPECM sonar node with a temperature sensor. The sonar node 742 includes a USPECM sonar FPGA/ASIC 768. The FPGA/ASIC 768 has a built-in GbE switch for switching traffic between different sonar nodes 742, 746 and the base stations 830. The sonar node 742 also includes a battery management unit 756 with a DC battery and battery management logic. The battery management unit 756, for example, can provide auxiliary DC power as necessary to operate the USPECM sonar node. Between each of the sonar nodes 742, 746, the communications cable 744 includes the DC power cable portion 753 and a fiber optic cable portion 757 (e.g., 1 GbE Cat-5 cable, 1000Base-X fiber optic cable, etc.).

In other implementations, rather than using two end stations 830 as described, at least one of the end stations 830 can be replaced with a wireless transmission unit. For example, in the event of a failure at the main end station 830, a portable monitoring device (e.g., notebook computer, PDA, etc.) or the monitoring station of a JUV (e.g., using the RWP as described in FIGS. 24 through 30) could be brought within range of a wireless transmission unit (e.g., built into a buoy, etc.) to receive the USPECM signal data from the LUC. Other configurations are possible.

Figure 76:
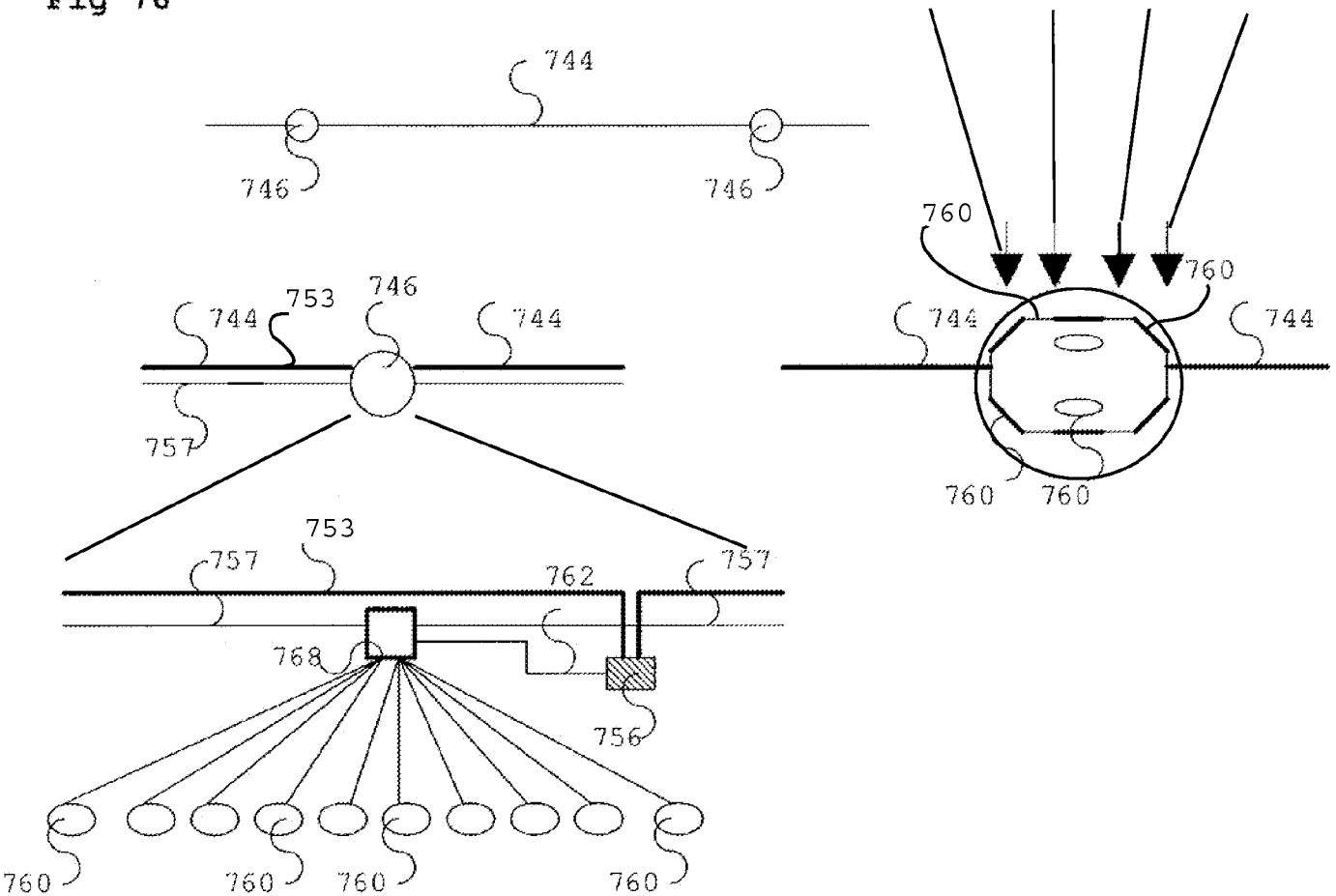
FIG. 76 is a block diagram illustrating a sonar node for use in a submarine surveillance and tracking network.

FIG. 76 is a block diagram illustrating a sonar node for use in a submarine surveillance and tracking network. The sonar node 746 includes one or more USPECM sensor devices 760 (e.g., piezoelectric hydrophone sensor, temperature sensor, piezoelectric transducers, etc.). The USPECM sensor devices 760, for example, can each connect to the FPGA/ASIC 768 of the sonar node 746. In some implementations, the USPECM sensor devices 760 are arranged around each sonar node to provide omni-directional detection of engine noise, active sonar pulses and/or propeller ripple waves. When manufactured in bulk (e.g., thousands of units), each sonar node may cost less than $3,000 to produce.

Figure 77:
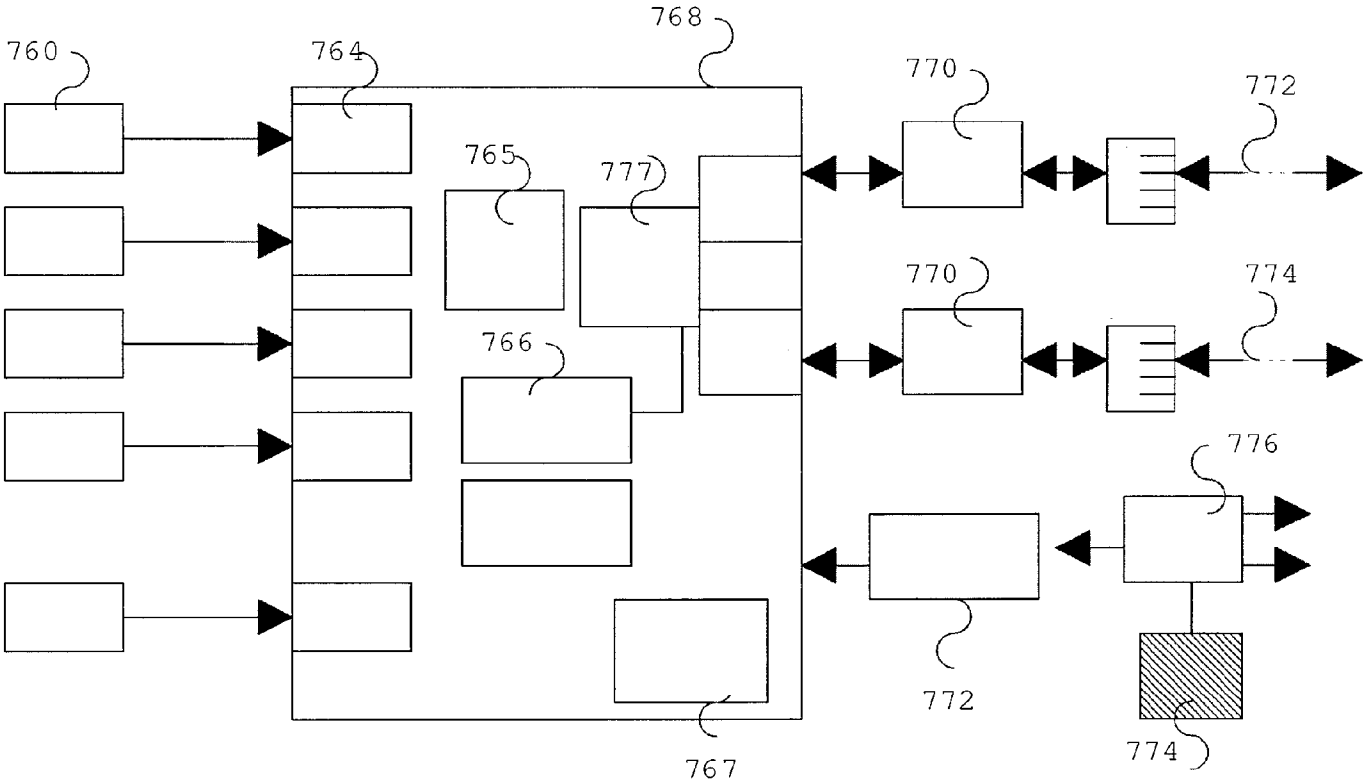
FIG. 77 is a hardware diagram illustrating an exemplary circuitry layout of a sonar node for use in a submarine surveillance and tracking network.

FIG. 77 is a hardware diagram illustrating an exemplary circuitry layout of a sonar node for use in a submarine surveillance and tracking network. Similar to the USPECM hull sonar as described in FIGS. 47 and 48, the SSTN sonar node (e.g., sonar nodes 742, 746 as described in FIGS. 74 through 76) can include multiple USPECM piezoelectric hydrophone/transducer sensor elements 760. The piezoelectric transducer of the SSTN sonar node can detect small ripples generated by a submarine's propeller. Additionally, the piezoelectric transducer can be used to detect the sonar pulses generated by a submarine for surveying the depth of the ocean floor to ensure safe navigation. In some implementations, the USPECM piezoelectric transducer can be maintained regularly through one or more USPECM vibration elements 760 for shaking off any collected debris (e.g., sand, silt, seaweed, etc.).

Internal to the sonar node 742, 746, the FPGA/ASIC 768 includes a built-in three-port Ethernet switch 777 used to switch between an upstream USPECM interface 772 (e.g., the cable 840, 744 to the first side of the sonar node 742, 746), a downstream USPECM interface 774 (e.g., the cable 744 to the second side of the sonar node 742, 746), and a local Ethernet USPECM interface. The Ethernet switch 777, for example, can route traffic to either of the end stations 830.

The FPGA/ASIC 768 collects signals from the USPECM devices 760. In the case of piezoelectric transducer devices 760, the signals are filtered by a digital signal processor (DSP) to isolate significant events (e.g., submarine engine sound recognition, surface vessel propeller sound recognition, propeller ripple wave recognition, etc.). The FPGA/ASIC can use one or more data reduction algorithms to compress the collected signal data before forwarding to the end station(s) 830. A USPECM real-time clock 767 can be used to timestamp the collected signals prior to transmission.

The sonar node 742,746 transmits data representing significant events through a set of 1 GbE physical layer devices 770 to both the upstream end station 830 and the downstream end station 830. The data transmission and basic USPECM device logic composition, for example, is similar to the generic USPECM controller device as described in FIG. 44. The sonar nodes 742, 746 additionally include a power supply switch 776 for switching the power feed between the DC power line (e.g., the DC power portion 753 of the cable 840 as shown in FIG. 76) and a battery 774. A power regulator 772 normalizes the input power (e.g., from +4.8V to +3.3V).

Figure 78:
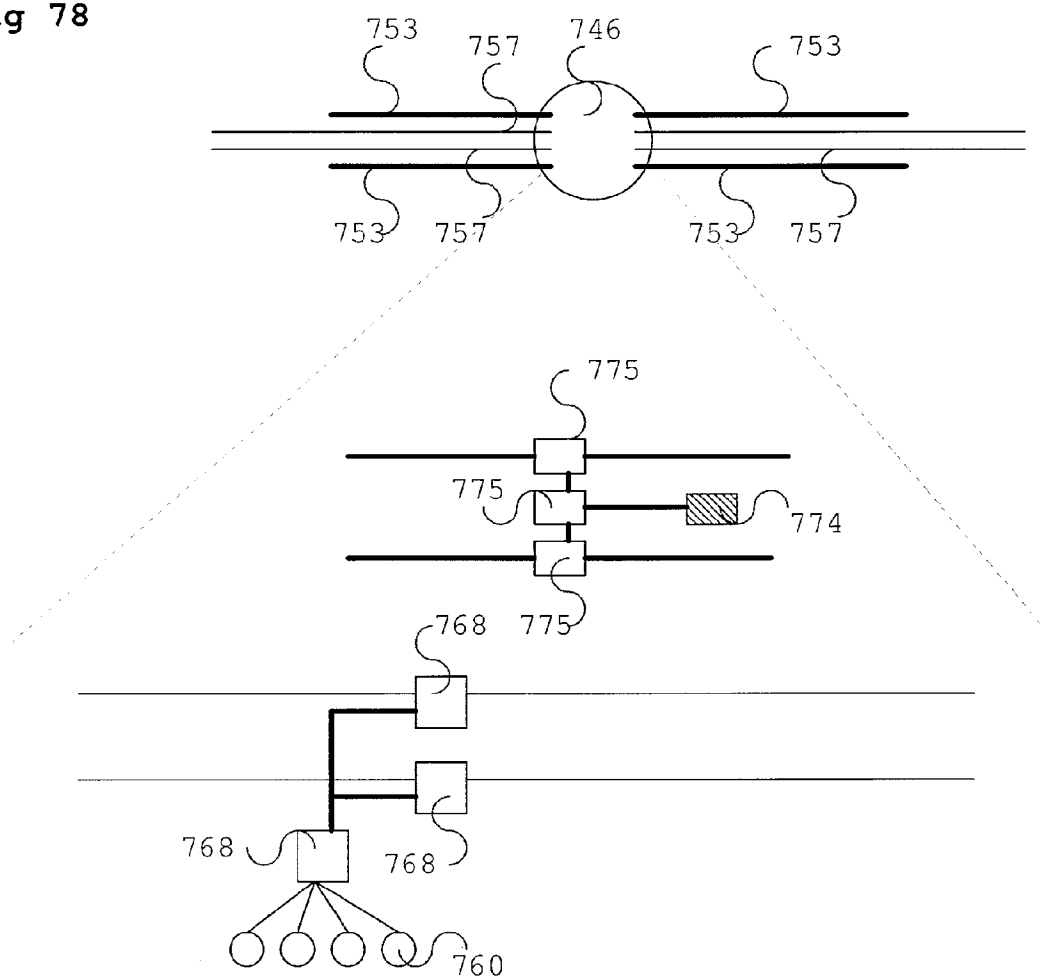
FIG. 78 is a block diagram illustrating a redundancy design for use with the sonar node of FIG. 76.

FIG. 78 is a block diagram illustrating a redundancy design for use with the sonar node of FIG. 76. The DC power feed and the battery management can be important in keeping the SSTN robust and operable for a long period of time. Typically, DC power can be generated from both end stations 830 (e.g., as shown in FIG. 74). In the event that a failure occurs in the DC power line (e.g., the DC power portion 753 of the cable 840) or the USPECM Ethernet interface (e.g., fiber optic cable portion 757 of the cable 840), the LUC can recover resiliently due to the redundant power feeds 753 and communication feeds 753. In the event that a failure occurs, the battery 774 in the middle sonar node can supply the power to adjacent nodes.

In a redundant power configuration, a DC power switch 775 can control which source supplies DC power to the local electronics: the upstream DC power 753, the downstream DC power 753, or the local battery 774. In some implementations, the battery 774 can be a lithium-ion battery. For example, at a charge level of 40 percent, stored within a water temperature of 34 degrees Fahrenheit, a lithium-ion battery will only lose approximately two percent of charge annually. With proper battery management, the local DC battery 774 within the sonar node 742, 746 can last for years, assuming the majority of the time the sonar nodes 742, 746 will be powered by the DC power line 753.

In some implementations, each sonar node 742, 746 can also include redundant ASIC/FPGA units 768. In the some implementations, a USPECM device multiplexer within the ASIC/FPGA unit 768 can provide redundant signals between the USPECM devices 760 (e.g., as shown in FIG. 77) and the redundant ASIC/FPGA units 768. For example, the upstream ASIC/FPGA 768 can provide signals to the upstream base station 830, while the downstream ASIC/FPGA 768 can provide signals to the downstream base station 830. In other implementations, the USPECM main communication path may be switched from the upstream ASIC/FPGA 768 to the downstream ASIC/FPGA 768 or vice-versa in the event of a communications failure.

Figure 79:
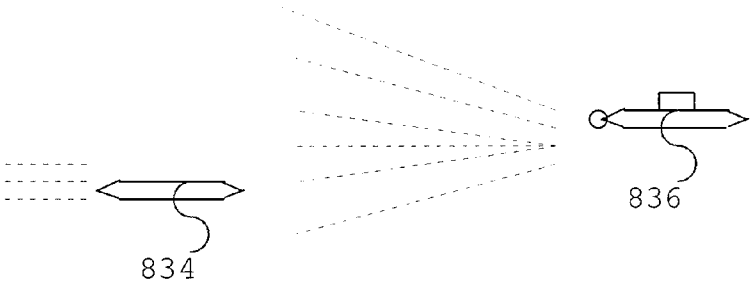
FIG. 79 is a diagram illustrating a J-Type Underwater Vehicle configured for tracking and surveillance.

FIG. 79 is a diagram illustrating a J-Type Underwater Vehicle configured for tracking and surveillance. The ST_JUV 834 can detect and track the adversary submarine 736 by detecting the engine sound, the ripple waves generated by the propeller, and/or the excess heat generated by the adversary submarine 836. In some implementations, the ST_JUV units 834 can be configured with one or more weaponry modules (e.g. WP module 12 as shown in FIG. 2 and described in FIG. 19) for use in engaging adversary submarines. The ST_JUV units 834, for example, can include a crew cabin module (e.g., CR/C3 module 15 as shown in FIG. 2 and described in FIG. 23) for manned operation.

Figure 80:
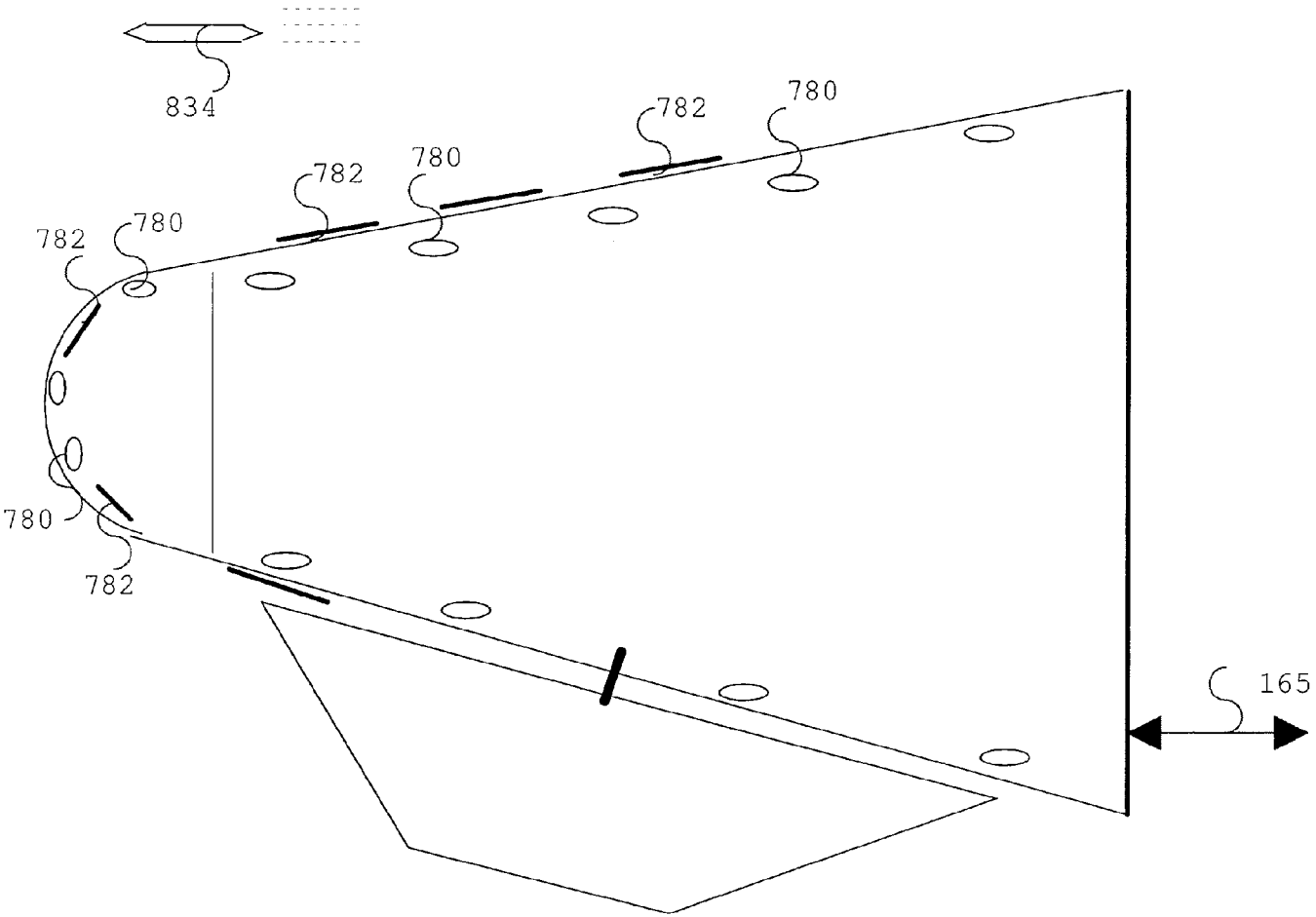
FIG. 80 is a block diagram illustrating a hull configuration for the J-Type Underwater Vehicle of FIG. 79.

FIG. 80 is a block diagram illustrating a hull configuration for the J-Type Underwater Vehicle of FIG. 79. The ST_JUV 834 can include one or more hull surface sonar devices 780 and one or more heat sensors 782 arranged along the entire hull/bow module. As shown in FIG. 80, a series of twelve surface sonar devices 780 are spaced evenly along the bow or stern module. The sonar devices 780 can detect engine noise, propeller ripple waves, propeller noise, and/or the sonar pulse sound of an adversary submarine. A series of six heat sensors 782 are mounted evenly on the surface of the hull. The heat sensors 782, as illustrated in FIG. 80, are not arranged within the path of the rudder(s). Accordingly, other embodiments are within the scope of the following claims.

What is claimed is:

1. A underwater vehicle comprising:

a hull that is angular in shape having a central portion and capable of avoiding sonar detection, the hull including a bow and a stern that are substantially the same in size and shape to one another;

a plurality of reconfigurable modules substantially the same size and shape that are interconnected to form a majority of the hull of the underwater vehicle, at least three of the reconfigurable modules including equipment for performing specific functions, each of the specific functions being different from each other and each of the specific functions being associated with operation of the underwater vehicle;

one or more engines that are mounted in any one of the plurality of reconfigurable modules without regard to module position in the hull; and a retractable wireless communication system, the retractable wireless communication system comprising a fiber optic remote control, a monitoring system and a rising pole with level balance weight;

wherein the rising pole is stowed at a 0 degree angle to the hull of the underwater vehicle while submerged and cruising;

wherein the rising pole is elevated to a 30 degree angle or a 90 degree angle to the hull of the underwater vehicle to perform periscope functionality, wireless communication functionality or snorkeling functionality; and wherein the plurality of reconfigurable modules are configured to be connected to one another in any order.

2. The underwater vehicle of claim 1, wherein the retractable wireless communication system does not require the use of a conning tower.

3. The underwater vehicle of claim 1, further comprising:

an Ethernet system utilized to control and monitor for autonomous, remote-controlled, or manual operation of the underwater vehicle wherein one of the plurality of reconfigurable modules is configured to monitor and control the underwater vehicle.

4. The underwater vehicle of claim 1, further comprising:

a symmetric rudder design that uses substantially the same rudder shape for both horizontal and vertical navigational control of the underwater vehicle wherein the symmetric rudders are mounted on both the bow and the stern.

5. The underwater vehicle of claim 1, further comprising:

multiple sets of a propulsion propeller and a shaft, both located underneath the hull of the underwater vehicle.

6. The underwater vehicle of claim 1, wherein the plurality of reconfigurable modules include a redundant manifold pipeline design.

7. The underwater vehicle of claim 1, wherein the angular hull design is substantially square in shape.

8. The underwater vehicle of claim 3, wherein the Ethernet system comprises:

a plurality of intelligent sensors, each sensor being individually controlled, monitored, and recorded.

9. The underwater vehicle of claim 8, wherein the sensors are powered based on the Power over Ethernet IEEE standard, and the sensors are configured based on Application Specific Integrated Circuit or Field Programmable Gate Array design.

10. The underwater vehicle of claim 3, wherein the Ethernet system comprises a plurality of electronic devices capable of synchronization within microseconds, and further wherein the Ethernet system utilizes only three layers of the Open Systems Interconnection Basic Reference Model throughout the system.

11. The underwater vehicle of claim 3, further comprising:

a router configured to relay information from the intelligent sensors to one or more command control stations, and a central monitor router configured to provide one or more system monitoring stations.

12. The underwater vehicle of claim 1, further comprising a connector to attach the plurality of reconfigurable modules to one another wherein the connector includes a plurality of module connection reinforcement connectors.

13. The underwater vehicle of claim 1, wherein the bow and the stern are the same in size and shape.

14. The underwater vehicle of claim 1, wherein the size of the underwater vehicle is large enough to transport a passenger underwater.

15. The underwater vehicle of claim 5, wherein the propulsion propeller and the shaft are located near the central portion of the underwater vehicle.

16. An underwater vehicle comprising:

a hull that is angular in shape and capable of avoiding sonar detection, the hull including a bow and a stern that are substantially the same in size and in shape to one another;

a plurality of reconfigurable modules substantially the same size and shape that are interconnected to form a majority of the hull of the underwater vehicle, at least three of the reconfigurable modules including equipment for performing specific functions, each of the specific functions being different from each other and each of the specific functions being associated with operation of the underwater vehicle; and a retractable wireless communication system, the retractable wireless communication system comprising a fiber optic remote control, a monitoring system and a rising pole with level balance weight;

wherein the rising pole is stowed at a 0 degree angle to the hull of the underwater vehicle while submerged and cruising; and wherein the rising pole is elevated to a 30 degree angle or a 90 degree angle to the hull of the underwater vehicle to perform periscope functionality, wireless communication functionality or snorkeling functionality.

17. The underwater vehicle of claim 16, further comprising:

an Ethernet system utilized to control and monitor for autonomous, remote-controlled, or manual operation of the underwater vehicle.

18. The underwater vehicle of claim 16, wherein the plurality of reconfigurable modules are capable of being built in a warehouse away from a shipyard and assembled to form the underwater vehicle at the shipyard.

19. The underwater vehicle of claim 16, wherein the size of the underwater vehicle is large enough to transport a passenger underwater.

20. A method of constructing an underwater vehicle at a port comprising the steps of:

connecting a bow module to a first plurality of reconfigurable modules to form a first module combination wherein connecting the bow module is by welding;

connecting a stern module to a second plurality of reconfigurable modules to form a second module combination wherein connecting the stern module is by welding;

housing a retractable wireless communication system in a first plurality of reconfigurable modules, the retractable wireless communication system comprising a fiber optic remote control, a monitoring system and a rising pole with level balance weight; and moving the first module combination and second module combination into a body of water at the port and securing the respective module combinations above the water to form an underwater vehicle;

wherein connecting the plurality of reconfigurable modules is by a plurality of module connection reinforcement connectors and hardware;

wherein modules in the first and the second plurality of reconfigurable modules are substantially the same in size and shape;

wherein the rising pole is stowed at a 0 degree angle to the first plurality of reconfigurable modules of the underwater vehicle while submerged and cruising; and wherein the rising pole is elevated to a 30 degree angle or a 90 degree angle to the first reconfigurable modules of the underwater vehicle to perform periscope functionality, wireless communication functionality or snorkeling functionality.

21. A method of constructing an underwater vehicle at a port of claim 20, wherein connecting the bow and stern module is by welding.

22. A method of constructing an underwater vehicle of at a port of claim 20, further comprising the steps of:

rotating the underwater vehicle upside down and securing the underwater vehicle so the bottom side is above the waterline;

installing a set of propulsion propellers and a supporting frame on the bottom side of the underwater vehicle;

rotating the underwater vehicle right side up; and installing a redundant manifold pipeline system and interconnecting all mechanical and electrical connections within each modular connection area.

* * * * *